US009494899B2

(12) United States Patent
Nakahara et al.

(10) Patent No.: US 9,494,899 B2
(45) Date of Patent: Nov. 15, 2016

(54) FIXING DEVICE AND HEATER USED IN FIXING DEVICE

(71) Applicant: CANON KABUSHIKI KAISHA, Tokyo (JP)

(72) Inventors: Hisashi Nakahara, Numazu (JP); Hideaki Yonekubo, Suntou-gun (JP); Satoru Taniguchi, Mishima (JP); Hiroyuki Sakakibara, Yokohama (JP); Koji Nihonyanagi, Susono (JP); Yasuhiro Shimura, Yokohama (JP); Nozomu Nakajima, Kawasaki (JP); Yuji Fujiwara, Susono (JP); Yusaku Iwasawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/749,454

(22) Filed: Jun. 24, 2015

(65) Prior Publication Data

US 2015/0293483 A1 Oct. 15, 2015

Related U.S. Application Data

(63) Continuation of application No. 14/103,503, filed on Dec. 11, 2013, now Pat. No. 9,098,035.

(30) Foreign Application Priority Data

Dec. 17, 2012 (JP) ..... 2012-274526
Dec. 4, 2013 (JP) ..... 2013-251320

(51) Int. Cl.

| | |
|---|---|
| ***G03G 15/20*** | (2006.01) |
| ***H05B 3/03*** | (2006.01) |
| ***H05B 3/10*** | (2006.01) |
| ***H05B 3/06*** | (2006.01) |
| ***H05B 3/26*** | (2006.01) |

(52) U.S. Cl.

CPC ..... *G03G 15/2053* (2013.01); *H05B 3/03* (2013.01); *H05B 3/06* (2013.01); *H05B 3/26* (2013.01); *G03G 15/2042* (2013.01); *G03G 2215/2035* (2013.01); *H05B 2203/007* (2013.01); *H05B 2203/011* (2013.01); *H05B 2203/016* (2013.01)

(58) Field of Classification Search

None

See application file for complete search history.

(56) References Cited

U.S. PATENT DOCUMENTS 5,068,517 A * 11/1991 Tsuyuki et al. ..... 219/543
5,391,861 A * 2/1995 Ooyama et al. ..... 219/543

(Continued)

FOREIGN PATENT DOCUMENTS

JP 2005209493 A * 8/2005 ..... H05B 3/10
JP 2010002857 A * 1/2010

*Primary Examiner* — Joseph M Pelham

(74) *Attorney, Agent, or Firm* — Canon U.S.A., Inc. IP Division

(57) ABSTRACT

A heater used for a fixing device includes a substrate, first and second conductor patterns formed at either end of the substrate in the short direction of the substrate, a third conductor pattern formed between the first and second conductor patterns and separated from the two conductor patterns, a first heating member disposed between the first and third conductor patterns and electrically connected to the two conductor patterns, and a second heating member disposed between the second and third conductor patterns and electrically connected to the conductor patterns. The heater has both end regions in which the widths of the third conductor pattern in the short direction is smaller than that of a middle portion of the third conductor pattern. The widths of the first and second heating members in the end regions are smaller than the widths of the first and second heating members in the other region, respectively.

12 Claims, 30 Drawing Sheets

(56) References Cited

U.S. PATENT DOCUMENTS

| | | | | |
|---|---|---|---|---|
| 8,175,508 | B2 * | 5/2012 | Kageyama | 399/329 |
| 8,592,726 | B2 * | 11/2013 | Tsuruya et al. | 219/216 |
| 2003/0185605 | A1 * | 10/2003 | Okabayashi | 399/329 |
| 2009/0230114 | A1 * | 9/2009 | Taniguchi et al. | 219/216 |
| 2014/0027441 | A1 * | 1/2014 | Mine et al. | 219/538 |
| 2014/0169845 | A1 * | 6/2014 | Nakahara et al. | 399/328 |
| 2015/0341985 | A1 * | 11/2015 | Nakayama | 219/216 |

* cited by examiner

FIXING DEVICE AND HEATER USED IN FIXING DEVICE

CROSS-REFERENCE TO RELATED APPLICATIONS

This application is a continuation of U.S. patent application Ser. No. 14/103,503 filed Dec. 11, 2013, which claims the benefit of Japanese Patent Application No. 2012-274526 filed Dec. 17, 2012 and No. 2013-251320 filed Dec. 4, 2013, all of which are hereby incorporated by reference herein in their entirety.

BACKGROUND OF THE INVENTION

1. Field of the Invention

The present invention relates to a fixing device mounted in image forming apparatuses, such as electrophotographic copying machines and electrophotographic printers, and a heater used in the fixing device.

2. Description of the Related Art

In recent years, a film heating fixing device mounted in electrophotographic copying machines or electrophotographic printers has been in practical use.

In general, such a film heating fixing device includes a cylindrical film, a plate-like heater that is in contact with the inner surface of the film, and a pressing member that forms a nip portion together with the heater via the film. Since the film heating fixing device can be produced using a low heat-capacity member, the amount of power consumption and the wait time for heating can be advantageously reduced.

However, since the film heating fixing device includes a low heat-capacity member, the temperature of a non-sheet passage area from which heat is not removed by a recording medium easily rises if printing is continuously performed on recording media of a small size. That is, a temperature rise of a non-sheet passage area easily occurs.

To address such an issue, Japanese Patent Laid-Open No. 2005-234540 describes a heater including a heat generating resistor having a positive temperature coefficient (PTC). FIG. 10 illustrates a heater having such a configuration. The heat generating resistor of the heater having a PTC has a conductor electrode portion in each of an upstream section and a downstream section thereof in a direction in which a recording medium is conveyed. An electrical current is applied to the heat generating resistors in the direction in which a recording medium is conveyed. As a result, the electrical resistance of the heater increases with increasing temperature of a non-sheet passage area. Accordingly, heat generation in the non-sheet passage area is reduced and, thus, a temperature rise of a non-sheet passage area is reduced.

In recent years, to further reduce FPOT (first print out time) and power consumption, the size and heat capacity of each of the components of a fixing device have been reduced. Thus, more strict prevention of a temperature rise of a non-sheet passage area is needed. As a result, a heater having an effect to prevent a temperature rise of a non-sheet passage area greater than that of the heater described in Japanese Patent Laid-Open No. 2005-234540 is needed.

SUMMARY OF THE INVENTION

According to a first aspect of the invention, a heater for used in a fixing device that fixes a toner image onto a recording medium bearing the toner image is provided. The heater includes an elongated substrate, a first conductor pattern formed at one end of the substrate in a short direction of the substrate and a second conductor pattern formed at the other end, a third conductor pattern formed between the first conductor pattern and the second conductor pattern in the short direction of the substrate, where the third conductor pattern is separated from each of the first conductor pattern and the second conductor pattern, a first electrical contact portion disposed at one of both ends of the first conductor pattern in a long direction of the substrate and a second electrical contact portion disposed at one of both ends of the second conductor pattern in the long direction of the substrate, a first heat generating resistor electrically connected to the first conductor pattern and the third conductor pattern, where the first heat generating resistor is disposed between the first conductor pattern and the third conductor pattern, and a second heat generating resistor electrically connected to the second conductor pattern and the third conductor pattern, the second heat generating resistor being disposed between the second conductor pattern and the third conductor pattern. The heater has both end regions in the long direction of the substrate in which the widths of the third conductor pattern in the short direction is smaller than the width of a middle portion of the third conductor pattern, and the widths of the first heat generating resistor and the second heat generating resistor in the short direction of the substrate in the end regions are smaller than the widths of the first heat generating resistor and the second heat generating resistor in the short direction of the substrate in a region other than the end regions.

According to a second aspect of the invention, a heater for used in a fixing device that fixes a toner image onto a recording medium bearing the toner image is provided. The heater includes an elongated substrate a first conductor pattern formed at one end of the substrate in a short direction of the substrate and a second conductor pattern formed at the other end with a spacing therebetween, where the first conductor pattern and the second conductor pattern extend in a long direction of the substrate, a first electrical contact portion disposed at one of both ends of the first conductor pattern in the long direction of the substrate and a second electrical contact portion disposed at one of both ends of the second conductor pattern in the long direction of the substrate, and a heat generating resistor electrically connected to the first conductor pattern and the second conductor pattern, where the heat generating resistor is disposed between the first conductor pattern and the second conductor pattern. The heater has both end regions in the long direction of the substrate in which by reducing at least one of the widths of the first conductor pattern and the second conductor pattern in the short direction of the substrate, the spacing is increased to a value larger than that in a middle portion, and the width of the heat generating resistor in the short direction of the substrate in the end regions is larger than the width of the heat generating resistor in a region other than the end regions.

According to a third aspect of the invention, a fixing device for fixing a toner image onto a recording medium bearing the toner image in a nip portion while conveying the recording medium is provided. The device includes a cylindrical film, a heater in contact with an inner peripheral surface of the film, and a pressing member configured to form the nip portion together with the heater via the film. The heater includes an elongated substrate, a first conductor pattern formed at one end of the substrate in a short direction of the substrate and a second conductor pattern formed at the other end, a third conductor pattern formed between the first conductor pattern and the second conductor pattern in the short direction of the substrate, where the third conductor pattern is separated from each of the first conductor pattern and the second conductor pattern, a first electrical contact portion disposed at one of both ends of the first conductor pattern in a long direction of the substrate and a second electrical contact portion disposed at one of both ends of the second conductor pattern in the long direction of the substrate, a first heat generating resistor electrically connected to the first conductor pattern and the third conductor pattern, the first heat generating resistor being disposed between the first conductor pattern and the third conductor pattern, and a second heat generating resistor electrically connected to the second conductor pattern and the third conductor pattern, the second heat generating resistor being disposed between the second conductor pattern and the third conductor pattern. The heater has both end regions in the long direction of the substrate in which the widths of the third conductor pattern in the short direction is smaller than the width of a middle portion of the third conductor pattern, and the widths of the first heat generating resistor and the second heat generating resistor in the short direction of the substrate in the end regions are smaller than the widths of the first heat generating resistor and the second heat generating resistor in the short direction of the substrate in a region other than the end regions.

According to a fourth aspect of the invention, a fixing device for fixing a toner image onto a recording medium bearing the toner image in a nip portion while conveying the recording medium is provided. The device includes a cylindrical film, a heater in contact with an inner peripheral surface of the film, and a pressing member configured to form the nip portion together with the heater via the film. The heater includes an elongated substrate, a first conductor pattern formed at one end of the substrate in a short direction of the substrate and a second conductor pattern formed at the other end with a spacing therebetween, the first conductor pattern and the second conductor pattern extending in a long direction of the substrate, a first electrical contact portion disposed at one of both ends of the first conductor pattern in the long direction of the substrate and a second electrical contact portion disposed at one of both ends of the second conductor pattern in the long direction of the substrate, and a heat generating resistor electrically connected to the first conductor pattern and the second conductor pattern, where the heat generating resistor is disposed between the first conductor pattern and the second conductor pattern. The heater has both end regions in the long direction of the substrate in which by reducing at least one of the widths of the first conductor pattern and the second conductor pattern in the short direction of the substrate, the spacing is increased to a value larger than that in a middle portion, and the width of the heat generating resistor in the short direction of the substrate in the end regions is larger than the width of the heat generating resistor in a region other than the end regions.

Further features of the present invention will become apparent from the following description of exemplary embodiments with reference to the attached drawings.

DESCRIPTION OF THE EMBODIMENTS

First Exemplary Embodiment

(1) Image Forming Apparatus

Figure 11:
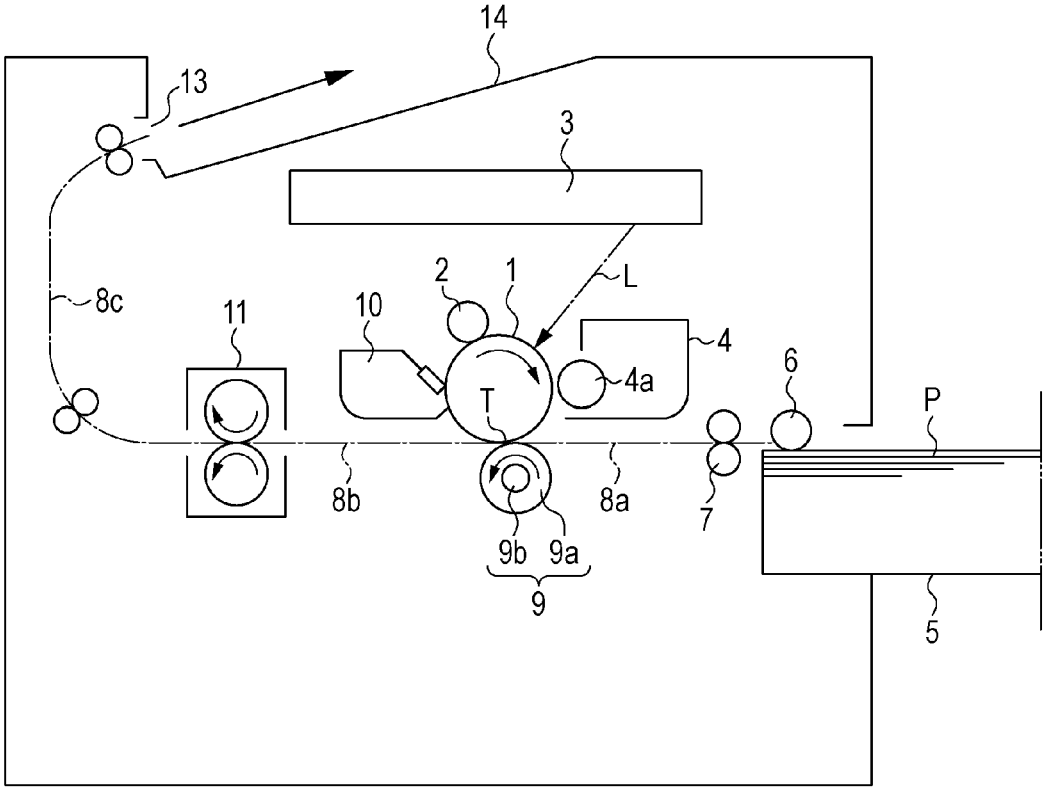
FIG. 11 is a schematic illustration of an image forming apparatus according to the first exemplary embodiment.

FIG. 11 is a schematic illustration of an image forming apparatus including a fixing device according to a first exemplary embodiment. The image forming apparatus is configured as a laser beam printer using an electrophotographic process.

The image forming apparatus includes an electrophotographic photosensitive member 1 serving as an image bearing member (hereinafter referred to as a "photoconductive drum"). The photoconductive drum 1 rotates at a predetermined circumferential speed in a direction indicated by an arrow. The photoconductive drum 1 is produced by forming a photoconductive material, such as an OPC (Organic Photoconductor) or amorphous silicon, on a cylindrical substrate made of, for example, aluminum or nickel.

The outer peripheral surface of the photoconductive drum 1 is uniformly charged by a charge roller 2 serving as a charging device while the photoconductive drum 1 is rotating. Thereafter, scanning exposure is performed on the outer peripheral surface of the photoconductive drum 1 that is uniformed charged using a laser beam L modulated in accordance with image information output from a laser beam scanner 3 serving as an exposure device. Thus, an electrostatic latent image corresponding to the image information is formed on the outer peripheral surface of the photoconductive drum 1. The electrostatic latent image is developed into a toner image by a developing roller 4*a* of a developing device 4.

In addition, a recording medium P serving as a medium to be heated is separated one by one by a feed roller 6 and is fed from a feeding cassette 5 to a registration roller 7. Thereafter, the recording medium P is introduced into a transfer nip portion T formed between the photoconductive drum 1 and a transfer roller 9 through a sheet path 8*a* by the registration roller 7 in synchronization with the toner image formed on the outer peripheral surface of the photoconductive drum 1. That is, conveyance of the recording medium P is controlled by the registration roller 7 so that when the leading edge of the toner image formed on the outer peripheral surface of the photoconductive drum 1 reaches the transfer nip portion T, the leading edge of the recording medium P exactly reaches the transfer nip portion T.

The recording medium P introduced into the transfer nip portion T is pinched by the transfer nip portion T and is conveyed. At that time, a transfer bias having a polarity that is opposite to the polarity of the toner is applied from a transfer bias application power supply (not illustrated) to the transfer roller 9. The toner image on the surface of the photoconductive drum 1 is electrostatically transferred to a surface of the recording medium P due to the effect of the transfer bias.

The recording medium P having the toner image transferred in the transfer nip portion T is separated from the surface of the photoconductive drum 1. Thereafter, the recording medium P passes through a sheet path 8*b* and is conveyed to a fixing device 11. The toner image is heat-fixed onto the surface of the recording medium P by the fixing device 11. Subsequently, the recording medium P exits from the fixing device 11. The recording medium P is led toward a sheet path 8*c* and is ejected onto an ejecting tray 14 through an ejecting port 13.

After the toner image is transferred, residual toner and dust of the recording medium P on the outer peripheral surface of the photoconductive drum 1 are removed by a cleaning device 10. In this manner, the outer peripheral surface is cleaned and is repeatedly used for image formation.

The feeding cassette 5 includes a regulating member (not illustrated) that is movable in a direction perpendicular to a recording medium conveyance direction. The regulating member is moved in accordance with the size of the recording medium P so as to regulate the positions of both side edges of the recording medium P in a direction parallel to the recording medium conveyance direction.

(2) Fixing Device

Figure 3:
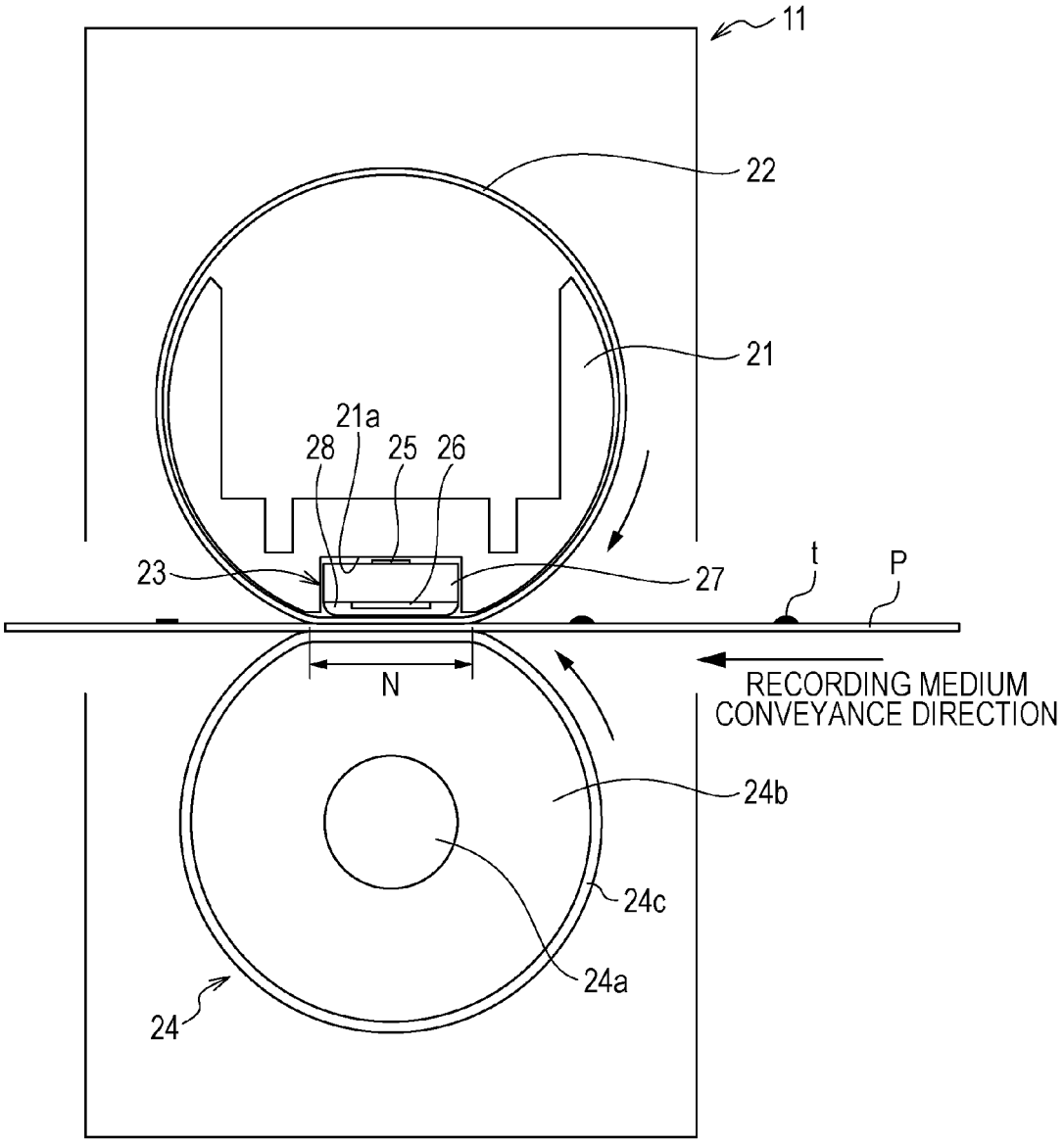
FIG. 3 is a schematic horizontal sectional view of a fixing device according to the first exemplary embodiment.
Figure 4:
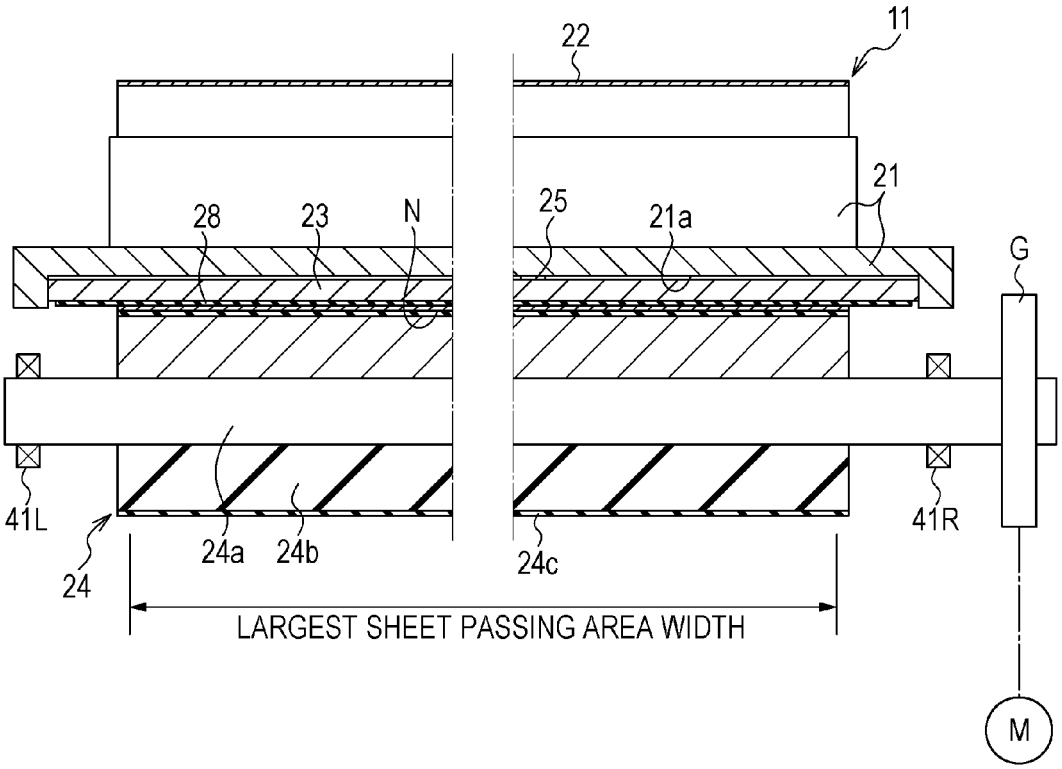
FIG. 4 is a schematic longitudinal sectional view of the fixing device according to the first exemplary embodiment.
Figure 5:
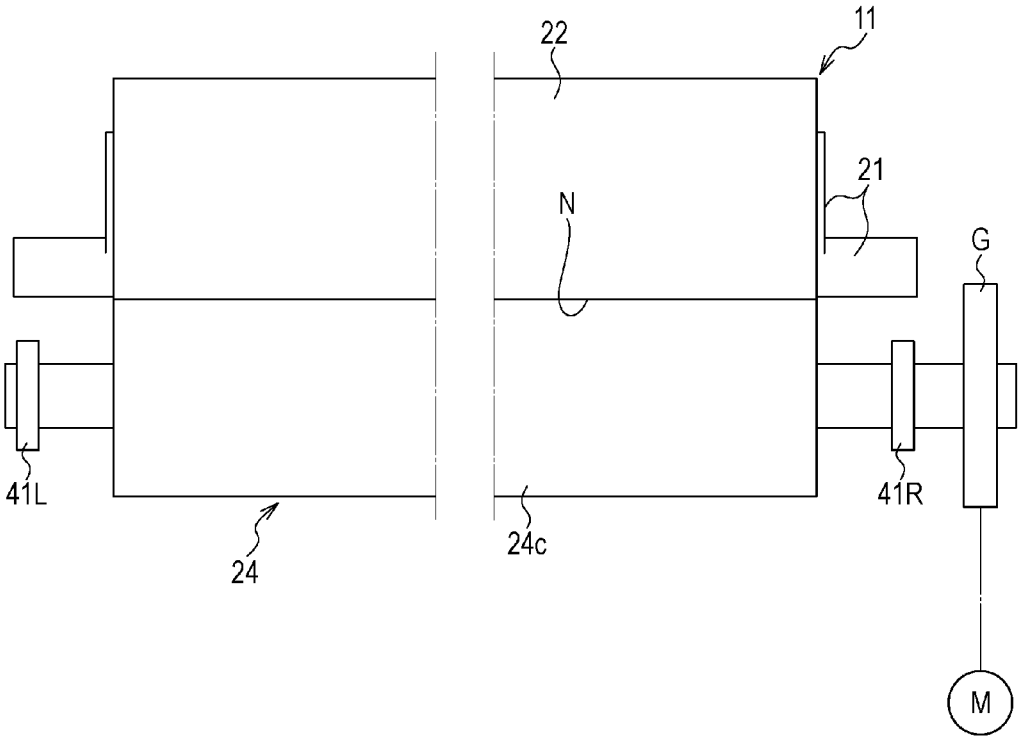
FIG. 5 illustrates the fixing device viewed from a recording medium introduction side.

FIG. 3 is a schematic horizontal sectional view of the fixing device 11. FIG. 4 is a schematic longitudinal sectional view of the fixing device 11. FIG. 5 illustrates the fixing device 11 viewed from the recording medium introduction side.

As used herein, the term "long direction" for the fixing device or the members that constitute the fixing device refers to a direction perpendicular to the recording medium conveyance direction. The term "short direction" refers to a direction parallel to the recording medium conveyance direction. The term "length" refers to the size of the fixing device or the members that constitute the fixing device in the long direction. The term "width" refers to the size of the fixing device or the members that constitute the fixing device in the short direction. The term "width direction" for a recording medium refers to a direction perpendicular to the recording medium conveyance direction. In addition, the term "width direction" for a recording medium is the same as a long direction for the fixing device or the members that constitute the fixing device. The term "width" of a recording medium refers to the size of the recording medium in the width direction.

According to the present exemplary embodiment, the fixing device 11 includes a cylindrical film 22 serving as a flexible member, a heater 23 serving as a heat generating member that is in contact with the inner surface of the film 22, and a pressing roller 24 serving as a pressing member that presses the film 22 to form a nip portion between the heater 23 and the film 22. Each of the film 22, the heater 23, and the pressing roller 24 is an elongated member that extends in the long direction. The fixing device 11 fixes a toner image onto the recording medium that bears the toner image while conveying the recording medium in the nip portion. In addition, the fixing device 11 includes a stay 21 serving as a guiding member which holds a surface of the heater 23 opposite to a surface facing the film 22 and guides the inner surface of the film 22. The stay 21 has heat resistance and rigidity. The stay 21 has a gutter shape in a longitudinal section and extends in the long direction.

The film 22 is fitted onto the stay 21 so as to surround the stay 21. The inner circumferential length of the film 22 is set so as to be greater than the outer circumferential length of the stay 21 by, for example, about 3 mm. Accordingly, the film 22 is fitted onto the stay 21 with some margin between the two circumferential lengths. The inner peripheral surface of the film 22 and the outer peripheral surface of the stay 21 have lubricant (not illustrated) therebetween. Thus, a sliding friction against the film 22 that rotates while in contact with the outer peripheral surface of the stay 21 can be reduced. According to the present exemplary embodiment, perfluoropolyether (PFPE) grease containing fluorine resin (polytetrafluoroethylene (PTFE)) as thickener is used as the lubricant.

Figure 2:
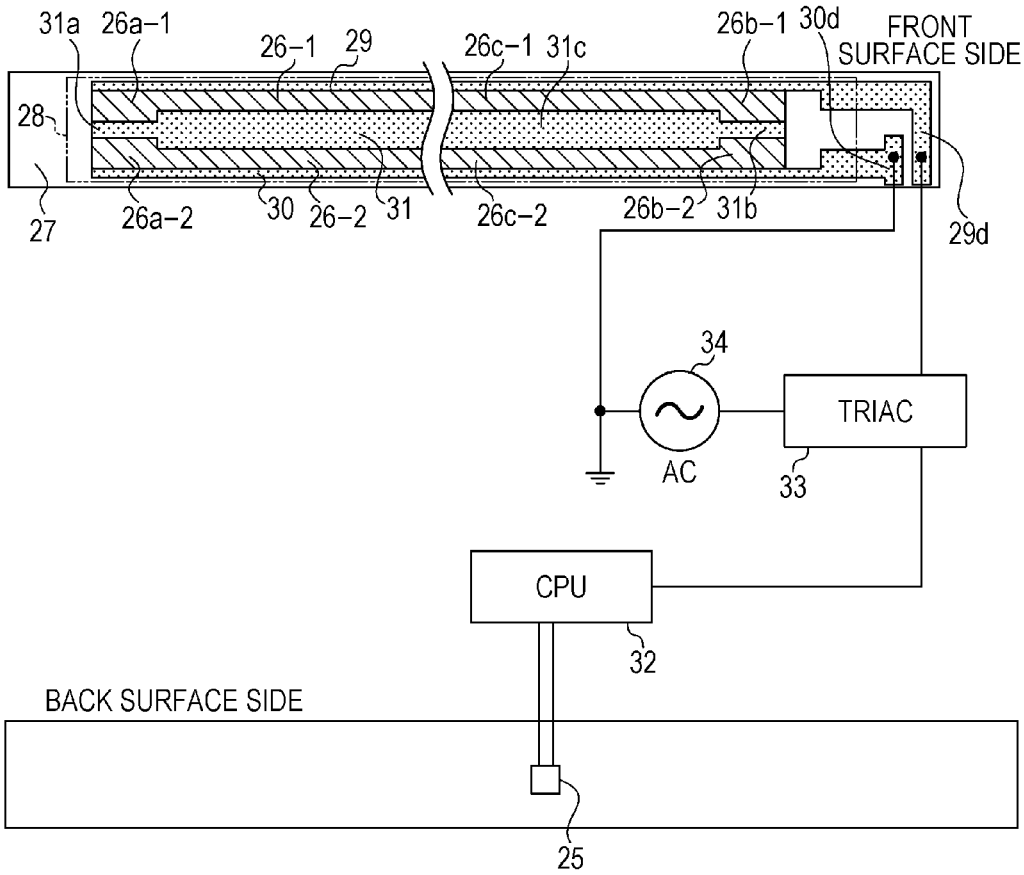
FIG. 2 is a block diagram of an example of a temperature control system of the heater according to the first exemplary embodiment.

As illustrated in FIG. 2, the fixing device 11 includes a thermistor 25 serving as a temperature detecting member on a surface of a substrate 27 opposite to a surface facing the inner surface of the film 22 in the substantially middle in the long direction of the substrate 27 (in a small-size sheet passage area). A central processing unit (CPU) 32 serving as a control unit turns on a triac 33 serving as a power supply control unit. Thus, power is supplied from an AC power supply 34 to a heat generating resistor 26 via a first electrical contact portion 29*d* and a second electrical contact portion 30*d* of the heater 23, and the temperature of the heater 23 rises. The temperature of the heater 23 is detected by the thermistor 25, and the output of the thermistor 25 is A/D-converted by an A/D converter (not illustrated). The CPU 32 acquires the resultant output. The CPU 32 performs phase control or wavenumber control on the power supplied to the heat generating resistor 26 using the triac 33 on the basis of the acquired information (temperature information). That is, if the temperature detected by the thermistor 25 is lower than a target temperature, the CPU 32 raises the temperature of the heater 23 by controlling the triac 33. In contrast, if the temperature detected by the thermistor 25 is higher than the target temperature, the CPU 32 lowers the temperature of the heater 23 by controlling the triac 33. In this manner, the CPU 32 maintains the temperature of the heater 23 at the target temperature.

As illustrated in FIGS. 3 and 5, when a drive gear (not illustrated) attached to the end portion of a core metal 24*a* of the pressing roller 24 is rotatingly driven by a fixing motor M, the pressing roller 24 rotates in a direction indicated by an arrow. The rotation of the pressing roller 24 generates a frictional force between a surface of the pressing roller 24 and a surface of the film 22 in a nip portion N and, thus, a rotary force is exerted on the film 22. Due to the rotary force, the inner surface of the film 22 slides on a coat layer 28 formed on the surface of the substrate 27 of the heater 23 in the nip portion N while in tight contact with the coat layer 28, and the film 22 is driven to rotate around the stay 21 in a direction indicated by an arrow at a speed that is the same as the speed of the outer peripheral surface of the pressing roller 24. When the temperature of the heater 23 reaches the target temperature and if the rotational speed of the film 22 rotated by the rotation of the pressing roller 24 becomes stable, the recording medium P that bears an unfixed toner image t is introduced into the nip portion N. Thereafter, the recording medium P is pinched by the surface of the film 22 and the surface of the pressing roller 24 in the nip portion N and is conveyed. By applying the heat of the heater 23 and a pressure to the unfixed toner image t via the film 22 in the nip portion N, the unfixed toner image t is heat-fixed onto the recording medium P. The recording medium P that has passed through the nip portion N is separated from the surface of the film 22 and is ejected from the fixing device 11.

The members of the fixing device 11 according to the present exemplary embodiment are described in more detail below. To reduce the heat capacity of the film 22 and improve the quick start property, the thickness of the film 22 is set to greater than or equal to 20 μm and less than or equal to 100 μm. The film 22 includes a base layer and a surface layer. The base layer can be a heat-resisting single layer of, for example, polytetrafluoroethylene (PTFE), tetrafluoroethylene-perfluoroalkyl vinyl ether copolymer (PFA), or fluorinated-ethylene-propylene (FEP). Alternatively, the following material can be used as the material of the base layer: polyimide, polyamide-imide, polyether ether ketone (PEEK), polyethersulfone (PES), or polyphenylene sulfide (PPS). The film 22 can be made as a composite layer formed by coating, for example, PTFE, PFA, or FEP, which serves as the surface layer, on the outer peripheral surface of the base layer. According to the present exemplary embodiment, the film 22 is formed by coating PFA on the outer peripheral surface of a polyimide film having a thickness of 50 μm. The outer diameter of the film 22 is 24 mm.

The stay 21 can be formed of a high heat resisting resin, such as polyimide, polyamide-imide, PEEK, PPS, or liquid crystal polymer, or a composite material of one of such resins and ceramic, metal, or glass. According to the present exemplary embodiment, liquid crystal polymer is used as the material of the stay 21. The stay 21 is formed so as to have a semi-circular gutter shape. Both ends of the stay 21 in the long direction are supported by two side plates (not illustrated) of the fixing device 11. The bottom surface of the stay 21 adjacent to the pressing roller 24 has a U-shaped groove 21*a* that extends in the long direction. The groove 21*a* holds the heater 23.

As illustrated in FIGS. 3 and 5, the pressing roller 24 includes a core metal 24*a*, an elastic layer 24*b* disposed outward of the core metal 24*a*, and a release layer 24*c* disposed outward of the elastic layer 24*b*. Both ends of the core metal 24*a* of the pressing roller 24 in the long direction are rotatably supported by the two side plates of the fixing device 11 via bearings 41L and 41R. According to the present exemplary embodiment, the core metal 24*a* is made of aluminum, the elastic layer 24*b* is made of silicone rubber, and the release layer 24*c* is made from a PFA tube having a thickness of 30 μm. The outer diameter of the pressing roller 24 is 25 mm. The elastic layer 24*b* is 3.5 mm in thickness. Both ends of the core metal 24*a* of the pressing roller 24 disposed parallel to the film 22 beneath the film 22 are pressurized toward the stay 21 by a pressing member, such as a pressurizing spring. Consequently, the elastic layer 24*b* of the pressing roller 24 is elastically deformed by the pressure of the pressurizing spring. Thus, the film 22 is pinched by the outer peripheral surface of the pressing roller 24 and the heater 23. In this manner, the nip portion N having a predetermined width required for heat-fixing the unfixed toner image t onto the recording medium P is formed.

Figure 1:
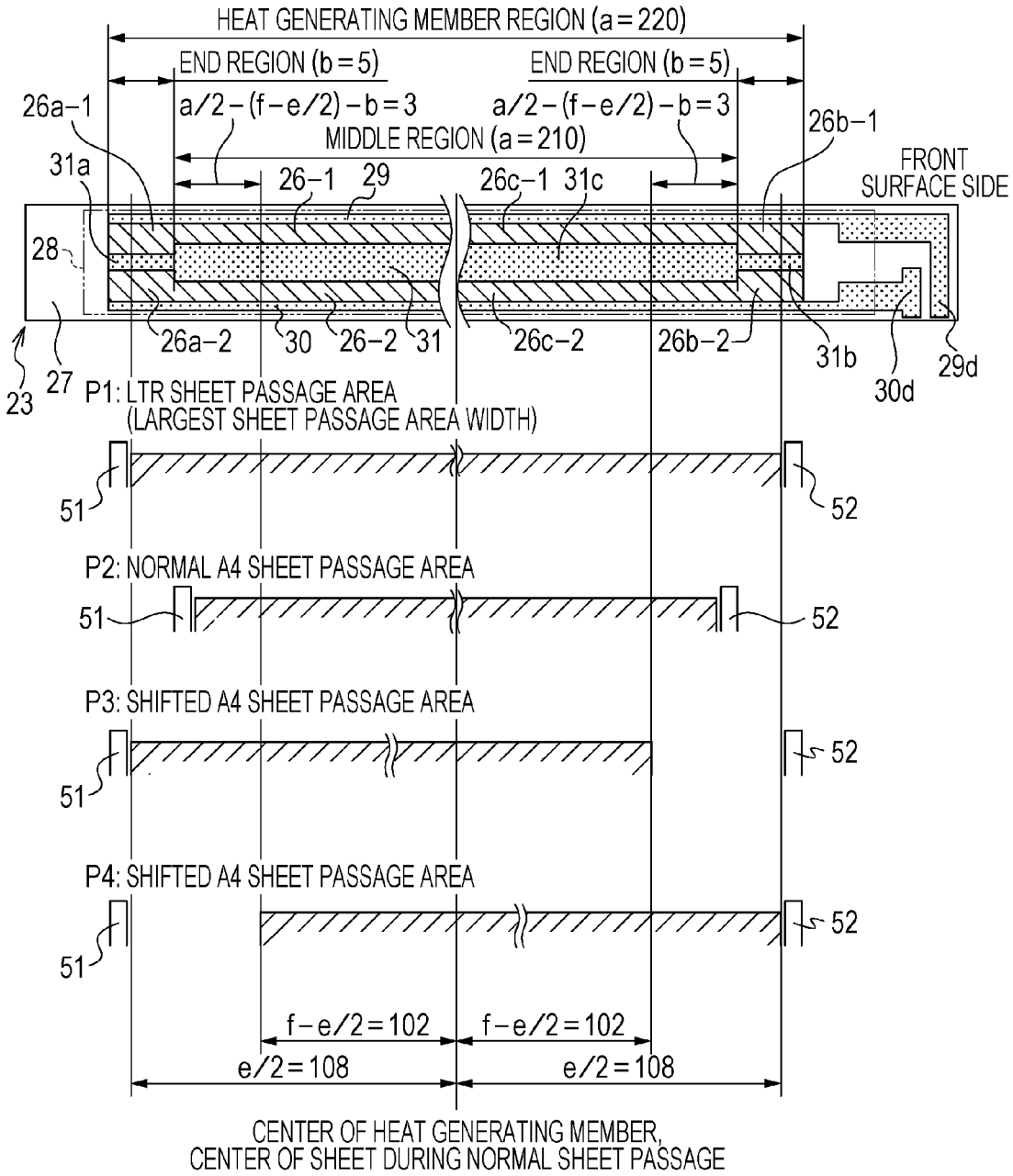
FIG. 1 is a front view of a heater according to a first exemplary embodiment.

The heater 23 according to the present exemplary embodiment is described next. FIG. 1 is a front view of the heater 23 according to the present exemplary embodiment. FIG. 2 is a block diagram of a temperature control system of the heater 23. Patterns of the heater 23 that allows an electrical current to flow in the short direction of the substrate 27 is described first. The heater 23 has a first conductor pattern 29 formed in one end portion of the substrate 27 in the short direction of the substrate 27 and a second conductor pattern 30 formed in the other end portion. The first conductor pattern 29 and the second conductor pattern 30 extend in the long direction of the substrate 27. In addition, the heater 23 has a third conductor pattern 31 between the first conductor pattern 29 and the second conductor pattern 30 in the short direction of the substrate 27. The third conductor pattern 31 extends in the long direction of the substrate 27 with a spacing from each of the first conductor pattern 29 and the second conductor pattern 30. Furthermore, the heater 23 has the first electrical contact portion 29*d* formed at one end of the first conductor pattern 29 in the long direction of the substrate 27 and the second electrical contact portion 30*d* formed at one end of the second conductor pattern 30 in the long direction of the substrate 27. Furthermore, the heater 23 has two heat generating resistors, that is, first and second heat generating resistors 26-1 and 26-2. The first heat generating resistor 26-1 is disposed between the first conductor pattern 29 and the third conductor pattern 31 and is electrically connected to the first conductor pattern 29 and the third conductor pattern 31, and the second heat generating resistor 26-2 is disposed between the second conductor pattern 30 and the third conductor pattern 31 and is electrically connected to the second conductor pattern 30 and the third conductor pattern 31.

To cause the heater 23 to generate heat, voltages of different polarities are applied to the first electrical contact portion 29*d* and the second electrical contact portion 30*d* using a connector (not illustrated) connected to the AC power supply 34 illustrated in FIG. 2. In this manner, a potential difference is generated between the first conductor pattern 29 and the second conductor pattern 30 and, thus, an electrical current flows in the first heat generating resistor 26-1 and the second heat generating resistor 26-2 in the short direction of the substrate 27. Accordingly, the first heat generating resistor 26-1 and the second heat generating resistor 26-2 generate heat. Since the heater 23 is of a type in which an electrical current flows in the short direction of a substrate, the amount of heat generation increases with increasing potential difference between the first conductor pattern 29 and the second conductor pattern 30 and with decreasing resistance values of the first conductor pattern 29 and the second conductor pattern 30.

A method for manufacturing the patterns of the heater 23 is described next. First, the first heat generating resistor 26-1 and the second heat generating resistor 26-2 are applied to a surface of the substrate 27 using screen printing. Subsequently, the first conductor pattern 29, the second conductor pattern 30, the third conductor pattern 31, the first electrical contact portion 29*d*, and the second electrical contact portion 30*d* are applied to the substrate 27 using, for example, screen printing. Thereafter, a protection layer 28 is coated thereon. At that time, the first heat generating resistor 26-1, the second heat generating resistor 26-2, the first conductor pattern 29, the second conductor pattern 30, and the third conductor pattern 31 are formed so as to have areas thereof that overlap each other by at least 0.5 mm in the short direction of the substrate 27. This is because stable electrical connection in the short direction of the substrate 27 is reliably maintained.

The material of the heater 23 is described next. The substrate 27 can be made of a high thermal conducting ceramic, such as alumina or aluminum nitride. According to the present exemplary embodiment, an alumina substrate having a width of 11 mm, a length of 270 mm, and a thickness of 1 mm is used as the substrate 27. The first heat generating resistor 26-1 and the second heat generating resistor 26-2 are made of an electrical resistance material, such as ruthenium oxide ($RuO_2$). The heat generating resistor has a positive temperature coefficient. The protection layer 28 is made of, for example, glass or fluorine resin. The first conductor pattern 29, the second conductor pattern 30, and the third conductor pattern 31 are made of a conducting material, such as Ag. According to the present exemplary embodiment, a heat resisting glass layer having a thickness of about 60 μm is used as the protection layer 28. The protection layer 28 improves electrical insulation between the heat generating resistor 26 and the surface of the substrate 27 and the ease of sliding between the heater 23 and the inner surface of the film 22.

A relationship among the lengths of the first heat generating resistor 26-1 and the second heat generating resistor 26-2 in the long direction of the substrate 27 and the widths of a letter (LTR) size recording medium and an A4 size recording medium is described next. According to the present exemplary embodiment, an LTR size recording medium is a recording medium having the largest printable width. An A4 size recording medium is a recording medium having the second largest printable width. More specifically, since the image forming apparatus according to the present exemplary embodiment feeds a recording medium with the short edge as the leading edge, a width e of an LTR size recording medium is 216 mm, and a width f of an A4 size recording medium is 210 mm.

In FIG. 1, an area P1 indicates an area in which an LTR size recording medium is normally set at an LTR size position using regulating members 51 and 52 that regulate the position of a recording medium in the width direction. An area P2 indicates an area in which an A4 size recording medium is normally set at an A4 size position using the regulating members 51 and 52. An area P3 indicates an area in which one of the side edges of an A4 size recording medium is in contact with the regulating member 51, although the regulating member 51 and the regulating member 52 are located at an LTR size position. An area P4 indicates an area in which one of the side edges of an A4 size recording medium is in contact with the regulating member 52, although the regulating member 51 and the regulating member 52 are located at an LTR size position. That is, the areas P3 and P4 are areas in which the recording medium is shifted to one side and is conveyed.

A length a of each of the first heat generating resistor 26-1 and the second heat generating resistor 26-2 in the long direction of the substrate 27 is 220 mm. That is, the length a is greater than the width of the LTR size recording medium (216 mm), which is the largest width of the recording medium P that passes through the nip portion N illustrated in FIG. 3. The first heat generating resistor 26-1 includes end regions 26*a*-1 and 26*b*-1 in the long direction of the substrate 27 and a middle region 26*c*-1 located between the end regions 26*a*-1 and 26*b*-1. The length of the middle region 26*c*-1 in the long direction of the substrate 27 is 210 mm. The length of each of the end regions 26*a*-1 and 26*b*-1 in the long direction of the substrate 27 is 5 mm. Like the first heat generating resistor 26-1, the second heat generating resistor 26-2 includes end regions 26*a*-2 and 26*b*-2 in the long direction of the substrate 27 and a middle region 26*c*-2 located between the end regions 26*a*-2 and 26*b*-2. The length of the middle region 26*c*-2 in the long direction of the substrate 27 is 210 mm. The length of each of the end regions 26*a*-2 and 26*b*-2 in the long direction of the substrate 27 is 5 mm.

The third conductor pattern 31 disposed between the first conductor pattern 29 and the second conductor pattern 30 in the short direction of the substrate 27 is electrically connected to the first heat generating resistor 26-1 and the second heat generating resistor 26-2. The third conductor pattern 31 includes end regions 31*a* and 31*b* at either end thereof in the long direction of the substrate 27 and a middle region 31*c* located between the end regions 31*a* and 31*b*. The width of each of the end regions 31*a* and 31*b* of the third conductor pattern 31 in the short direction of the substrate 27 is 0.5 mm. The width of the middle region 31*c* in the short direction of the substrate 27 is 2.5 mm. That is, the width of the end regions 31*a* and 31*b* of the third conductor pattern 31 in the short direction of the substrate 27 is set so as to be greater than the width of the middle region 31*c* in the short direction of the substrate 27. The reason for this is described in detail below. Note that the width of each of the conductor patterns 29 and 30 in the short direction of the substrate 27 is 1.5 mm.

The width of the first heat generating resistor 26-1 in the short direction of the substrate 27 is 3.0 mm for the end regions 26*a*-1 and 26*b*-1 and is 2.0 mm for the middle region 26*c*-1. That is, in terms of the width of the first heat generating resistor 26-1 in the short direction of the substrate 27, the width of the end region 26*a*-1 (26*b*-1) is set so as to be greater than the width of the middle region 26*c*-1. Similarly, in terms of the width of the second heat generating resistor 26-2 in the short direction of the substrate 27, the width of the end region 26*a*-2 (26*b*-2) is set so as to be greater than the width of the middle region 26*c*-2. The reason for this is described in detail below.

A length from the first conductor pattern 29 to the second conductor pattern 30 in the short direction of the substrate 27 is set to 9.5 mm throughout the length of the substrate 27 in the long direction. According to the present exemplary embodiment, the first conductor pattern 29 and the second conductor pattern 30 are formed of Ag having a sheet resistance of 3 mΩ/square. The sheet resistance values of the first heat generating resistor 26-1 and the second heat generating resistor 26-2 are controlled so that the total electrical resistance between the first electrical contact portion 29*d* and the second electrical contact portion 30*d* is 50Ω. Note that each of the conductor pattern and the heat generating resistor is formed so that the resistance value per unit area is the same.

According to the present exemplary embodiment, as described above, the width of each of the end regions 31*a* and 31*b* of the third conductor pattern 31 in the short direction of the substrate 27 is smaller than the width of the middle region 31*c* in the short direction of the substrate 27. In addition, in terms of the width of the first heat generating resistor 26-1 in the short direction of the substrate 27, the width of the end region 26*a*-1 (26*b*-1) is larger than the width of the middle region 26*c*-1. Similarly, in terms of the width of the second heat generating resistor 26-2 in the short direction of the substrate 27, the width of the end region 26*a*-2 (26*b*-2) is larger than the width of the middle region 26*c*-2. That is, in a heater, the width of the heat generating resistor disposed in a region of the third conductor pattern 31 having a small width in the short direction of the substrate 27 is made larger than the width of a region of the heat generating resistor other than the above-described region in the width direction.

In this manner, in the heat generating resistor 26-1 (26-2), the electrical resistance value of the end region 26*a*-1 (26*b*-1) is higher than that of the middle region 26*c*-1 (26*c*-2). Thus, the amount of heat generation of the end region 26*a*-1 (26*b*-1) is smaller than that of the middle region 26*c*-1 (26*c*-2).

Figure 7:
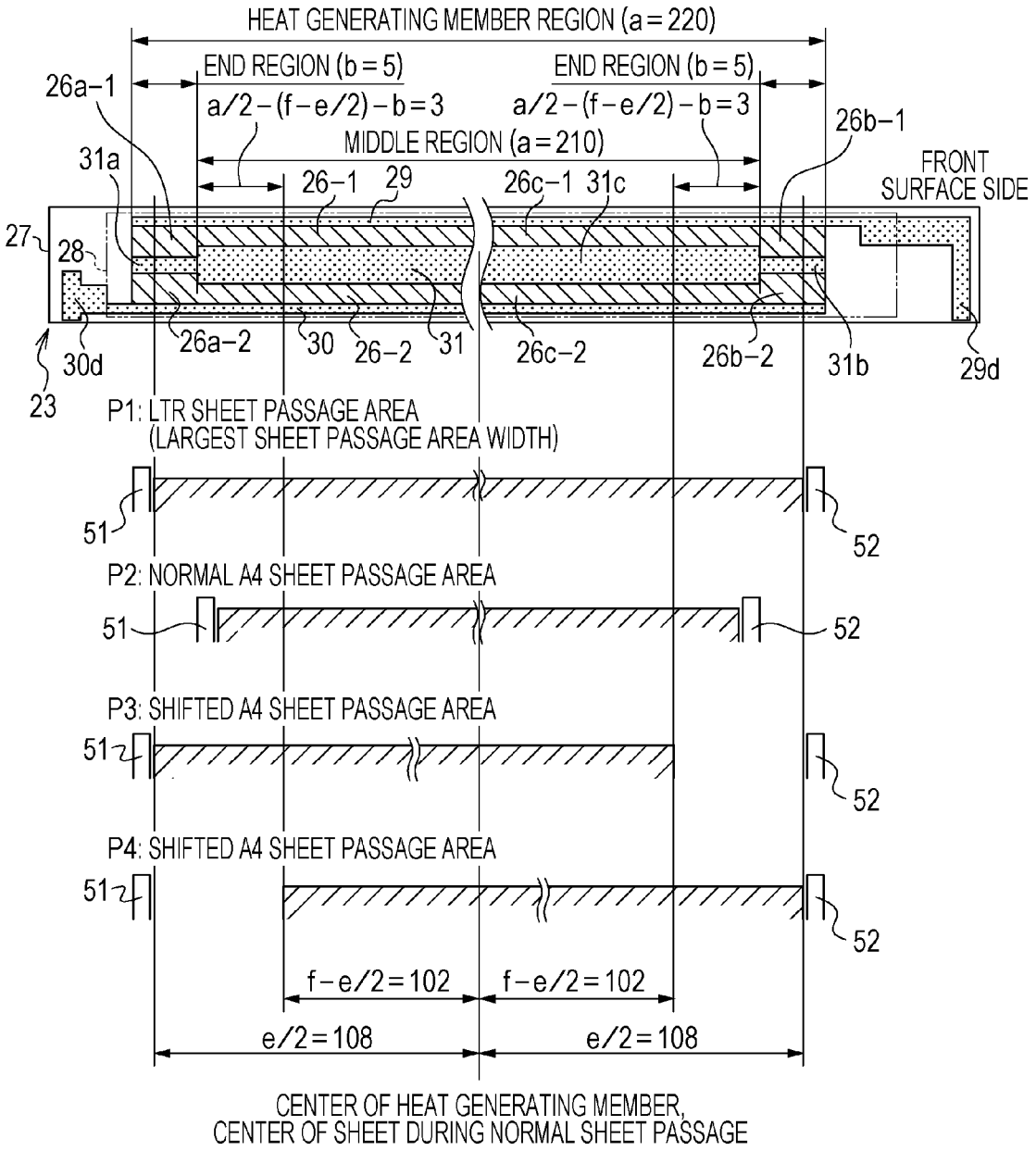
FIG. 7 is a front view of the heater according to the modification of the first exemplary embodiment.

FIG. 7 illustrates a configuration of the pattern of the heater according to a modification of the first exemplary embodiment. Only difference between the first exemplary embodiment (FIG. 1) and the modification of the first exemplary embodiment (FIG. 7) is the position of the second electrical contact portion 30*d*. According to the first exemplary embodiment, the second electrical contact portion 30*d* is disposed on the same side of the middle of the substrate 27 in the long direction of the substrate 27 as the first electrical contact portion 29*d*. In contrast, according to the modification of the first exemplary embodiment, the second electrical contact portion 30*d* is disposed on the opposite side of the middle of the substrate 27 in the long direction of the substrate 27 from the first electrical contact portion 29*d*. A difference between the effects of the first exemplary embodiment (FIG. 1) and the modification of the first exemplary embodiment (FIG. 7) is described below.

According to the modification of the first exemplary embodiment, the heater produces the effect if the electrical resistance values of the conductor pattern and an electrical contact portion are not vanishingly smaller than that of the heat generating resistor. According to the first exemplary embodiment and the modification of the first exemplary embodiment, if voltages of different polarities are applied to the two electrical contact portions, the voltage of the conductor pattern gradually decreases with distance from the electrical contact portion in the long direction of the substrate 27. The difference is that according to the first exemplary embodiment, the potential difference between the first conductor pattern 29 and the second conductor pattern 30 is maximized in an end portion on the side in which the two electrical contact portions of the heater 23 are located and, thus, the amount of heat generation is maximized. In addition, the potential difference is minimized at an end portion on the side in which the two electrical contact portions of the heater 23 are not located and, thus, the amount of heat generation is minimized. As a result, the nonuniformity of heat generation of the heater 23 in the long direction of the substrate 27 is large. Accordingly, a rise of the temperature of a non-sheet passage area in the end portion located on the side in which the electrical contact portions of the heater 23 are located in the long direction of the substrate 27 easily occurs.

In contrast, as illustrated in FIG. 7, according to the modification of the first exemplary embodiment, the voltage of the first conductor pattern 29 is maximized in the end portion of the heater 23 on the side in which the first electrical contact portion 29*d* is located, and the voltage gradually decreases toward the end portion on the side in which the second electrical contact portion 30*d* is located. In addition, the voltage of the second conductor pattern 30 is maximized in the end portion of the heater 23 on the side in which the second electrical contact portion 30*d* is located, and the voltage gradually decreases toward the end portion on the side in which the first electrical contact portion 29*d* is located. As a result, the potential difference between the first conductor pattern 29 and the second conductor pattern 30 is substantially uniform along the long direction of the substrate 27. That is, if the electrical resistance values of the conductor pattern and the electrical contact portion are not negligible compared to the electrical resistance value of the heat generating resistor, the nonuniformity of heat generation in the long direction of the substrate 27 of the heater 23 in the arrangement of the electrical contact portions according to the modification of the first exemplary embodiment is less than that according to the first exemplary embodiment.

Figure 6A:
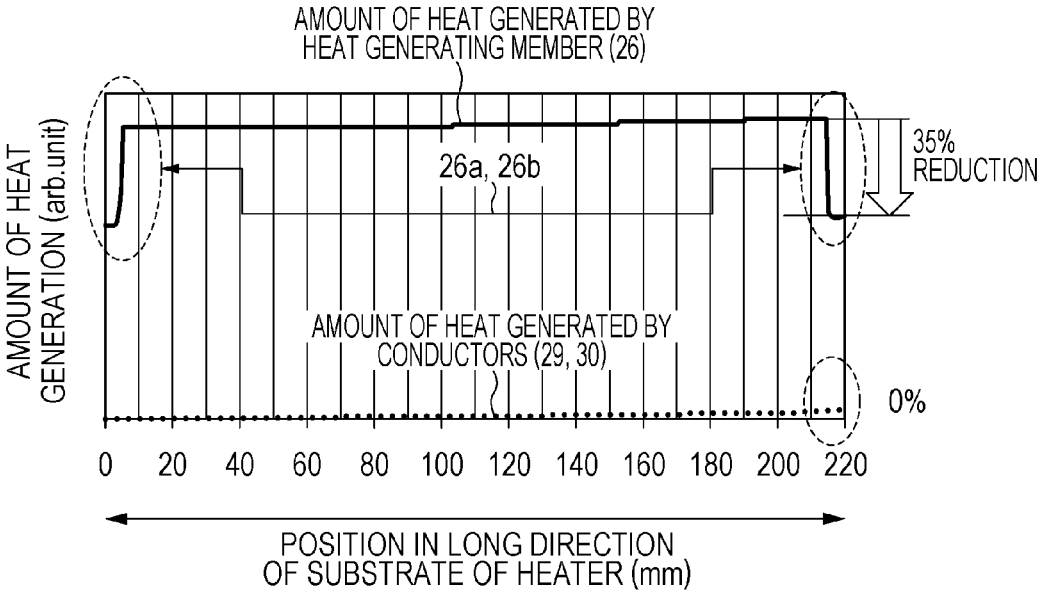
FIG. 6A illustrates the heat distribution of the heater along the long direction of the substrate according to the first exemplary embodiment.
Figure 6B:
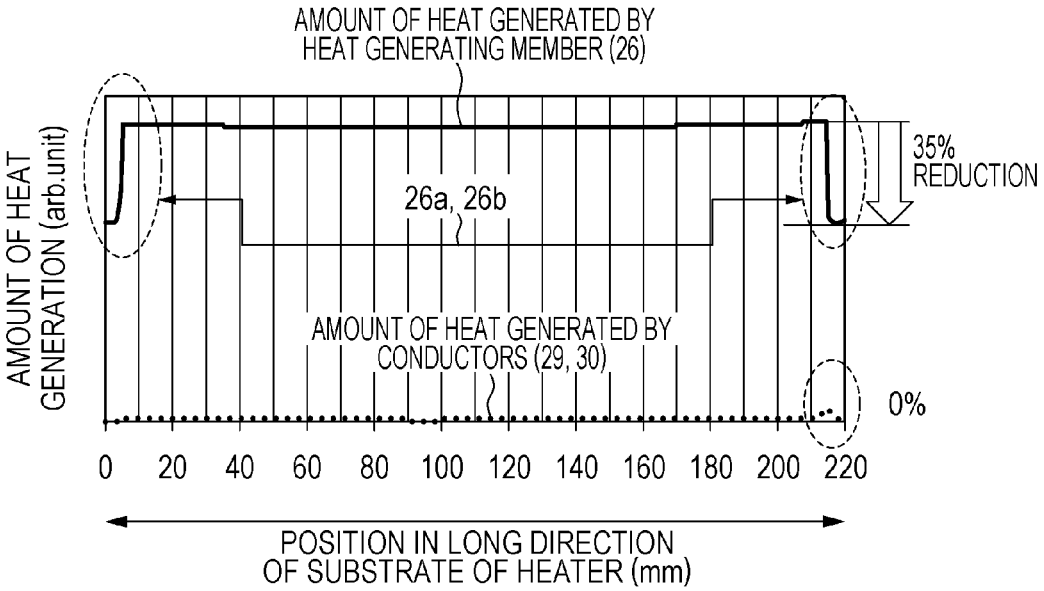
FIG. 6B illustrates the heat distribution of a heater along the long direction of the substrate according to a modification of the first exemplary embodiment.

The heat distributions of the heaters in the long direction of the substrate 27 according to the first exemplary embodiment and the modification of the first exemplary embodiment occurring when, as described above, the nonuniformity of heat generation of the substrate 27 is negligible are described next. The heat distributions of the heaters in the long direction of the substrate 27 according to the first exemplary embodiment and the modification of the first exemplary embodiment are illustrated in FIGS. 6A and 6B, respectively. The abscissa of FIGS. 6A and 6B represents a position in the heater 23 in the long direction of the substrate 27, and the ordinate represents the average amount of heat generation of the heater 23. As the average amount of heat generation of the heater, the average amount of heat generation of the heat generating resistor 26 (26-1, 26-2) and the average amount of heat generation of the conductor pattern (29, 30) are discussed. As used herein, the term "average amount of heat generation" refers to the average of the amounts of heat generation in the short direction of the substrate 27.

As can be seen from FIGS. 6A and 6B, in the heaters 23 according to the first exemplary embodiment and the modification of the first exemplary embodiment, the amounts of heat generation of the end regions 26*a* (26*a*-1, 26*a*-2) and the end region 26*b* (26*b*-1, 26*b*-2) of the heat generating resistor 26 can be made smaller than the amount of heat generation of the middle region 26*c* (26*c*-1, 26*c*-2). More specifically, according to the first exemplary embodiment, the average amount of heat generation of the end region 26*a* or the end region 26*b* can be reduced from the average amount of heat generation of the middle region 26*c* by 35%. In addition, in the heaters 23 according to the first exemplary embodiment and the modification of the first exemplary embodiment, heat is negligibly produced in the conductor pattern (29, 30).

Figure 10:
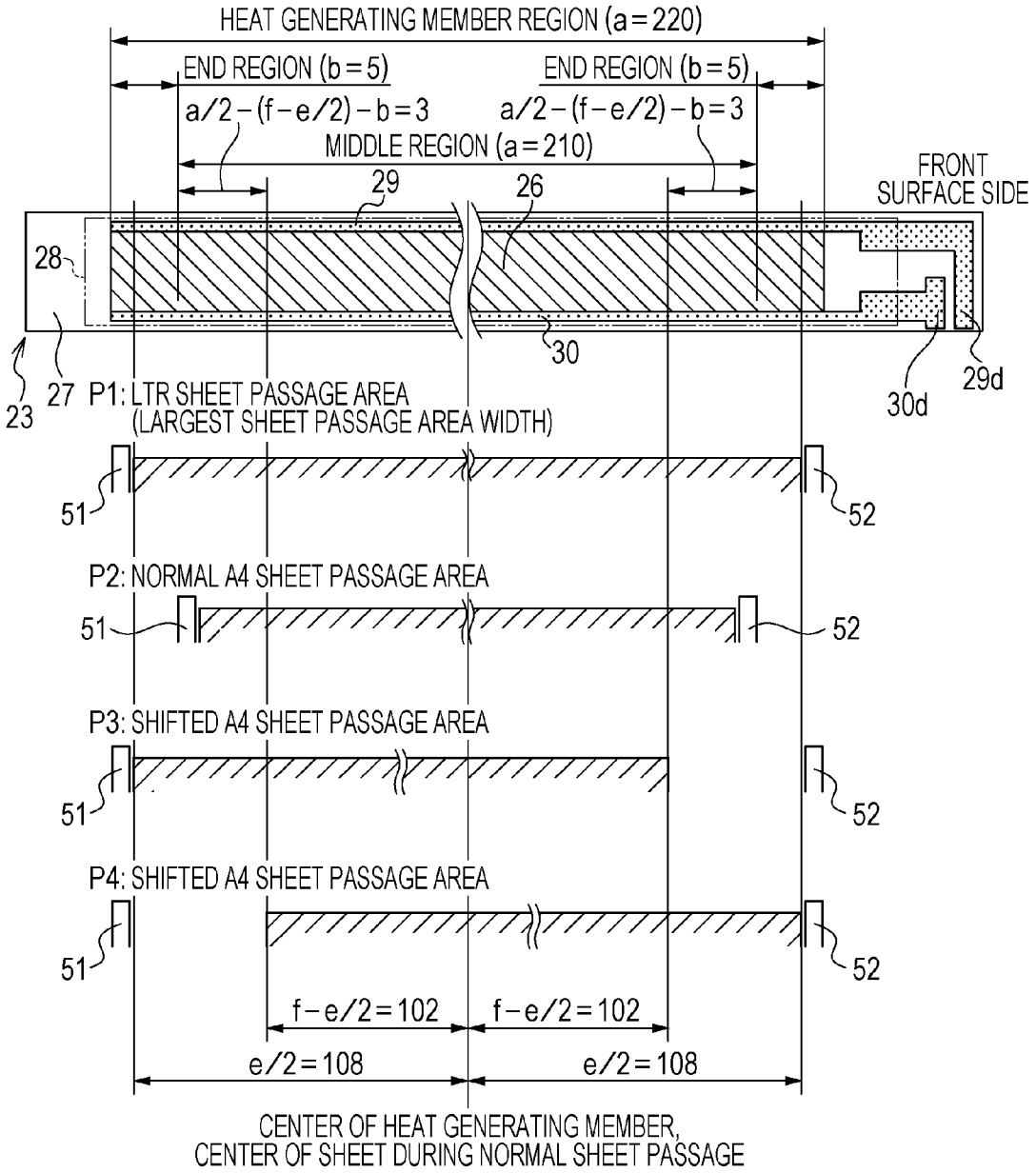
FIG. 10 illustrates the configuration of an existing heater.

As described above, unlike the existing heater illustrated in FIG. 10, according to the heater of the first exemplary embodiment and the modification of the first exemplary embodiment, the amount of heat generation of the end region in the long direction of the substrate 27 can be made smaller than that in the middle region. Accordingly, a temperature rise in the non-sheet passage area can be reduced.

The result of an experiment conducted to study the effects (the fixability and temperature rise in the non-sheet passage area) of the heater of the first exemplary embodiment and an existing heater (refer to FIG. 10) is described below. Since the heater according to the first exemplary embodiment has a configuration that is the same as the above-described configuration (refer to FIG. 1), description of the heater is not repeated. In the existing heater (refer to FIG. 10), the width of the heat generating resistor 26 in the short direction of the substrate 27 is uniform throughout the length of the substrate 27 in the long direction and, thus, the electrical resistance value per unit length is constant. In comparative examples 1 to 4, the lengths of the heat generating resistors 26 in the long direction of the substrate 27 are 214 mm (the comparative example 1), 215 mm (the comparative example 2), 216 mm (the comparative example 3), and 217 mm (the comparative example 4), respectively. Note that since the configurations other than the configuration of the heater are the same as those of the first exemplary embodiment, descriptions of the configurations are not repeated.

In terms of the fixability, the fixability of an unfixed toner image obtained when the LTR size recording medium having the largest printable width passes through the nip portion N is evaluated. The fixability is evaluated using a three grade system, in which (x) indicates that a toner image is completely destroyed when a finger runs back and forth over the toner image after a fixing process, (Δ) indicates that a toner image is partially destroyed, and (○) indicates that a toner image is not destroyed at all. According to the present exemplary embodiment, the evaluation (○) is at an acceptable level.

In terms of the temperature rise in a non-sheet passage area, the temperature in the non-sheet passage area is measured when the A4 size recording medium is intentionally shifted to one side and is conveyed through the nip portion N. To measure the temperature in the nip portion N, the temperature of the pressing roller that is easily damaged by a temperature rise in the non-sheet passage area is measured. The pressing roller is made of silicon rubber having a withstand temperature limit of 230° C. A temperature rise in the non-sheet passage area is evaluated using a three grade system, in which (x) indicates that the temperature of the pressing roller is higher than or equal to 230° C., (Δ) indicates that the temperature is between 200° C. to 230° C., and (○) indicates that the temperature is lower than or equal to 200° C. According to the present exemplary embodiment, the evaluation (○) indicating that the temperature is lower than or equal to 200° C. is at an acceptable level.

The above-described technique for setting a distance between the regulating members 51 and 52 for a recording medium to the width of an LTR size, causing a side edge of the A4 size recording medium in the width direction to be in contact with one of the regulating members 51 and 52, and conveying the A4 size recording medium in the nip portion N is referred to as a "shifted sheet conveyance mode". In such a mode, the temperature rise in the non-sheet passage area is most prominent. In this experiment, the conveyance speed and the sheet-to-sheet interval is the same for LTR size recording media and A4 size recording media.

Table 1 indicates the results of the fixability and a temperature rise in the non-sheet passage area according to the present exemplary embodiment and the comparative examples 1 to 4. Note that the value "(average amount of heat generation d in the end region)/(average amount of heat generation c in the middle region)" in Table 1 is described in detail below.

As indicated by comparative examples 1 to 4 in Table 1, if the length is less than or equal to 215 mm, the fixability for an LTR size recording medium is not satisfactory. In addition, if the length is greater than or equal to 216 mm, prevention of the temperature rise in the non-sheet passage area is not satisfactory. That is, it is difficult for existing heaters having the amount of heat generation of the heat generating resistor that is uniform along the length direction to satisfy the fixability for an LTR size recording medium and prevention of a temperature rise in the non-sheet passage area at the same time. In contrast, according to the first exemplary embodiment, the fixability for an LTR size recording medium and prevention of a temperature rise in the non-sheet passage area can be satisfied at the same time.

This is because by using a parameter of the width (the length in the short direction of the substrate 27) of the end portion of the heat generating resistor in the long direction of the substrate 27 in addition to a parameter of the length of the heat generating resistor in the long direction of the substrate 27, the amount of heat generation of the end portion of the heater can be reduced.

TABLE 1

| | Heater Specification | | | | |
|---|---|---|---|---|---|
| | Length a of Heat Generating Resistor | Length b of End Region of Heat Generating Resistor | (Average Amount of Heat Generation d in End Region)/(Average Amount of Heat Generation c in Middle Region) | Temperature Rise in Non-Sheet Passage Area for Shifted A4 Sheet | LTR Fixability |
| Comparative Example 1 | 214 | — | — | ○ | X |
| Comparative Example 2 | 215 | — | — | ○ | X |
| Comparative Example 3 | 216 | — | — | X | ○ |
| Comparative Example 4 | 217 | — | — | X | ○ |
| First Exemplary Embodiment | 220 | 5 | 0.65 | ○ | ○ |

To determine the condition for satisfying the fixability for the LTR size recording medium and prevention of a temperature rise in the non-sheet passage area, a value equivalent to the amount of heat generation of the non-sheet passage area is calculated, and description is made with reference to the equivalent value.

The value equivalent to the amount of heat generation of the non-sheet passage area serves as a parameter related to the amount of heat generated by the heat generating resistor in a shifted sheet conveyance mode. The value equivalent to the amount of heat generation of the non-sheet passage area is defined as follows:

The value equivalent to the amount of heat generation of the non-sheet passage area $=b\times(d/c)+\{a/2-(f-e/2)-b\}\times(c/c)$ where a: the length of the heat generating resistor in the long direction (mm)

b: the length of the end portion of the heat generating resistor (mm)

c: the average amount of heat generation per unit length of the middle region in the short direction of a substrate (W)

d: the average amount of heat generation per unit length of the end region in the short direction of the substrate (W)

e: the width of an LTR size recording medium (216 mm)

f: the width of an A4 size recording medium (210 mm)

For simplicity, d and c are divided by c so that the amount of heat generation per unit length of the middle region 26*c* is 1. The first term b×(d/c) of the above-described equation is an equivalent value of the amount of heat generation of the end region 26*a* or 26*b* of the non-sheet passage area. The term {a/2−(f−e/2)−b}×(c/c) is an equivalent value of the amount of heat generation of the middle region 26*c* in the non-sheet passage area. The sum of the two equivalent values is the equivalent value of heat generation of the entire non-sheet passage area. For example, according to the present exemplary embodiment, the parameters are set as follows:

a: 220 mm, b: 5 mm, d/c: 0.65, e: 216 mm, and f: 210 mm.

Accordingly, the equivalent value of the heat generation of the non-sheet passage area can be calculated as follows:

$$5\times0.65+\{220/2-(210-216/2)-5\}\times1=6.25$$

Note that if a plurality of the heat generating resistors are provided in the short direction of the substrate 27, the same calculation is performed for each of the heat generating resistors. Thereafter, the average value of the resultant values is calculated to obtain the equivalent value of the heat generation of the non-sheet passage area.

To conduct the experiment, the parameters are set in consideration of the following conditions. That is, to obtain the fixability from the data in Table 1, it is desirable that the length of the heat generating resistor be greater than or equal to 216 mm, which is the same value as the width of the LTR size. To ensure prevention of a temperature rise in the non-sheet passage area from the data in Table 1, it is desirable that the border between the end region and the middle region be located within the width of the LTR size recording medium (216 mm). In addition, if an A4 size recording medium is conveyed in the shifted sheet conveyance mode, the recording medium passes through an area within a 204-mm range, which is a sheet passage area. Accordingly, heat of the heater is removed. Thus, the amount of heat generation of the heater need not be reduced. That is, it is desirable that the end region is located outside the 204-mm range.

Table 2 indicates the specification of the heater used in the experiment and the result of the experiment. The method for evaluating the fixability and prevention of a temperature rise in the non-sheet passage area is the same as described above. As can be seen from Table 2, an increase in the equivalent value of the amount of heat generation of the non-sheet passage area has a disadvantage for prevention of the temperature rise in the non-sheet passage area, and a decrease in the equivalent value has a disadvantage for the fixability.

If the equivalent value of the amount of heat generation of the non-sheet passage area is in the range from 5.4 to 6.4, the fixability and prevention of a temperature rise in the non-sheet passage area can be made satisfactory regardless of the length of the heat generating resistor.

TABLE 2

| Heater Specification | | | | | |
|---|---|---|---|---|---|
| Length a of Heat Generating Resistor | Length b of End Region | (Average Amount of Heat Generation d in End Region)/(Average Amount of Heat Generation c in Middle Region) | Equivalent Value of Amount of Heat Generation in Non-Sheet Passage Area | LTR Fixability | Temperature Rise in Non-Sheet Passage Area for Shifted A4 Sheet |
| 218 | 6 | 0.95 | 6.7 | ○ | X |
| 218 | 6 | 0.9 | 6.4 | ○ | ○ |
| 218 | 6 | 0.7 | 5.2 | ○ | ○ |
| 218 | 6 | 0.6 | 4.6 | X | ○ |
| 218 | 4 | 0.95 | 6.8 | ○ | X |
| 218 | 4 | 0.85 | 6.4 | ○ | ○ |
| 218 | 4 | 0.6 | 5.4 | ○ | ○ |
| 218 | 4 | 0.5 | 5 | X | ○ |
| 220 | 7 | 0.9 | 7.3 | ○ | X |
| 220 | 7 | 0.8 | 6.6 | ○ | ○ |
| 220 | 7 | 0.6 | 5.2 | ○ | ○ |
| 220 | 7 | 0.45 | 4.15 | X | ○ |
| 220 | 5 | 0.75 | 6.75 | ○ | X |
| 220 | 5 | 0.65 | 6.25 | ○ | ○ |
| 220 | 5 | 0.6 | 6 | ○ | ○ |
| 220 | 5 | 0.45 | 5.25 | ○ | ○ |
| 220 | 5 | 0.3 | 4.5 | X | ○ |
| 222 | 8 | 0.8 | 7.4 | ○ | X |
| 222 | 8 | 0.7 | 6.6 | ○ | ○ |
| 222 | 8 | 0.55 | 5.4 | ○ | ○ |
| 222 | 8 | 0.5 | 5 | X | ○ |
| 222 | 6 | 0.7 | 7.2 | ○ | X |
| 222 | 6 | 0.6 | 6.6 | ○ | ○ |
| 222 | 6 | 0.4 | 5.4 | ○ | ○ |
| 222 | 6 | 0.3 | 4.8 | X | ○ |

As described above, in the heater 23 according to the first exemplary embodiment, the length of the heat generating resistor 26 is longer than the width of an LTR size recording medium that is the largest printable width (216 mm). The average amount of heat generation of the end region 26*a* (26*a*-1, 26*a*-2) and the end region 26*b* (26*b*-1, 26*b*-2) of the heat generating resistor 26 is set to less than the average amount of heat generation of the middle region 26*c* (26*c*-1, 26*c*-2). In addition, setting is performed such that the side edges of an LTR size recording medium are located within the end regions 26*a* and 26*b* each having the average amount of heat generation less than that in the middle region 26*c*. Furthermore, the position of the border between the middle region 26*c* and the end region 26*a* (26*b*) is determined such that when one of the side edges of an A4 size recording medium in the width direction is in contact with the regulating member set to the position corresponding to an LTR size, the other side edge is located in the middle region 26*c* of the heat generating resistor. In this manner, an unfixed toner image t can be excellently fixed to an LTR size recording medium. In addition, if an A4 size recording medium is shifted to one side, a temperature rise of the non-sheet passage area can be reduced.

While the first exemplary embodiment has been described with reference to the technique in which the largest printable width is determined as the width of an LTR size recording medium and an A4 size recording medium having the width smaller than the width of the LTR size recording medium is shifted and conveyed, the technique is not limited thereto. For example, the largest printable width may be determined as the width of an A3 size recording medium (297 mm×420 mm), and a Ledger size recording medium (11"×17"≅279 mm×432 mm) may be shifted and conveyed.

Second Exemplary Embodiment

Figure 8:
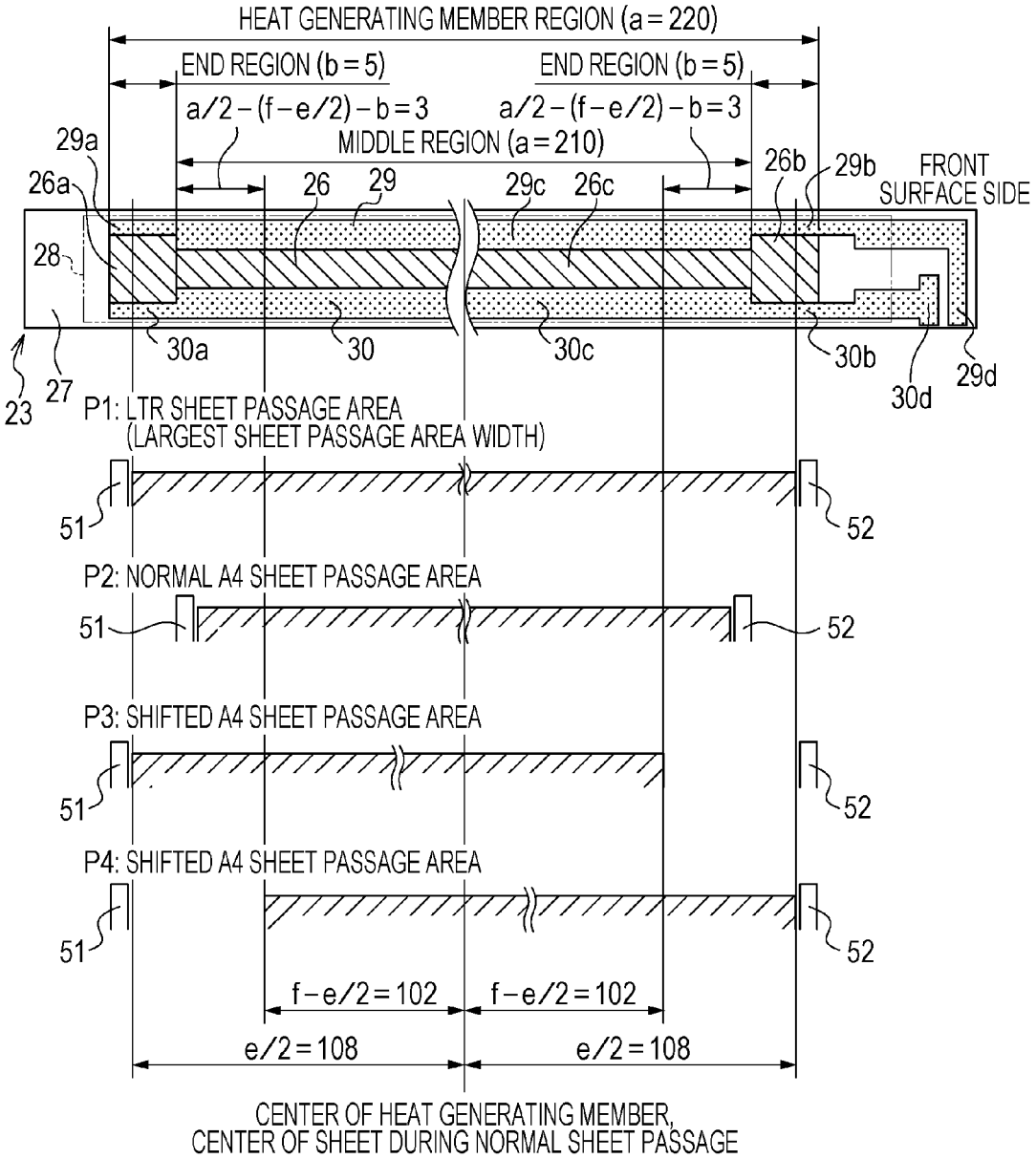
FIG. 8 is a front view of a heater according to a second exemplary embodiment.

According to a second exemplary embodiment, the configurations other than the pattern of the heater 23 are the same as those in the first exemplary embodiment. Accordingly, descriptions of the configurations other than the pattern of the heater 23 are not repeated. The pattern of the heater 23 according to the second exemplary embodiment is described below with reference to FIG. 8. According to the second exemplary embodiment, a heater 23 includes a first conductor pattern 29 formed on the substrate 27 at one end in the short direction of the substrate 27 and a second conductor pattern 30 formed at the other end. In addition, the heater 23 includes a first electrical contact portion 29*d* and a second electrical contact portion 30*d* formed in the first conductor pattern 29 and the second conductor pattern 30, respectively, at one end of the substrate 27 in the long direction of the substrate 27. Furthermore, the heater 23 includes a heat generating resistor 26 disposed between the first conductor pattern 29 and the second conductor pattern 30. The heat generating resistor 26 is electrically connected to the first conductor pattern 29 and the second conductor pattern 30. A length a of the heat generating resistor 26 in the long direction of the substrate 27 is 220 mm, which is greater than the width of the LTR size recording medium that is the largest among the widths of recording media P passing through the nip portion N (216 mm).

In addition, the first conductor pattern 29 has end regions 29*a* and 29*b* located at either end thereof in the long direction of the substrate 27 and a middle region 29*c* located between the end regions 29*a* and 29*b*. The conductor pattern 30 has end regions 30*a* and 30*b* located at either end thereof in the long direction of the substrate 27 and a middle region 30*c* located between the end regions 30*a* and 30*b*. According to the present exemplary embodiment, the width of the end region 29*a* (29*b*) of the first conductor pattern 29 in the short direction of the substrate 27 is smaller than that of the middle region 29*c*. Furthermore, the width of the end region 30*a* (30*b*) of the second conductor pattern 30 in the short direction of the substrate 27 is smaller than that of the middle region 30*c*. More specifically, according to the second exemplary embodiment, the width of the end region 29*a* (29*b*) of the first conductor pattern 29 in the short direction of the substrate 27 is 0.5 mm, and the width of the middle region 29*c* of the first conductor pattern 29 in the short direction of the substrate 27 is 1.5 mm. Similarly, the width of the end region 30*a* (30*b*) of the second conductor pattern 30 in the short direction of the substrate 27 is 0.5 mm, and the width of the middle region 30*c* of the second conductor pattern 30 in the short direction of the substrate 27 is 1.5 mm.

The heat generating resistor 26 has end regions 26*a* and 26*b* at either end thereof in the long direction of the substrate 27 and a middle region 26*c* between the end regions 26*a* and 26*b*. In the end regions at either end in the long direction of the substrate 27, by using a space produced by decreasing the widths of the two conductor patterns (29, 30) in the short direction of the substrate 27, the width of the heat generating resistor 26 in the short direction of the substrate 27 can be increased.

That is, in a region of the heater in which the width of the conductor pattern (29, 30) in the short direction of the substrate is small, the width of the heat generating resistor 26 in the short direction of the substrate is set to greater than the width of a region of the heat generating resistor 26 other than that region in the short direction of the substrate. More specifically, according to the present exemplary embodiment, the width of each of the end regions 26*a* and 26*b* of the heat generating resistor 26 in the short direction of the substrate 27 is set to 8.5 mm, and the width of the middle region 26*c* in the short direction of the substrate 27 is set to 6.5 mm.

Figure 9:
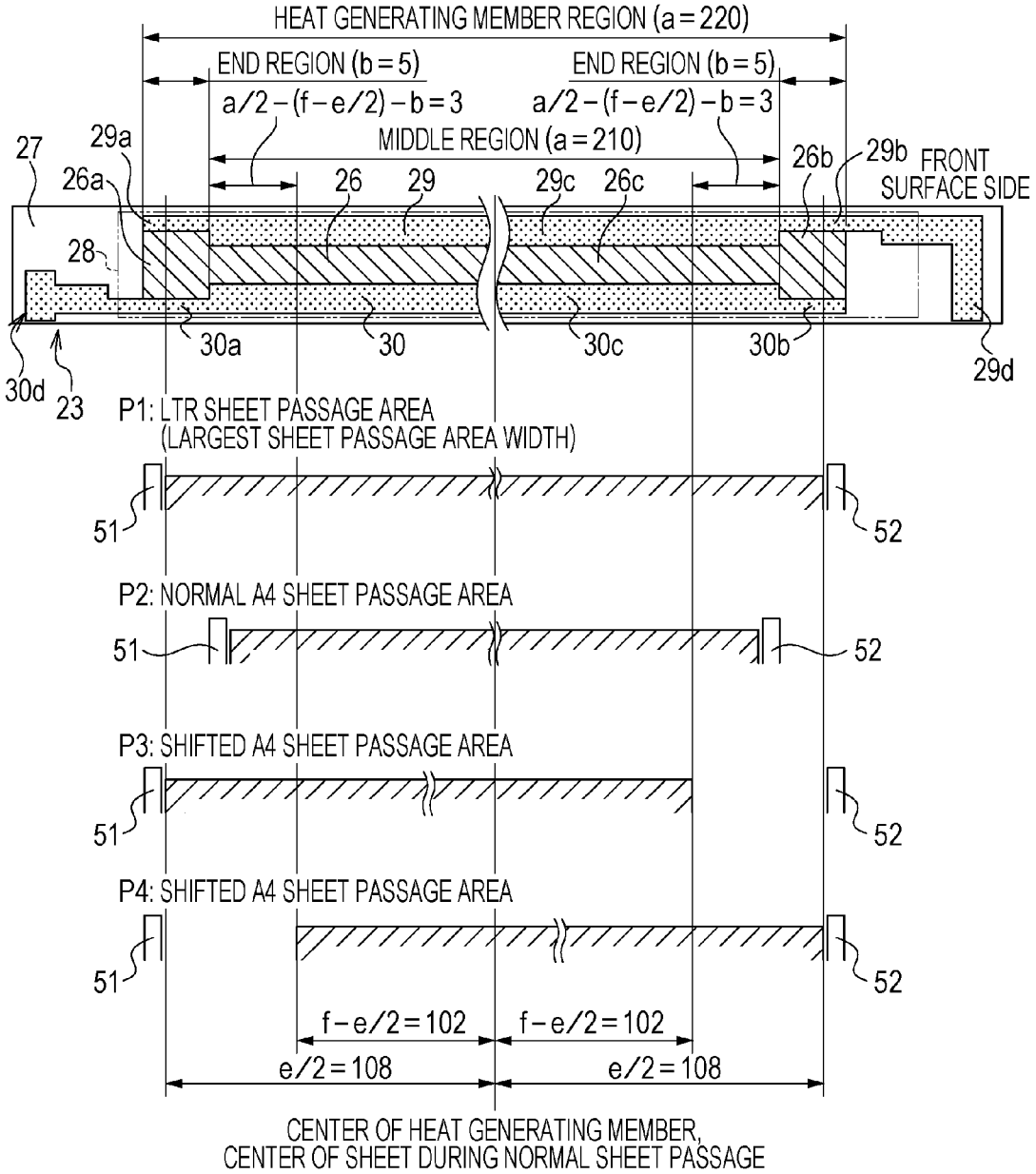
FIG. 9 is a front view of the heater according to a modification of the second exemplary embodiment.

FIG. 9 illustrates the patterns of the heater 23 according to a modification of the second exemplary embodiment. The modification of the second exemplary embodiment differs from the second exemplary embodiment in terms of only the position of the second electrical contact portion 30*d*. Since the effect of the different position of the second electrical contact portion 30*d* is the same as that of the modification of the first exemplary embodiment, descriptions of the effect is not repeated.

Note that in the second exemplary embodiment and the modification of the second exemplary embodiment, the widths of the first conductor pattern and the second conductor pattern in the short direction of the substrate 27 are reduced. However, at least one of the first conductor pattern and the second conductor pattern may be reduced in each of the end regions of the substrate 27 in the long direction of the substrate 27. That is, to provide, in the end region in the long direction of the substrate 27, a space in which a distance between the first conductor pattern and the second conductor pattern in the short direction of the substrate 27 is greater than that in the middle region, the width of at least one of the first conductor pattern and the second conductor pattern in the short direction of the substrate 27 is reduced. In addition, in the region in which the distance between the first conductor pattern and the second conductor pattern in the short direction of the substrate 27 is greater than that in the middle region, the width of the heat generating resistor 26 in the short direction of the substrate 27 is increased.

By decreasing the width of the conductor pattern and increasing the width of the heat generating resistor in the short direction of the substrate 27 in this manner, the width of the heat generating resistor can be increased without increasing the width of the substrate 27. Accordingly, the size of the heater 23 can be advantageously reduced to be smaller than that in the first exemplary embodiment.

Figure 12A:
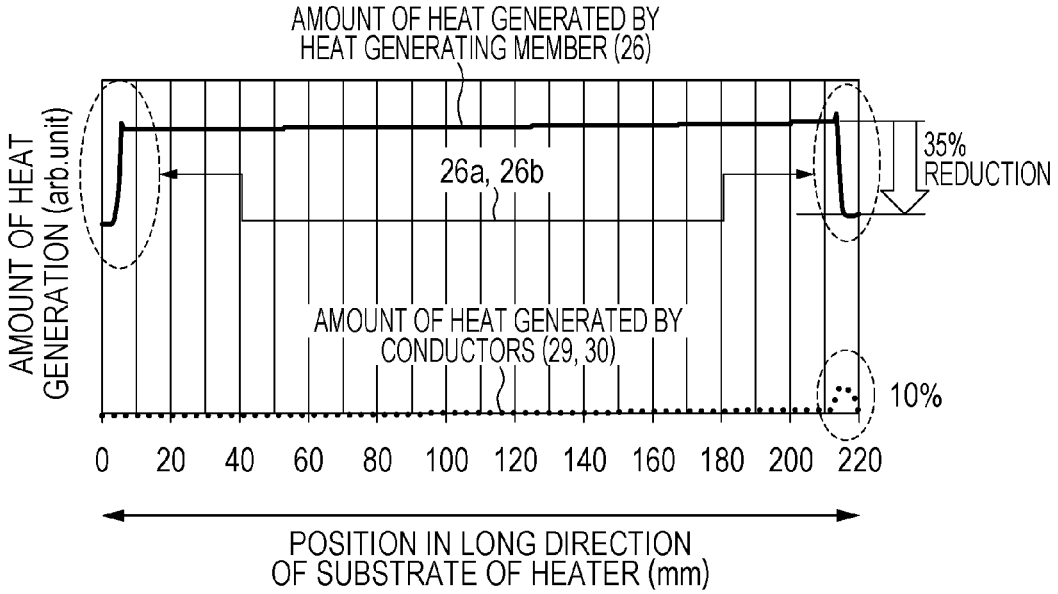
FIG. 12A illustrates the heat distribution of the heater along the long direction of the substrate according to the second exemplary embodiment.
Figure 12B:
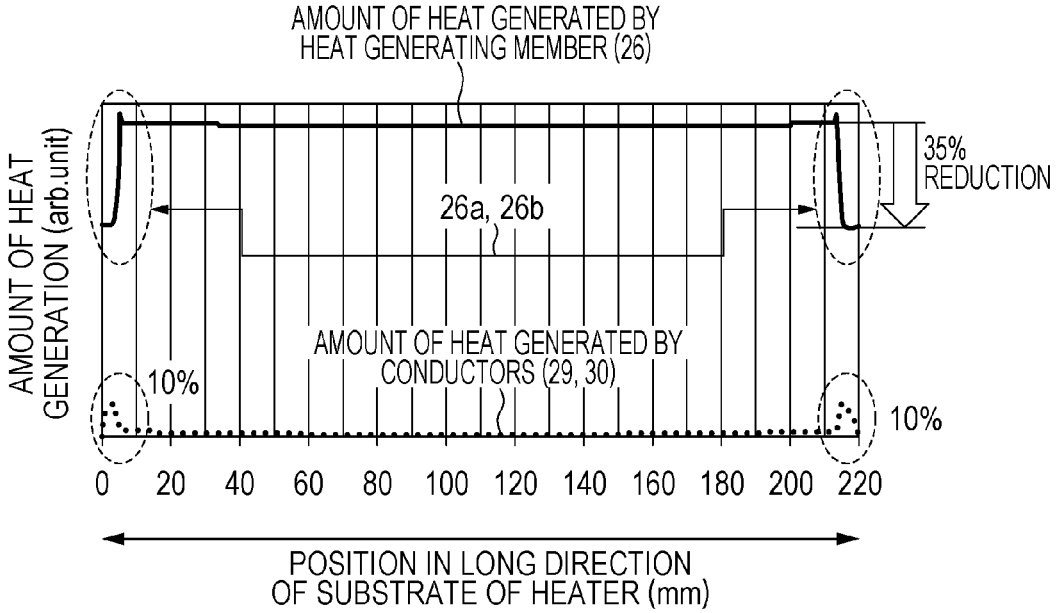
FIG. 12B illustrates the heat distribution of a heater along the long direction of the substrate according to the modification of the second exemplary embodiment.

An inhibitory effect of the heater on a temperature rise in the non-sheet passage area according to the second exemplary embodiment is discussed below with reference to FIGS. 12A and 12B. In FIGS. 12A and 12B, the abscissa represents a position in the long direction of the substrate 27 of the heater 23, and the ordinate represents the amount of heat generation of the heater 23. In FIGS. 12A and 12B, the average amounts of heat generation of the substrate 27 of the heater 23 according to the second exemplary embodiment (FIG. 8) and the modification of the second exemplary embodiment (FIG. 9) along the long direction of the substrate 27 are plotted, respectively. In FIGS. 12A and 12B, as the average amount of heat generation, the amount of heat generation of the heat generating resistor 26 and the amount of heat generation of the conductor pattern (29, 30) are separately illustrated.

According to the second exemplary embodiment and the modification of the second exemplary embodiment, the average amount of heat generation of the end region 26*a* (26*b*) of the heat generating resistor 26 can be reduced from that of the middle region 26*c* by 35%, as in the first exemplary embodiment. However, the amount of heat generation of the end region of the conductor pattern 29 (30) is at a level that is not negligible. According to the second exemplary embodiment, heat generation of the end region of the conductor pattern occurs in the end regions (29*b*, 30*b*) in the vicinity of the electrical contact portions 29*d* and 30*d*. In contrast, according to the modification of the second exemplary embodiment, heat generation of the end region of the conductor pattern occurs in both the end region (29*a*, 30*a*) and the end region (29*b*, 30*b*). The amount of heat generation of the end region of the conductor pattern is about 10% of the average amount of heat generation of the middle region 26*c* of the heat generating resistor 26 in each of the second exemplary embodiment and the modification of the second exemplary embodiment. The increase in the average amount of heat generation of the end region of the conductor pattern is caused by an increase in the resistance value of the conductor pattern due to reduction of the width of the conductor pattern.

Note that if, like the second exemplary embodiment, the absolute value of the reduced amount of heat generation of the end region of the heat generating resistor 26 is greater than the absolute value of the increased amount of heat generation of the end region of the conductor pattern, the amount of heat generation of the end region of the heater 23 is smaller than that in the middle region. Accordingly, an inhibitory effect of the heater on a temperature rise in the non-sheet passage area can be obtained.

In addition, if the electrical resistance value of the heat generating resistor is sufficiently greater than the electrical resistance value of the conductor pattern, an increase in the amount of heat generation of the end region of the conductor pattern is vanishingly small.

As described above, by using the heater according to the second exemplary embodiment or the modification of the second exemplary embodiment in a fixing device, a temperature rise in the non-sheet passage area can be prevented without increasing the width of the heater.

Third Exemplary Embodiment

Like the second exemplary embodiment, the configurations of the third exemplary embodiment other than the pattern of the heater 23 are the same as those of the first exemplary embodiment. Accordingly, description of the configurations other than the pattern of the heater 23 are not repeated.

Figure 13:
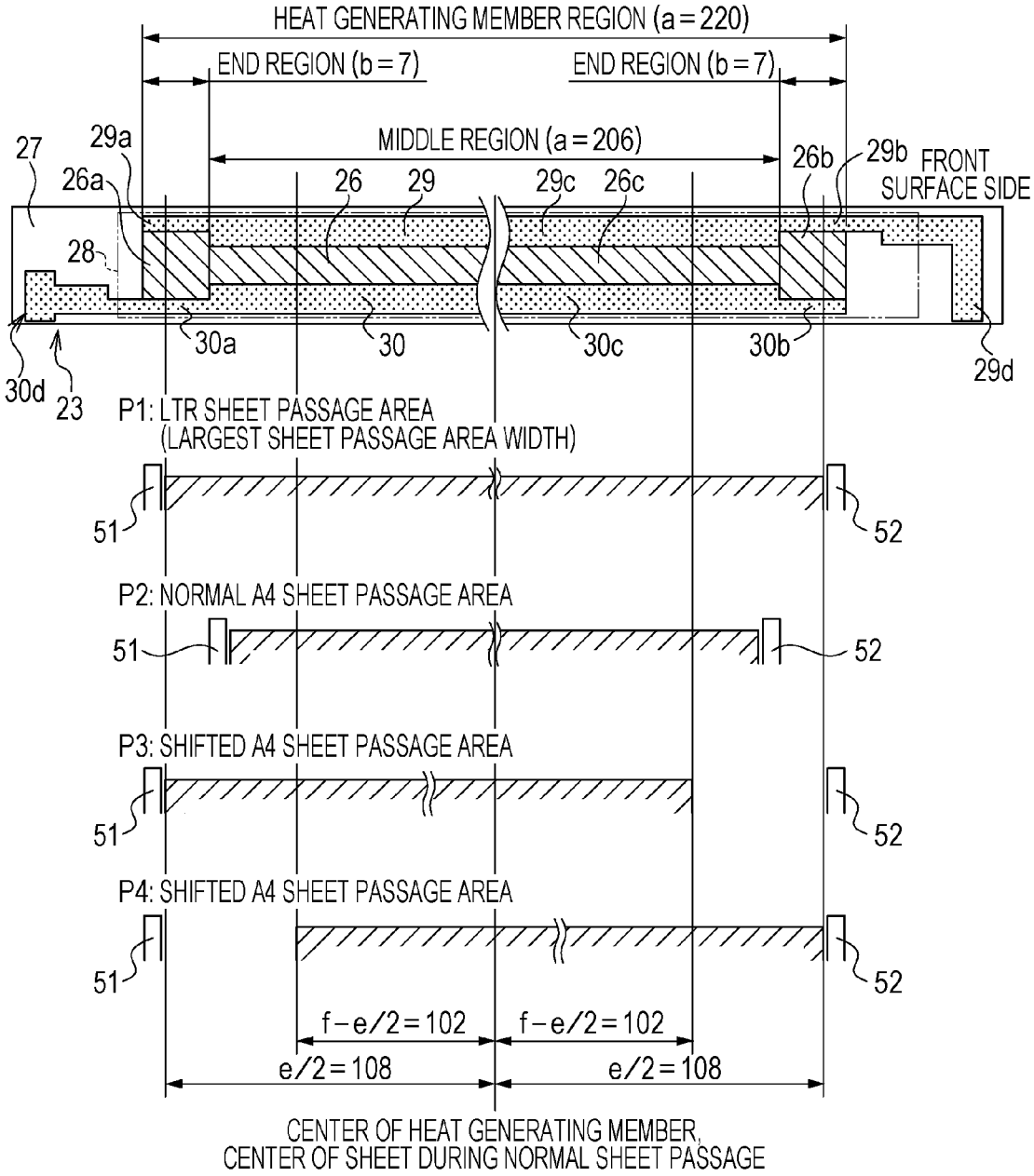
FIG. 13 is a front view of a heater according to a third exemplary embodiment.

FIG. 13 is a front view of an example of the heater 23 according to the present exemplary embodiment. Each of patterns is formed by applying an electrical resistance material (a heat generating member 26), such as ruthenium oxide ($RuO_2$), on a surface of the substrate 27 made of a high thermal conducting material, such as alumina or aluminum nitride using, for example, screen printing. Thereafter, an electric conductive material (conductor members 29 and 30), such as Ag, is applied using, for example, screen printing. Subsequently, glass or fluorine contained resin, for example, is coated thereon as a protection layer 28. According to the present exemplary embodiment, an alumina substrate having a width of 11 mm, a length of 270 mm, and a thickness of 1 mm is used as the substrate 27. In addition, a heat resisting glass layer having a thickness of about 60 μm is used as the protection layer 28. The protection layer 28 improves electrical insulation between the heat generating member 26 and the substrate 27 and the ease of sliding between the heater 23 and the inner surface of the film 22. To provide excellent contact between the heat generation pattern and the conductor pattern in the short direction of the substrate, the patterns are formed so as to have an overlapping area of 0.5 mm or greater. As illustrated in FIG. 13, by forming the conductor members 29 and 30 so as to extend in the long direction of the substrate and forming the heat generating member 26 between the conductor members 29 and 30, a print pattern can be formed on the heater 23 so as to allow an electric current to flow in the sheet conveyance direction. Power supply electrodes 29*d* and 30*d* are formed so as to be connected to the ends of the conductor members 29 and 30 in the long direction of the substrate, respectively.

A relationship between the heat generating member and the long direction of an LTR sheet and an A4 sheet is described next. Note that an LTR sheet has the largest printable width according to the present exemplary embodiment, and an A4 sheet has the second largest printable width. More specifically, since the image forming apparatus according to the present exemplary embodiment feeds a sheet with the short edge as the leading edge, a width e of an LTR sheet is 216 mm, and a width f of an A4 sheet is 210 mm.

In FIG. 13, an area P1 indicates an area in which an LTR size sheet is normally set at an LTR size position using regulating members 51 and 52 that regulate the position of a recording medium in the width direction. An area P2 indicates an area in which an A4 sheet is normally set at an A4 size position using the regulating members 51 and 52. An area P3 indicates an area in which one of the side edges of an A4 sheet is in contact with the regulating member 51, although the regulating member 51 and the regulating member 52 are located at an LTR size position. An area P4 indicates an area in which one of the side edges of an A4 sheet is in contact with the regulating member 52, although the regulating member 51 and the regulating member 52 are located at an LTR size position. That is, the areas P3 and P4 are areas in which the sheet is shifted to one side and is conveyed.

A length a of the heat generating member 26 in the long direction of the substrate 27 is 220 mm. That is, the length a is greater than the width of the LTR size sheet (216 mm), which is the largest width of the recording medium P that passes through the nip portion N illustrated in FIG. 13. The heat generating member 26 includes end regions 26*a* and 26*b* located at either end of the heat generating member 26 and a middle region 26*c* located between the end regions 26*a* and 26*b*.

The length of the middle region 26*c* in the long direction of the substrate 27 is 206 mm. The length of each of the end regions 26*a* and 26*b* in the long direction of the substrate 27 is 7 mm. The width of each of the end regions 26*a* and 26*b* of the heat generating member 26 in the short direction of the substrate is 7.5 mm. The width of the middle region 26*c* is 4.5 mm. That is, the width of the middle region 26*c* is set to smaller than the width of the end regions 26*a* and 26*b*. In addition, the width of the end regions 29*a*, 29*b*, 30*a*, and 30*b* of the conductor members in the short direction of the substrate is 1.0 mm. The width of each of the middle regions 29*c* and 30*c* of the conductor members is 2.5 mm. In this manner, the distance between the outer edge of the conductor member 29 and the outer edge of the conductor member 30 in the short direction of the substrate is set to 9.5 mm throughout the length of the substrate. According to the present exemplary embodiment, the first conductor pattern 29 and the second conductor pattern 30 are formed of Ag having a sheet resistance of 3 mΩ/square. The sheet resistance value of the heat generating member 26 is controlled so that the total electrical resistance between the power supply electrodes 29*d* and 30*d* is 19Ω. Note that each of the conductor member and the heat generating member is formed so as to have the same resistance value per unit area.

Figure 14A:
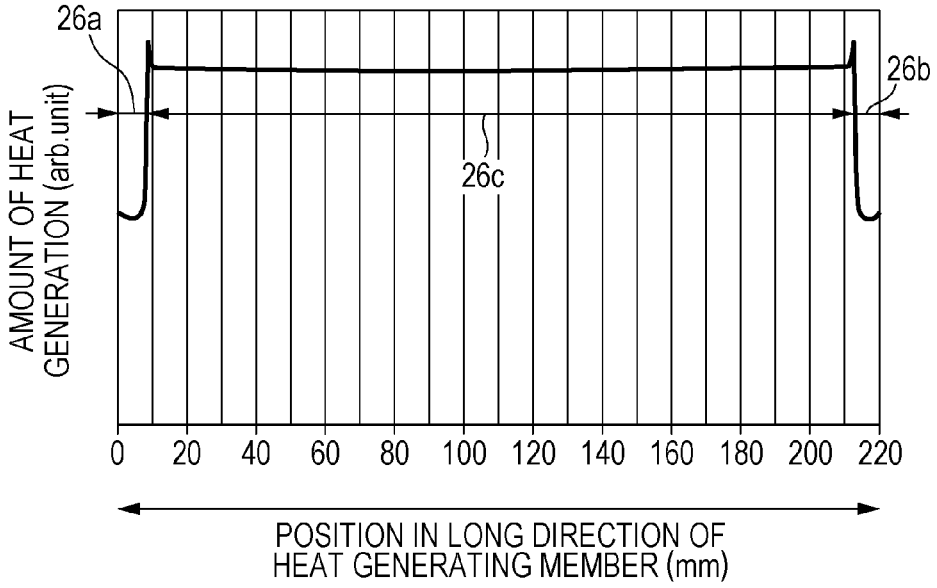
FIG. 14A illustrates the heat distribution of the heater according to the third exemplary embodiment.

The heat distribution in the long direction of the substrate according to the third exemplary embodiment is illustrated in FIG. 14A. Note that in FIG. 14A, the average amounts of heat generation of the heat generating member in the short direction of the substrate are plotted along the long direction of the substrate.

Since the electric resistance of each of the end regions 26*a* and 26*b* is greater than that of the middle region 26*c*, the amount of heat generation of each of the end regions 26*a* and 26*b* is greater than that of the middle region 26*c*, as illustrated in FIG. 14A. Note that by employing the heater pattern according to the present exemplary embodiment, the average amount of heat generation of each of the end regions 26*a* and 26*b* is about 60% of the average amount of heat generation of the middle region 26*c*.

A thermometric element 25 serving as a temperature detecting unit is disposed in the substantially middle of the back surface of the substrate 27 in the long direction of the substrate (in the small-size sheet passage area). According to the present exemplary embodiment, an external thermistor separated from the heat generating member 23 is used as the thermometric element 25. The external thermometric element 25 has a configuration in which for example, a heat insulating layer is formed on a support member (not illustrated), a chip thermistor element is fixed on the heat insulating layer, and the chip thermistor element is in pressure contact with the back surface of the substrate 27 using a predetermined pressing force with the chip thermistor element facing the back surface. According to the present exemplary embodiment, high heat resistance liquid crystal polymer is used as the support member, and stacked ceramic paper is used as a heat insulating layer.

In the heater 23, the substrate 27 is fixed to and supported by the groove 21*a* so that the substrate 27 is disposed with the front surface facing downward and is exposed through the groove 21*a* of the stay 21.

Figure 18:
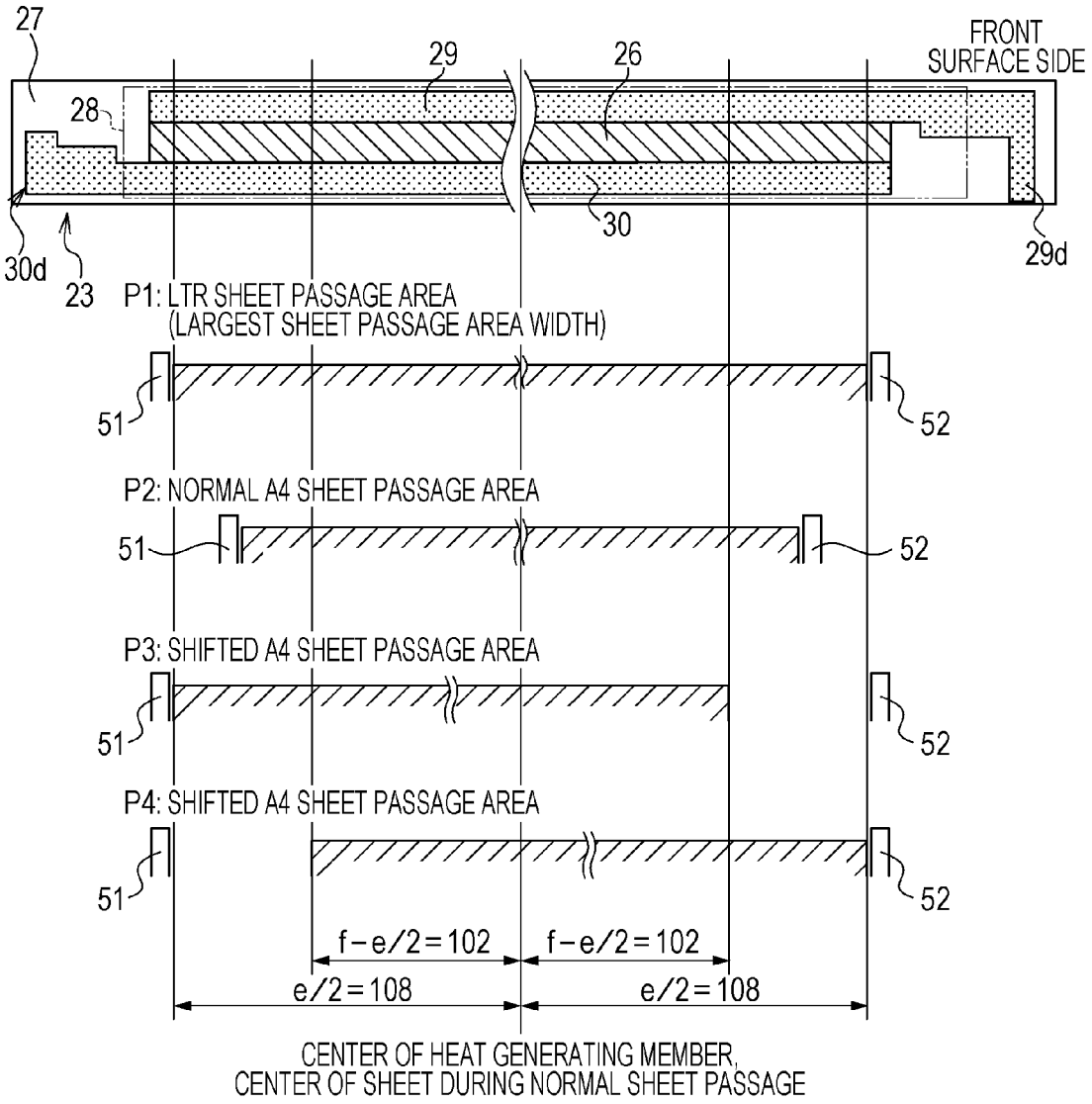
FIG. 18 is a front view of an existing heater.

The fixability and a temperature rise in the non-sheet passage area of the heater according to the present exemplary embodiment and comparative examples (an existing heater illustrated in FIG. 18) are evaluated. The heater according to the present exemplary embodiment has the configuration described above. In the existing heater illustrated in FIG. 18, the width of the heat generating member in the short direction of the substrate is uniform throughout the length thereof in the long direction and, thus, the electric resistance per unit length is uniform. The lengths of the heat generating member in the comparative examples are 214 mm, 215 mm, 216 mm, and 217 mm. The other configurations are the same as those of the present exemplary embodiment.

In terms of the fixability, the fixability of an unfixed toner image obtained when the LTR size recording medium having the largest printable width passes through the nip portion N is evaluated. The fixability is evaluated using a three grade system, in which (x) indicates that a toner image is completely destroyed when a finger runs back and forth over the toner image after a heat-fixing process, (Δ) indicates that a toner image is partially destroyed, and (○) indicates that a toner image is not destroyed at all. In this evaluation system, the evaluation (○) is at an acceptable level.

In terms of the temperature rise in the non-sheet passage area, an excessive temperature rise in the non-sheet passage area (the tendency of a temperature rise in the non-sheet passage area) is evaluated when the A4 sheet is shifted to one side and is conveyed through the nip portion N. To evaluate the tendency of a temperature rise in the non-sheet passage area, the temperature of the pressing roller that is damaged first by the temperature rise in the non-sheet passage area is measured. The pressing roller is made of silicon rubber having a withstand temperature limit of 230° C. The temperature rise in the non-sheet passage area is evaluated using a three grade system, in which (x) indicates that the temperature of the pressing roller is higher than or equal to 230° C., (Δ) indicates that the temperature is between 200° C. to 230° C., and (○) indicates that the temperature is lower than or equal to 200° C. In this evaluation system, the evaluation (○) that indicates that the temperature is lower than or equal to 200° C. is at an acceptable level.

The above-described technique for setting a distance between the regulating members 51 and 52 to the width of an LTR size, causing a side edge of the A4 sheet in the width direction to be in contact with one of the regulating members 51 and 52, and conveying the A4 size recording medium in the nip portion N is referred to as a "shifted sheet passage mode". In such a mode, the temperature rise in the non-sheet passage area is most prominent.

In this evaluation, the conveyance speed and the sheet-to-sheet interval are the same for LTR sheets and A4 sheets.

Table 3 indicates the results of evaluation of the fixability and a temperature rise in the non-sheet passage area according to the present exemplary embodiment and the comparative examples 5 to 8.

As indicated by the comparative examples 5 to 8 in Table 3, if the length is less than or equal to 215 mm, the fixability for an LTR sheet is not satisfactory. In addition, if the length is greater than or equal to 216 mm, prevention of a temperature rise in the non-sheet passage area is not satisfactory. That is, it is difficult for existing heaters having the amount of heat generation of the heat generating member that is uniform along the long direction to satisfy the fixability for an LTR sheet and prevention of a temperature rise in the non-sheet passage area at the same time. In contrast, according to the present exemplary embodiment, the fixability for an LTR sheet and prevention of a temperature rise in the non-sheet passage area are satisfactory at the same time.

This is because by using a parameter of the width (the length in the short direction of the substrate) of the end portion of the heat generating member in addition to a parameter of the length of the heat generating member, the amount of heat generation of the end portion of the heater can be controlled. In addition, according to the present exemplary embodiment, by cutting and removing part of the conductor member, the width of the heat generating member is increased. Accordingly, the width of the heater substrate in the short direction need not be increased to maintain the heat capacity of the heater substrate. As a result, the FPOT is not increased.

TABLE 3

| | Heater Specification | | | Temperature | |
|---|---|---|---|---|---|
| | Length a of Heat Generating Member | Length b of End Region of Heat Generating Member | LTR Fixability | Rise in Non-Sheet Passage Area for Shifted A4 Sheet | LTR Fixability |
| Comparative Example 5 | 214 | — | — | ○ | X |
| Comparative Example 6 | 215 | — | — | ○ | X |
| Comparative Example 7 | 216 | — | — | X | ○ |
| Comparative Example 8 | 217 | — | — | X | ○ |
| Third Exemplary Embodiment | 220 | 7 | 0.6 | ○ | ○ |

To determine the condition for satisfying the fixability and prevention of a temperature rise in the non-sheet passage area, a value equivalent to the amount of heat generation of the non-sheet passage area is calculated, and description is made with reference to the equivalent value.

The value equivalent to the amount of heat generation of the non-sheet passage area serves as a parameter related to the amount of heat generated by the heat generating member in a shifted sheet conveyance mode. The value equivalent to the amount of heat generation of the non-sheet passage area is defined as follows:

$$\text{The value equivalent to the amount of heat generation of the non-sheet passage area} = b\times(d/c)+\{a/2-(f-e/2)-b\}\times(c/c)$$

where a: the length of the heat generating member in the long direction (mm)

b: the length of the end portion of the heat generating member (mm)

c: the average amount of heat generation per unit length of the middle portion in the short direction of a substrate (W)

d: the average amount of heat generation per unit length of the end portion in the short direction of the substrate (W)

e: the width of an LTR sheet (216 mm)

f: the width of an A4 sheet (210 mm)

For simplicity, d and c are divided by c so that the amount of heat generation per unit length of the middle region 26*c* is 1. The first term b×(d/c) of the above-described equation is an equivalent value of the amount of heat generation of the end region 26*a* or 26*b* of the non-sheet passage area. The term {a/2−(f−e/2)−b}×(c/c) is an equivalent value of the amount of heat generation of the middle region 26*c* of the non-sheet passage area. The sum of the two equivalent values is an equivalent value of heat generation of the entire non-sheet passage area.

For example, according to the third exemplary embodiment, the parameters are set as follows:

a: 220 mm, b: 7 mm, d/c: 0.6, e: 216 mm, and f: 210 mm.

Thus, the equivalent value of heat generation of the non-sheet passage area can be calculated as follows:

$$7\times0.6+\{220/2-(210-216/2)-7\}\times1=5.2.$$

To conduct the experiment, the parameters are set in consideration of the following conditions.

That is, to obtain the fixability from the data in Table 3, the length of the heat generating member needs to be greater than or equal to 216 mm, which is the same value as the width of the LTR size. To ensure prevention of a temperature rise in the non-sheet passage area from the data in Table 3, the border between the end region and the middle region needs to be located within a 216-mm range, which is the width of the LTR size sheet. In addition, if an A4 sheet is conveyed in the shifted sheet conveyance mode, the A4 sheet passes through an area of a 204-mm range, which is a sheet passage area. Accordingly, in this area, heat of the heater is removed. Thus, the amount of heat generation of the heater need not be reduced. That is, the end region can be located outside the 204-mm range.

Table 4 indicates the specification of the heater used in the experiment and the result of the experiment. In the experiment, the length a of the heat generating member and the length b of the end region are changed. In addition, the ratio of the average amount of heat generation per unit length of the end portion d to the average amount of heat generation per unit length of the middle portion c is changed by changing the ratio of the width of the heat generating member to the width of the conductor in the end region. At that time, the fixability for an LTR sheet and a temperature rise in the non-sheet passage area in a shifted sheet conveyance mode of an A4 sheet are measured.

The evaluation system of the fixability and a temperature rise in the non-sheet passage area is the same as described above. As can be seen from Table 4, an increase in the equivalent value of the amount of heat generation of the non-sheet passage area has a disadvantage for prevention of the temperature rise in the non-sheet passage area, and a decrease in the equivalent value has a disadvantage for the fixability.

In addition, Table 4 indicates that if the equivalent value of the amount of heat generation of the non-sheet passage area is in the range from 5.2 to 6.6, the fixability and prevention of a temperature rise in the non-sheet passage area can be made satisfactory regardless of the length of the heat generating member.

TABLE 4

| Heater Specification | | | | | |
|---|---|---|---|---|---|
| Length a of Heat Generating Member | Length b of End Region | (Average Amount of Heat Generation d in End Region)/(Average Amount of Heat Generation c in Middle Region) | Equivalent Value of Amount of Heat Generation in Non-Sheet Passage Area | LTR Fixability | Temperature Rise in Non-Sheet Passage Area for Shifted A4 Sheet |
| 218 | 6 | 0.95 | 6.7 | ○ | X |
| 218 | 6 | 0.9 | 6.4 | ○ | ○ |
| 218 | 6 | 0.7 | 5.2 | ○ | ○ |
| 218 | 6 | 0.6 | 4.6 | X | ○ |
| 218 | 4 | 0.95 | 6.8 | ○ | X |
| 218 | 4 | 0.85 | 6.4 | ○ | ○ |
| 218 | 4 | 0.6 | 5.4 | ○ | ○ |
| 218 | 4 | 0.5 | 5 | X | ○ |
| 220 | 7 | 0.9 | 7.3 | ○ | X |
| 220 | 7 | 0.8 | 6.6 | ○ | ○ |
| 220 | 7 | 0.6 | 5.2 | ○ | ○ |
| 220 | 7 | 0.45 | 4.15 | X | ○ |
| 220 | 5 | 0.75 | 6.75 | ○ | X |
| 220 | 5 | 0.7 | 6.5 | ○ | ○ |
| 220 | 5 | 0.6 | 6.0 | ○ | ○ |
| 220 | 5 | 0.45 | 5.25 | ○ | ○ |
| 220 | 5 | 0.3 | 4.5 | X | ○ |
| 222 | 8 | 0.8 | 7.4 | ○ | X |
| 222 | 8 | 0.7 | 6.6 | ○ | ○ |
| 222 | 8 | 0.55 | 5.4 | ○ | ○ |
| 222 | 8 | 0.5 | 5 | X | ○ |
| 222 | 6 | 0.7 | 7.2 | ○ | X |
| 222 | 6 | 0.6 | 6.6 | ○ | ○ |

TABLE 4-continued

| Heater Specification | | | | | |
|---|---|---|---|---|---|
| Length a of Heat Generating Member | Length b of End Region | (Average Amount of Heat Generation d in End Region)/(Average Amount of Heat Generation c in Middle Region) | Equivalent Value of Amount of Heat Generation in Non-Sheet Passage Area | LTR Fixability | Temperature Rise in Non-Sheet Passage Area for Shifted A4 Sheet |
| 222 | 6 | 0.4 | 5.4 | ○ | ○ |
| 222 | 6 | 0.3 | 4.8 | X | ○ |

As described above, in the heater 23 according to the present exemplary embodiment, the length of the heat generating member 26 is longer than the width of an LTR sheet that is the largest printable width (216 mm). The average amount of heat generation of each of the end regions 26*a* and 26*b* of the heat generating member 26 is set to less than the average amount of heat generation of the middle region 26*c*. In addition, the position of the border between the middle region 26*c* and the end region 26*a* (26*b*) is determined such that the positions of the side edges of an LTR sheet are located in the end regions 26*a* and 26*b* having the average amount of heat generation lower than that of the middle region 26*c* and, when one of the side edges of an A4 sheet, which is a standard-sized sheet having a second largest width just behind an LTR sheet, is shifted to one side, the position of the other side edge is located in the middle region 26*c*. In this manner, the unfixed toner image t can be excellently fixed to an LTR sheet. In addition, if an A4 sheet is shifted to one side, a temperature rise of the non-sheet passage area can be reduced.

Accordingly, the fixing device 11 using the heater 23 according to the present exemplary embodiment can prevent an excessive temperature rise of the heater 23 during printing A4 sheets even when the conveyance speed and the sheet-to-sheet interval for A4 sheets are set to substantially the same as those for LTR sheets. In addition, for LTR sheets, an excellent fixability of the unfixed toner image t can be provided.

In addition, according to the present exemplary embodiment, by cutting and removing part of the conductor member, the width of the heat generating member can be increased. Accordingly, the width of the substrate in the short direction need not be increased to maintain the heat capacity of the heater substrate. As a result, the amount of heat generation of the end region can be controlled without increasing the FPOT.

While the present exemplary embodiment has been described with reference to the technique in which the largest printable width is determined as the width of an LTR sheet and an A4 sheet having the width smaller than the width of an LTR sheet is shifted to one side and conveyed, the technique is not limited thereto. For example, the largest printable width may be determined as the width of an A3 sheet (297 mm×420 mm), and a Ledger sheet (11"×17" ≅279 mm×432 mm) may be shifted to one side and be conveyed.

Figure 15:
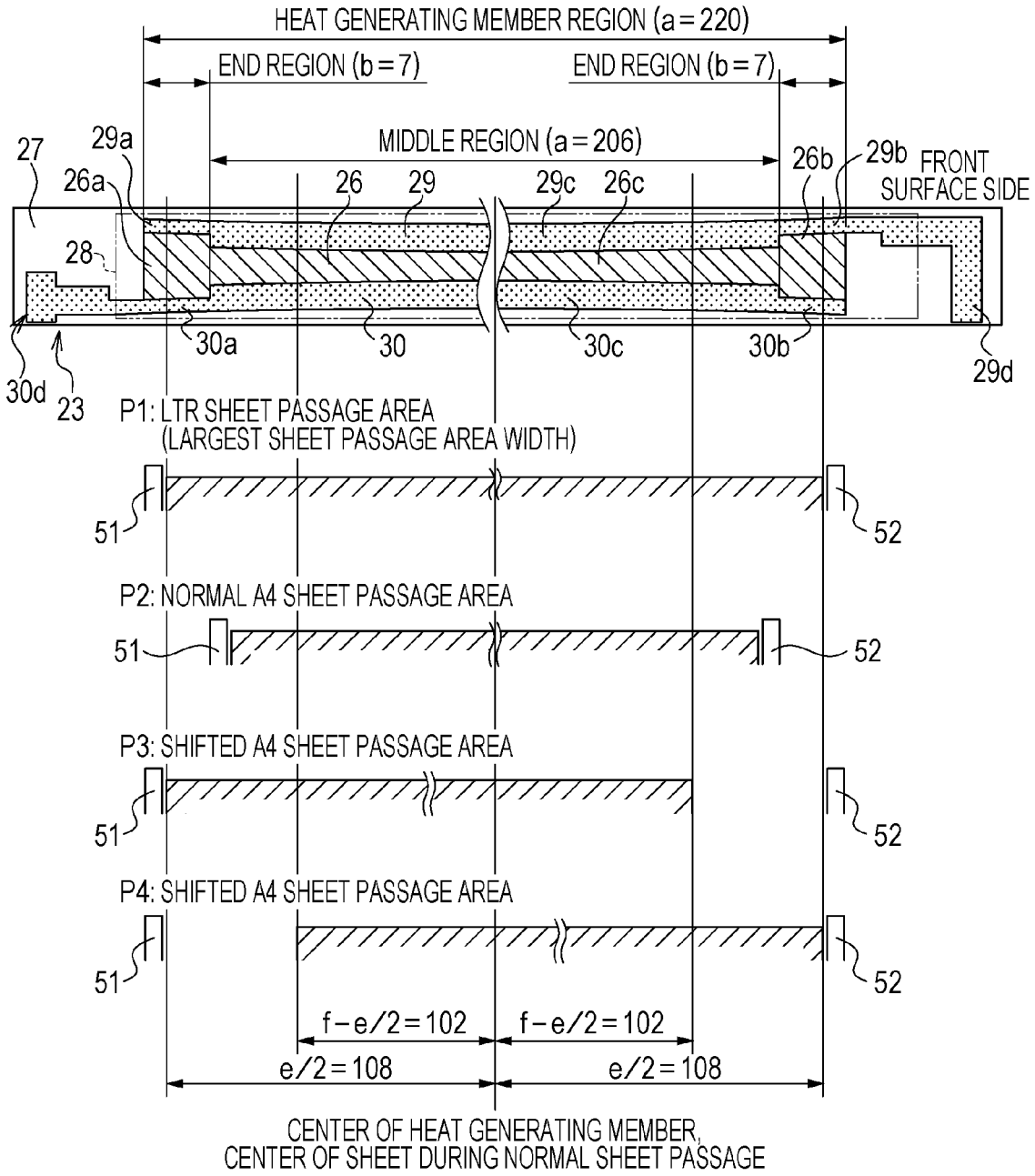
FIG. 15 is a front view of a heater having another configuration according to the third exemplary embodiment.

Alternatively, as illustrated in FIG. 15, for each of the middle region and the end region of the heat generating member, the width of the heat generating member may be gradually increased toward the end in the long direction of the substrate.

In addition, it is desirable to avoid the nonuniformity of heat generation that increases toward the power supply unit in the long direction of the substrate. Accordingly, as illustrated in FIG. 15, by gradually increasing the width of the heat generating member towards an end of the substrate in each of the middle region and the end region, the nonuniformity of heat generation in the long direction can be prevented. Thus, uniform heat distribution can be obtained in each of the middle region and the end region. In particular, if the volume resistivity of the conductor member is greater than the volume resistivity of the heat generating member, the nonuniformity of heat generation is prominent. Accordingly, it is desirable that the heater pattern illustrated in FIG. 7 be selected.

Fourth Exemplary Embodiment

In the configuration according to the third exemplary embodiment, by cutting out rectangular part of the conductor member, the width of the heat generating member can be increased to larger than that of the middle region in the long direction of the substrate and, thus, the amount of heat generation of the end region can be decreased. However, if rectangular part of the conductor member is cut out, an electrical current is locally concentrated into the border of the cut-out part (the border between the middle region and the end region illustrated in FIG. 13), a peak of the heat generation appears in a border portion between the middle region and the end region, as indicated by the heat distribution in FIG. 14A. In a heater having such a heat distribution, if, for example, printing is performed on an overhead transparency (OHT) of an LTR size, glossy unevenness occurs at a position corresponding to the peak of heat generation due to a local temperature rise.

Figure 16:
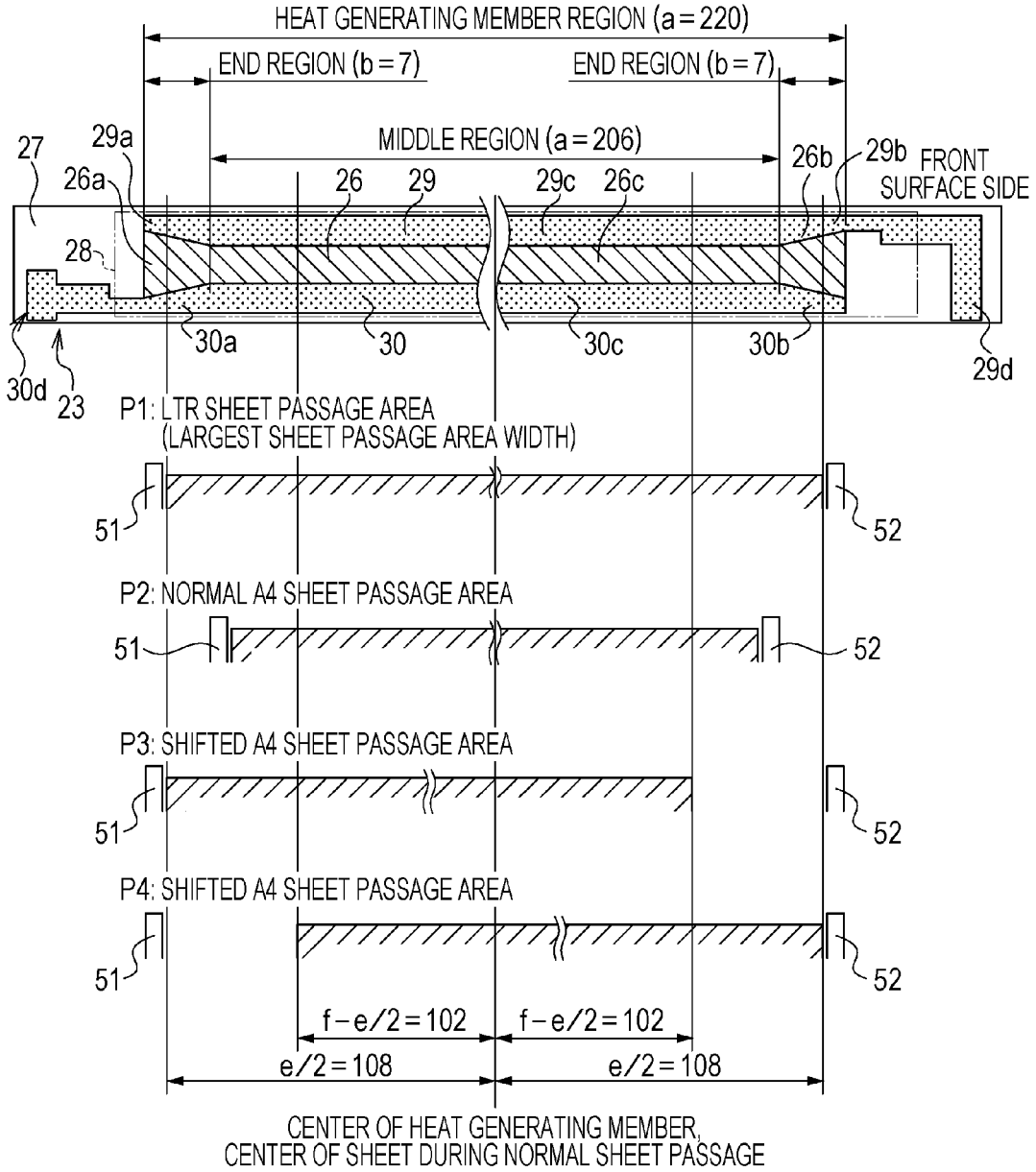
FIG. 16 is a front view of a heater according to the fourth exemplary embodiment.

Thus, according to the present exemplary embodiment, by changing the shape of the cut-out part, a configuration by which the occurrence of a local peak of heat generation is reduced and the amount of heat generation of the end region is reduced while preventing the glossy unevenness is provided. The heater pattern according to the present exemplary embodiment is illustrated in FIG. 16. Since the configurations other than the heater are the same as those of the first exemplary embodiment, description of the configurations are not repeated. The heater is described in detail below.

Like the third exemplary embodiment, an electrical resistance material (a heat generating member 26), such as ruthenium oxide ($RuO_2$), is applied to a surface of a heater substrate 27 made of a high thermal conducting material, such as alumina or aluminum nitride using, for example, screen printing. Thereafter, an electric conductive material (conductor members 29 and 30), such as Ag, is applied using, for example, screen printing. Subsequently, glass or fluorine contained resin, for example, is coated thereon as a protection layer 28. According to the present exemplary embodiment, an alumina substrate having a width of 11 mm, a length of 270 mm, and a thickness of 1 mm is used as the substrate 27. In addition, a heat resisting glass layer having a thickness of about 60 μm is used as the protection layer 28.

The protection layer 28 improves electrical insulation between the heat generating member 26 and the substrate 27 and the ease of sliding between the heater 23 and the inner peripheral surface (the inner surface) of the film 22. To provide excellent contact between the heat generation pattern and the conductor pattern in the short direction of the substrate, the members are formed so as to have an overlapping area of 0.5 mm or greater. As illustrated in FIG. 16, by forming the conductor members 29 and 30 so as to extend in the long direction of the substrate and forming the heat generating member 26 between the conductor members 29 and 30, a pattern can be formed on the heater 23 so as to allow an electric current to flow in the sheet conveyance direction. Power supply electrodes 29*d* and 30*d* are formed so as to be connected to the end regions of the conductor members 29 and 30 in the long direction of the substrate, respectively.

A length a of the heat generating member 26 in the long direction of the substrate 27 is 220 mm. That is, the length a is greater than the width of an LTR size sheet (216 mm), which is the largest width of the recording medium P that passes through the nip portion N illustrated in FIG. 16. The heat generating member 26 includes end regions 26*a* and 26*b* located at either end thereof and a middle region 26*c* located between the end regions 26*a* and 26*b*.

The length of the middle region 26*c* in the long direction of the substrate 27 is 206 mm. The length of each of the end regions 26*a* and 26*b* in the long direction of the substrate 27 is 7 mm. The width of the middle region 26*c* of the heat generating member 26 in the short direction of the substrate 27 is 4.5 mm, which is uniform along the length thereof. In contrast, as illustrated in FIG. 16, the width of each of the end regions 26*a* and 26*b* of the heat generating member 26 in the short direction of the substrate is 4.5 mm in a border portion with the middle region 26*c*. The width gradually increases from the border portion towards the end of the heat generating member 26 at a rate of 0.429 mm/unit length in the long direction of the substrate. The width is 7.5 mm at the end of the heat generating member 26.

The width of each of the middle regions 29*c* and 30*c* of the conductor members 29 and 30, respectively, in the width direction of the substrate is set to 2.5 mm throughout the length thereof. In contrast, as illustrated in FIG. 16, each of the widths of the end region 29*a*, 29*b*, 30*a*, and 30*b* in the short direction of the substrate is 2.5 mm at the border with the middle region 29*c* or 30*c*. The width gradually decreases from the border towards the end of the conductor member at a rate of 0.214 mm/unit length in the long direction of the substrate. The width is 1.0 mm at the end of the conductor member.

As described above, the ratio of the width of the heat generating member to the width of the conductor member in the end region is set to higher than that in the middle region. Thus, the resistance value of the end region of the heat generating member in the short direction of the substrate is set to higher than that that of the middle region. In addition, as illustrated in FIG. 16, by gradually decreasing the width of each of the end region 29*a*, 29*b*, 30*a*, and 30*b* of the conductor members in the short direction of the substrate, local concentration of an electrical current at the border between the middle region and the end region can be reduced and, thus, the occurrence of a peak of heat generation is prevented. Note that the distance between the outer edges of the conductor members 29 and 30 in the short direction of the substrate is 9.5 mm, which is uniform throughout the length of the conductor member.

According to the present exemplary embodiment, the conductor members 29 and 30 are formed of Ag having a sheet resistance of 3 mΩ/square. The sheet resistance value of the heat generating member 26 is controlled so that the total electrical resistance between the power supply electrodes 29*d* and 30*d* is 19Ω. Note that each of the conductor members 29 and 30 and the heat generating member 26 is formed so as to have the same resistance value per unit area.

Figure 14B:
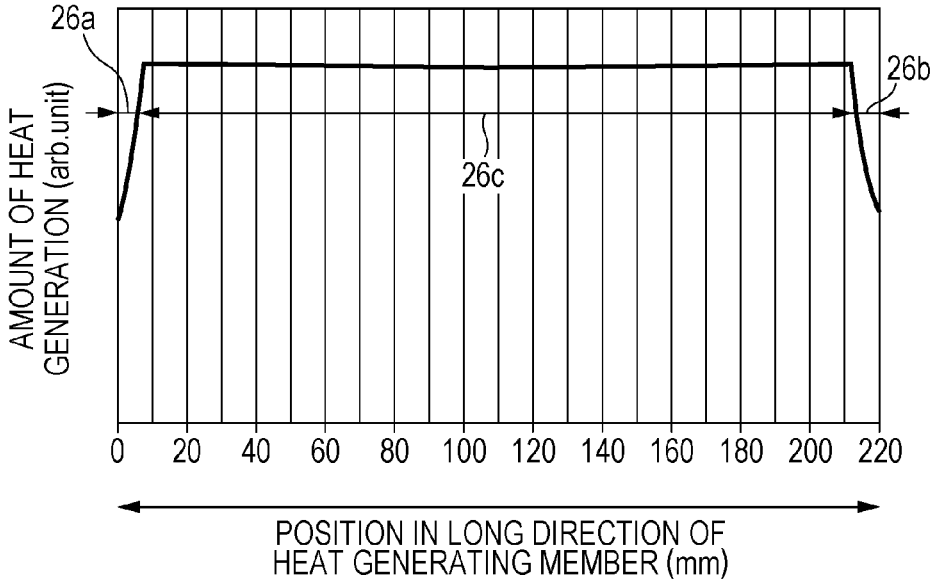
FIG. 14B illustrates the heat distribution of a heater according to a fourth exemplary embodiment.

The heat distribution of the heater pattern in FIG. 16 in the long direction of the substrate is illustrated in FIG. 14B. Note that in FIG. 14B, the average amounts of heat generation of the heat generating member along the short direction of the substrate are plotted.

Since the electric resistance of each of the end regions 26*a* and 26*b* is greater than that of the middle region 26*c*, the amount of heat generation of each of the end regions 26*a* and 26*b* is less than that of the middle region 26*c*, as illustrated in FIG. 14B. In addition, as can be seen from comparison of FIG. 14B and FIG. 14A that indicates the heat distribution of the heater pattern of the first exemplary embodiment illustrated in FIG. 9, the peak of heat generation in the border portion between the middle region and the end region is reduced. By cutting the cut-out portion in a diagonal direction, local concentration of an electrical current in the border portion between the middle region and the end region can be prevented and, thus, the peak of heat generation in the border portion can be reduced.

Note that, by forming the heat pattern of the present exemplary embodiment, the average amount of heat generation of each of the end regions 26*a* and 26*b* can be about 70% of the average amount of heat generation of the middle region 26*c*.

As described above, by employing the configuration of the present exemplary embodiment, a peak of heat generation at the border between the middle region and the end region can be reduced, and the amount of heat generation in the end region of the heat generating member in the long direction of the substrate can be reduced.

The results of evaluation of the fixability, the temperature rise in the non-sheet passage area, and the glossy unevenness of the heater according to the present exemplary embodiment are discussed below. Table 5 indicates the results of evaluation of the fixability, the temperature rise in the non-sheet passage area, and the glossy unevenness in the image forming apparatus when the shape of the cut-out part is changed. Note that in evaluation of the glossy unevenness, (x) indicates that a glossy unevenness appears when printing is performed on an OHT having an LTR size, and (○) indicates that no glossy unevenness appears. In addition, the evaluation systems for the fixability and a temperature rise in the non-sheet passage area and a technique for calculating the equivalent value of the amount of heat generation of the non-sheet passage area are the same as those in the third exemplary embodiment.

Figure 17A:
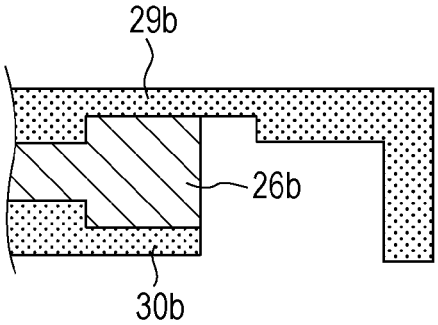
FIGS. 17A to 17D illustrate the shapes of a cut-out part of a conductor end portion.
Figure 17B:
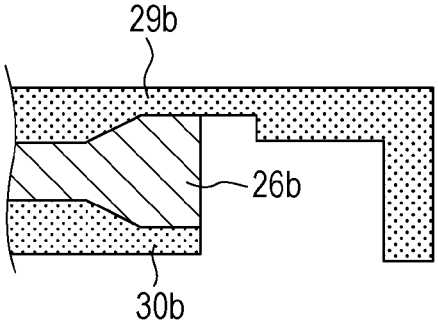
Figure 17C:
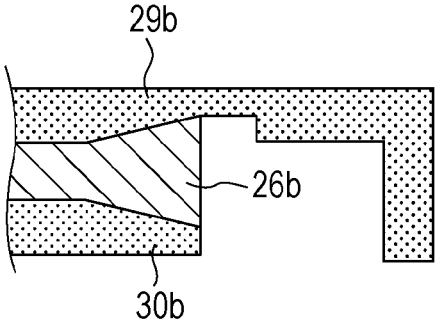
Figure 17D:
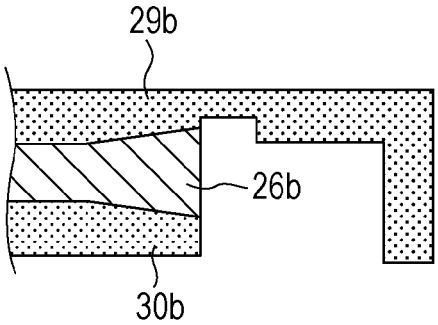

As the comparative examples, four types of heater are prepared. A heater having a rectangular cut-out portion (the third exemplary embodiment) and heaters having different decreases in the width of the conductor members per unit length in the long direction of the substrate are evaluated as the comparative examples. FIGS. 17A to 17D illustrate the end portion patterns of the heaters used in this evaluation. More specifically, FIG. 17A illustrates an end portion pattern of the first exemplary embodiment, in which the cut-out part of the conductor member is rectangular in shape. FIG. 17B illustrates an end portion pattern in which the cut-out part of the conductor member is diagonal in shape and the width of the conductor member decreases at a rate of 0.667 mm per unit length in the long direction of the substrate. At that time, the width of the conductor member is constantly 1 mm within the range of 3 mm from the end of the conductor member in order to prevent the width from being less than 1 mm. FIG. 17C illustrates an end portion pattern according to the present exemplary embodiment. The cut-out part of the conductor member is diagonal in shape, and the width of the conductor member decreases at a rate of 0.214 mm per unit length in the long direction of the substrate. The width of the conductor member in the end region is exactly 1 mm. FIG. 17D illustrates an end portion pattern in which the cut-out part of the conductor member is diagonal in shape and the width of the conductor member decreases at a rate of 0.071 mm per unit length in the long direction of the substrate. The width of the conductor member in the end region is exactly 2 mm. Note that in each of the heater patterns illustrated in FIGS. 17A to 17D, the length of the heat generating member is 220 mm, and the length of the end region is constantly 7 mm.

As can be seen from the results of evaluation of the four types of heater pattern in Table 5, by employing a diagonal cut-out part, the glossy unevenness occurring in an OHT of an LTR size can be prevented. However, if the rate of a decrease in the width of the conductor member per unit length in the long direction of the substrate is too low, the effect of reduction in the amount of heat generation of the end portion is small. As a result, the temperature rise in the non-sheet passage area is not satisfactory when an A4 sheet is shifted to one side and is conveyed.

That is, even when part of the conductor member is diagonally cut out, it is necessary to control the decrease in the width per unit length in the long direction of the substrate so that the equivalent value of the amount of heat generation of the non-sheet passage area is in the range from 5.2 to 6.6. In this manner, the glossy unevenness can be prevented, and the fixability and the temperature rise in the non-sheet passage area can be made satisfactory at the same time.

TABLE 5

| Heater Specification | | | | | | | |
|---|---|---|---|---|---|---|---|
| Shape of End Region | Shape of Cut-out Part | Decrease in Conductive Width in End Region per Unit Length | (Average Amount of Heat Generation d in End Region)/(Average Amount of Heat Generation c in Middle Region) | Equivalent Value of Amount of Heat Generation in Non-Sheet Passage Area | LTR Fixability | Temperature Rise in Non-Sheet Passage Area for A4 | OHT glossy unevenness |
| FIG. 17A | Rectangular | — | 0.60 | 5.2 | ○ | ○ | x |
| FIG. 17B | Diagonal | 0.667 | 0.65 | 5.55 | ○ | ○ | ○ |
| FIG. 17C | Diagonal | 0.214 | 0.70 | 5.9 | ○ | ○ | ○ |
| FIG. 17D | Diagonal | 0.071 | 0.82 | 6.74 | ○ | x | ○ |

As described above, in the heater 23 according to the present exemplary embodiment, part of each of the end regions 29*a*, 29*b*, 30*a*, and 30*b* is diagonally cut out and, thus, the average amount of heat generation of each of the end regions 26*a* and 26*b* of the heat generating member 26 is set to lower than that of the middle region 26*c*. In this manner, the unfixed toner image t is excellently fixed to an LTR sheet without glossy unevenness. In addition, when an A4 sheet is shifted to one side, a temperature rise in the non-sheet passage area can be reduced.

Accordingly, the fixing device 11 using the heater 23 according to the present exemplary embodiment can prevent an excessive temperature rise of the heater 23 during printing an A4 sheet even when the conveyance speed and the sheet-to-sheet interval for A4 sheets are set to substantially the same as those for LTR sheets. In addition, for LTR sheets, an excellent fixability of the unfixed toner image t can be provided.

While the present exemplary embodiment has been described with reference to the technique in which the largest printable width is determined as the width of an LTR sheet and an A4 sheet having the width smaller than the width of the LTR sheet is shifted to one side and conveyed, the technique is not limited thereto. For example, the largest printable width may be determined as the width of an A3 sheet (297 mm×420 mm), and a Ledger sheet (11"×17"≅279 mm×432 mm) may be shifted to one side and be conveyed.

Fifth Exemplary Embodiment

Like the above-described exemplary embodiments, the configurations of the fifth exemplary embodiment other than the pattern of the heater are the same as those of the first exemplary embodiment. Accordingly, description of the configurations other than the pattern of the heater are not repeated.

Figure 19:
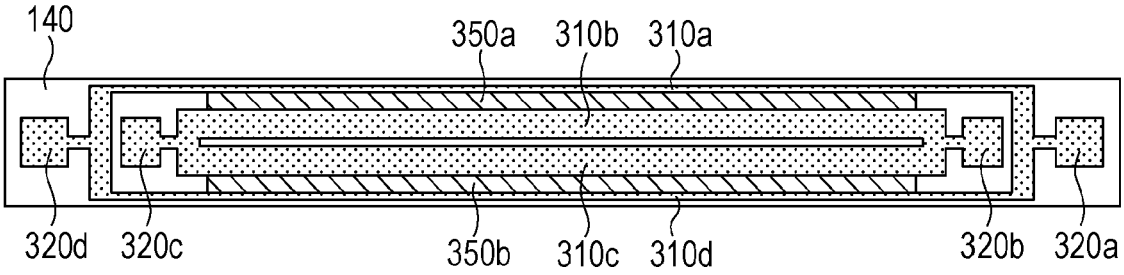
FIG. 19 is a front view of a heater according to a fifth exemplary embodiment.

FIG. 19 is a plan view of a heater 130 mounted in a fixing device 8 according to the fifth exemplary embodiment. The heater 130 includes an elongated substrate 140 made of alumina. The substrate 140 is 1 mm in thickness, is 290 mm in length in a direction perpendicular to the recording medium conveyance direction, and is 10 mm in width in the recording medium conveyance direction.

Conductor members formed on the substrate 140 is described below. A first conductor member is formed so as to have a long annular shape that extends in the long direction of the substrate. The first conductor member includes a conductor portion 310*b* and a conductor portion 310*c*. In addition, an annular second conductor member including a conductor portion 310*a* and a conductor portion 310*d* is formed so as to outwardly surround the first conductor member with a space therebetween. The first conductor member and the second conductor member are formed of a conductive material, such as Ag or Ag/Pd, containing glass powders.

An electrical contact portion of the conductor member formed in the heater 130 is described next. A first electrical contact portion 320*b* is formed in one end portion of the first conductor member in the long direction of the substrate, and a second electrical contact portion 320*c* is formed in the other end portion of the first conductor member in the long direction of the substrate. A third electrical contact portion 320*a* is formed in an end portion of the second conductor member in the long direction of the substrate and on the same side as the first electrical contact portion 320*b*. A fourth electrical contact portion 320*d* is formed in an end portion of the second conductor member in the long direction of the substrate and on the same side as the second electrical contact portion 320*c*.

A technique to apply voltages to the above-described electrical contact portions is described next. Voltages having the same polarity are applied to the first electrical contact portion 320*b* and the second electrical contact portion 320*c*. In addition, voltages having the same polarity are applied to the third electrical contact portion 320*a* and the fourth electrical contact portion 320*d*. The voltages applied to the first electrical contact portion 320*b* and the second electrical contact portion 320*c* have a polarity that is opposite to the polarity of the voltages applied to the third electrical contact portion 320*a* and the fourth electrical contact portion 320*d*. A first power supply connector is attached to the first electrical contact portion 320*b* and the third electrical contact portion 320*a*, and a second power supply connector is attached to the second electrical contact portion 320*c* and the fourth electrical contact portion 320*d*. In this manner, according to the fifth exemplary embodiment, each of the first conductor member and the second conductor member is configured to receive power from both end portions in the long direction of the substrate 140.

The configuration of heat generating resistors is described next. Two heat generating resistors, that is, a first heat generating resistor 350*a* and a second heat generating resistor 350*b*, are disposed on the substrate 140. The first heat generating resistor 350*a* is disposed between a conductor portion 310*b* of the first conductor member and a conductor portion 310*a* of the second conductor member and is electrically connected to the conductor portion 310*b* and the conductor portion 310*a*. The second heat generating resistor 350*b* is disposed between a conductor portion 310*c* of the first conductor member and a conductor portion 310*d* of the second conductor member and is electrically connected to the conductor portion 310*c* and the conductor portion 310*d*. In this manner, according to the fifth exemplary embodiment, the heater 130 has two heat generating regions arranged in the short direction of the substrate, and each of the two heat generating regions is formed from a set of the first conductor member, the second conductor member, and the heat generating resistor. Note that the first heat generating resistor 350*a* and the second heat generating resistor 350*b* have a PTC and a temperature coefficient of resistance (TCR) of 500 ppm/° C.

The width of each of the conductor portion 310*a* and the conductor portion 310*d* of the second conductor member in the short direction of the substrate 140 is 0.5 mm. The width of each of the conductor portion 310*b* and the conductor portion 310*c* of the first conductor member in the short direction of the substrate 140 is 1.7 mm. The width of the conductor portion 310*a* and the conductor portion 310*d* in the short direction of the substrate 140 of the second conductor member is set to smaller than the width of the conductor portion 310*b* and the conductor portion 310*c* of the first conductor member in the short direction of the substrate 140. This setting is employed in order to minimize the distance between the heat generating resistor and an end portion of the substrate in the short direction of the substrate.

The electrical contact portion, the conductor member, and the heat generating resistor are formed on the substrate 140 using screen printing so that the thickness thereof is easily controlled. The conductor member and the electrical contact portion is screen-printed on the substrate 140 using the same paste material. In addition, the heat generating resistor 350*a* and the heat generating resistor 350*b* are screen-printed on the substrate 140 using the same paste material. The length of each of the heat generating resistors 350*a* and 350*b* in the long direction of the substrate is about 220 mm. The heat generating resistors 350*a* and 350*b* are formed of an electrical resistance material, such as ruthenium oxide or silver-palladium (Ag/Pd), containing glass powders. By changing the compounding ratio of the materials, the volume resistivity of the resistors can be changed. According to the present exemplary embodiment, ruthenium oxide is used.

The paste for the conductor member and the electrical contact portion are screen-printed on the substrate 140 at the same time. Thereafter, the heat generating resistors 350*a* and 350*b* are screen-printed on the conductor member. Subsequently, a glass layer is screen-printed so as to cover the heat generating resistors.

Nonuniformity of heat generation and heater cracking, which are the issues to be solved for a heater used in fixing devices, are described below. Nonuniformity of heat generation is described first. Nonuniformity of heat generation negligibly occurs if the electrical resistance value of the conductor member is negligibly small with respect to the resistance value of the heat generating resistor. This is because since the conductor member has substantially uniform potential along the long direction of the substrate, the heat generating resistor uniformly generates heat throughout the length thereof. However, in reality, since the conductor member has a limitation on, for example, the width in the short direction of the substrate, it is difficult to reduce the electrical resistance value of the conductor member to a negligible level with respect to the electrical resistance value of the heat generating resistor. Accordingly, the voltage of the conductor member drops in the long direction of the substrate and, thus, the nonuniformity of heat generation occurs in the long direction of the substrate. The level of nonuniformity of heat generation varies from pattern to pattern on the substrate 140.

Figure 27:
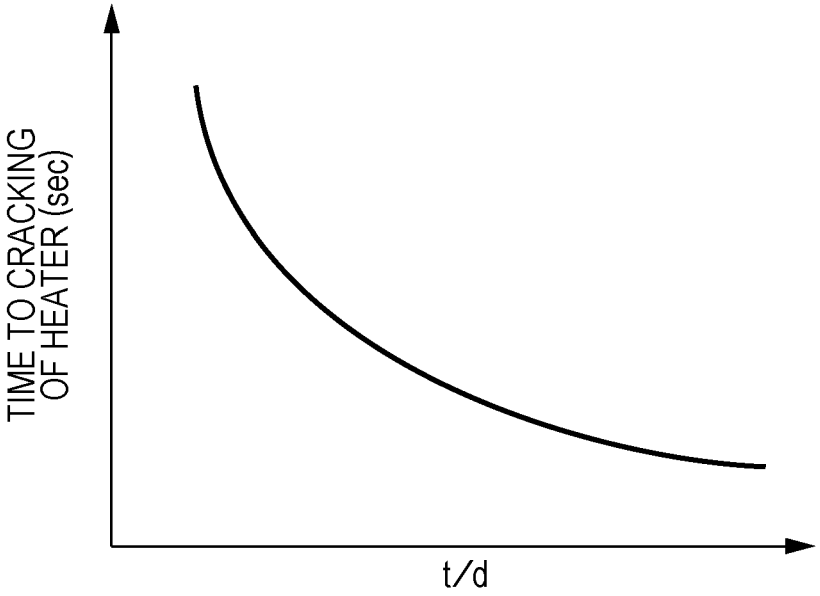
FIG. 27 illustrates a relationship between a position in a heat generating resistor illustrated in FIG. 25 and a time to heater cracking.

Heater cracking is described next. To prevent heater cracking, it is desirable that in the short direction of the substrate, each of the two heat generating resistors be located in the vicinity of the end portion of the substrate in the short direction of the substrate. FIG. 27 illustrates a relationship between t/d and a time to heater cracking when a thermal runaway test in which power is continuously supplied to the heater is conducted. As can be seen from FIG. 27, the time to heater cracking increases with decreasing t/d and, thus, the heater margin increases with decreasing t/d.

Note that in FIG. 27, "d" denotes the width of the substrate, and "t" denotes the smallest distance from an end of the substrate to the heat generating resistor in the short direction of the substrate. "t/d" is an index indicating how close each of the two heat generating resistors is to an end portion of the substrate and how far the two heat generating resistors are apart.

The results of evaluation of the nonuniformity of heat generation and the heater cracking margin for the heaters according to the fifth exemplary embodiment, a comparative example 10, and a comparative example 20 are shown in Table 6.

TABLE 6

Figure 25:
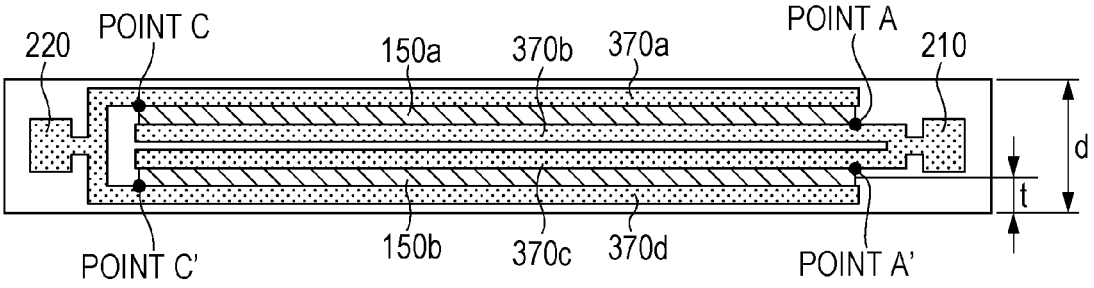
FIG. 25 is a plan view of an existing heater.
Figure 26A:
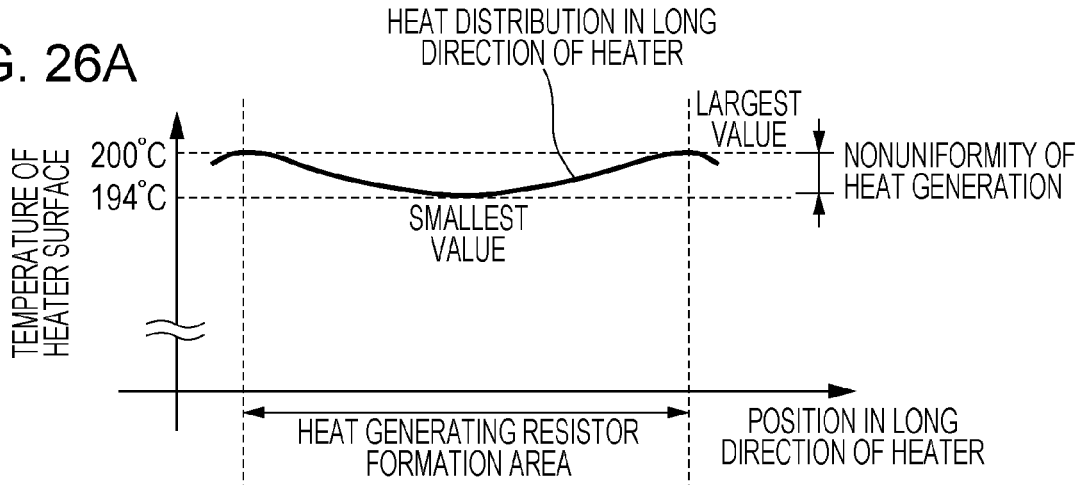
FIGS. 26A and 26B illustrate the heat distribution and the potential distribution in the length direction of a substrate of the heater illustrated in FIG. 25.
Figure 26B:
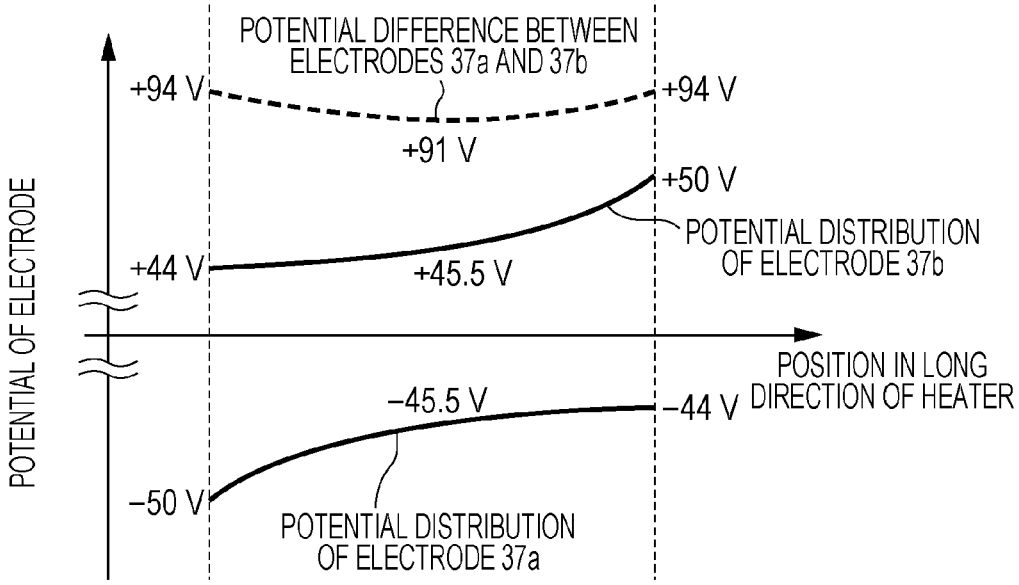

| Heater Pattern | Nonuniformity of Heat Generation | Heater Cracking Margin |
|---|---|---|
| Comparative Example 10 (FIG. 25) | 6° C. (FIG. 26A) | 1.5 seconds |
| Comparative Example 20 (FIG. 28) | 12° C. (FIG. 29A) | 5.9 seconds |
| Fifth Exemplary Embodiment (FIG. 19) | 8° C. (FIG. 20A) | 6.1 seconds |

The configuration that is common to the comparative example 10 and the comparative example 20 (an existing heater) is described next. The substrate 140 of the heater is an elongated plate made of alumina. The substrate 140 is 1 mm in thickness, is 290 mm in length in a direction perpendicular to the recording medium conveyance direction, and is 10 mm in width in the recording medium conveyance direction. The heat generating resistor formed on the substrate 140 is 1.6 mm in width in the short direction of the substrate.

The widths of the conductor members of the comparative examples 10 and 20 in the short direction of the substrate differ from each other. In the comparative example 10, the width of the conductor member in the short direction of the substrate is 1.2 mm throughout the length thereof. In the comparative example 20, the width of the conductor member in the short direction of the substrate is 0.5 mm throughout the length thereof.

In evaluation of the nonuniformity of heat generation in the long direction of the substrate for the comparative example 10, the comparative example 20, and the fifth exemplary embodiment, the total resistance value of the heater is 20Ω. The nonuniformity of heat generation is evaluated by supplying 800-W power to the heater and acquiring, when some part of the heater surface becomes 200° C., a difference temperature obtained by subtracting the lowest temperature of the heater surface from 200° C.

In evaluation of heater cracking margin, as indicated in Table 6, a period of time from start of supplying a constant power of 1400 W to the heater until cracking occurs in the substrate is measured. Thereafter, a difference between the time to cracking of the substrate and a thermal switch turn-off time is obtained, and the differences are compared with one another. Note that to ensure safety, it is desirable that the heater cracking margin be 2 seconds or longer.

The results of evaluation of the heaters in the comparative example 10 and the comparative example 20 are described below. For the heater in the comparative example 10, since the width of the conductor member is set to a large value of 1.2 mm, the electric resistance of the conductor member is low and, thus, voltage drop of the conductor member in the long direction of the substrate is decreased. Accordingly, the nonuniformity of heat generation of the heater in the long direction of the substrate can be a small value of 6° C. In contrast, in terms of a heater cracking margin, since the width of the conductor member is set to a large value, t/d is a large value of 0.25. Thus, it is difficult to dispose the heat generating resistor at a position sufficiently close to an end portion of the substrate in the short direction of the substrate. Consequently, the heater cracking margin is 1.5 seconds, which is less than 2 seconds. As a result, although the existing heater in the comparative example 10 has a satisfactory level of nonuniformity of heat generation, the heater has an unsatisfactory heater cracking margin.

Figure 28:
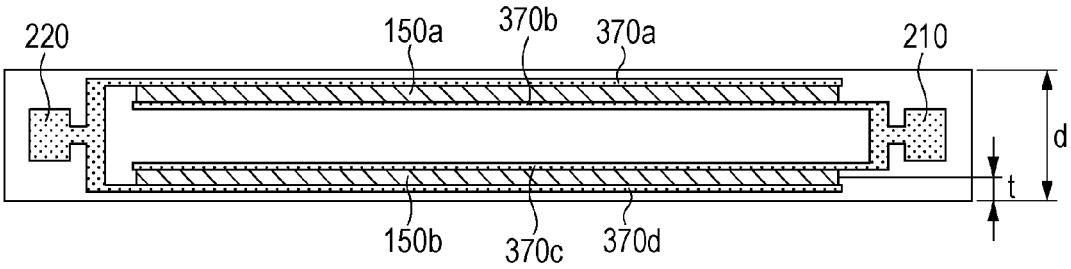
FIG. 28 is a plan view of a heater that is illustrated in FIG. 25 and that has a small conductive width.
Figure 29A:
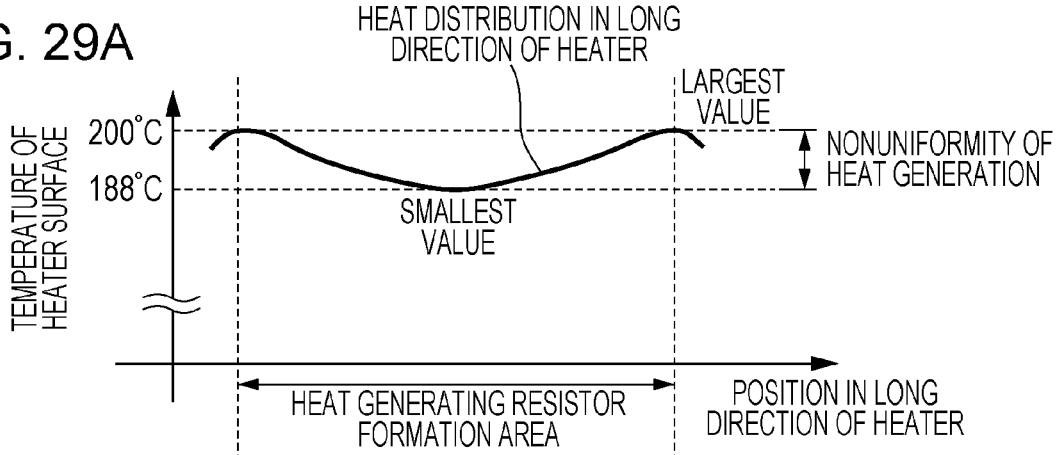
FIGS. 29A and 29B illustrate the heat distribution and the potential distribution in the length direction of a substrate of the heater illustrated in FIG. 28.
Figure 29B:
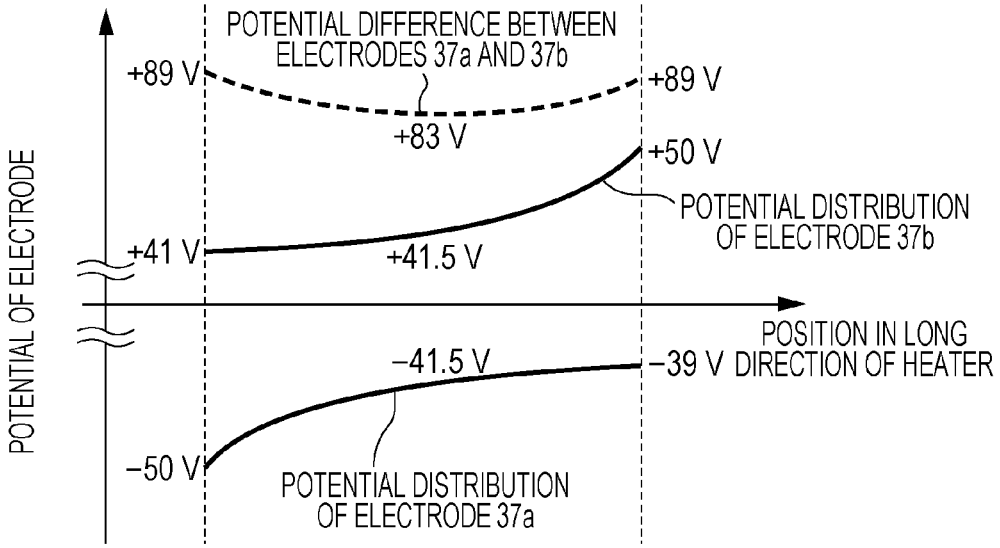

For the heater in the comparative example 20 illustrated in FIG. 28, since the width of the conductor member is set to a small value of 0.5 mm, t/d is a small value of 0.18. Accordingly, the heat generating resistor can be disposed closer to the end of the substrate than in the comparative example 10 and, thus, the heater cracking margin is 5.9 seconds, which is longer than that in the comparative example 10. That is, the heater cracking margin is satisfactory. In contrast, since the width of the conductor member in the short direction of the substrate is set to a small value, the resistance of the conductor member increases and, thus, voltage drop of the conductor member in the long direction of the substrate increases. Accordingly, the nonuniformity of heat generation of the heater in the long direction of the substrate of the heater is a large value of 12° C. As a result, although the heater in the comparative example 20 has a satisfactory heater cracking margin, the heater cannot sufficiently prevent nonuniformity of heat generation.

As described above, it is difficult for the heaters in the comparative example 10 and the comparative example 20 to prevent the nonuniformity of heat generation of the heater in the long direction of the substrate and provide a satisfactory heater cracking margin at the same time.

The result of evaluation of the heaters according to the fifth exemplary embodiment is described below. According to the fifth exemplary embodiment, since the width of each of the conductor portion 310*a* and the conductor portion 310*d* of the conductor member is set to a small value of 0.5 mm, t/d can be a small value of 0.18. Accordingly, since the heat generating resistor can be disposed so as to be sufficiently close to an end portion of the heater substrate in the short direction of the substrate, the heater cracking margin can be 6.1 seconds. As a result, a satisfactory result can be obtained.

Figure 20A:
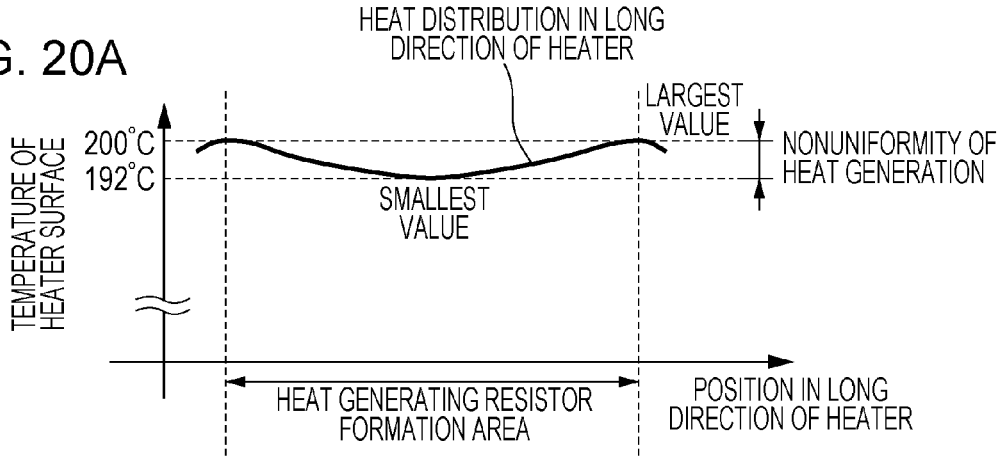
FIGS. 20A and 20B illustrate the heat distribution and the potential distribution in the length direction of a substrate of a heater according to the fifth exemplary embodiment.
Figure 20B:
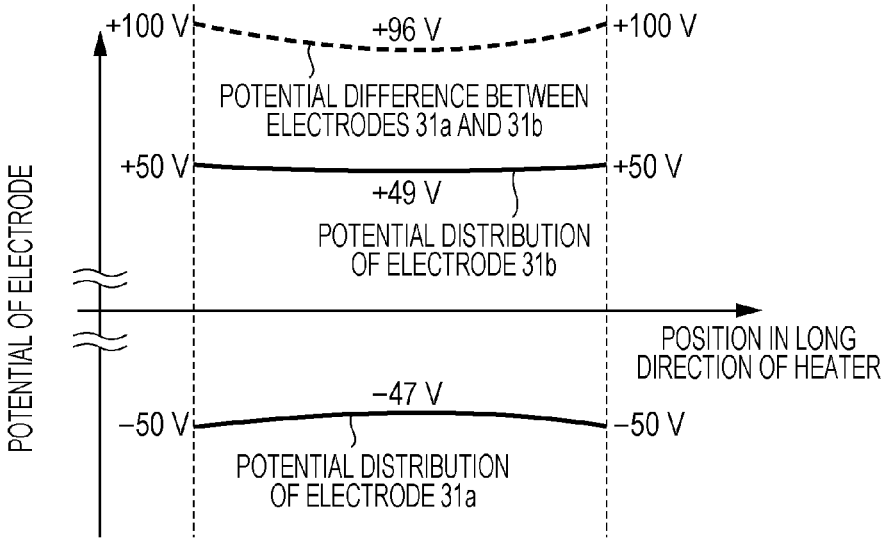

The nonuniformity of heat generation in the length direction of the heater according to the fifth exemplary embodiment is described next. FIG. 20A illustrates the heat distribution of the heater in the long direction of the substrate according to the fifth exemplary embodiment. As can be seen from the heat distribution of FIG. 20A, the temperature is maximized in both end portions of the heater in the long direction of the substrate and is minimized in the middle portion. This is because since power is supplied to the conductor portion 310*a* and the conductor portion 310*b* from both end portions of the substrate in the long direction of the substrate, the voltage drops from each of both end portions toward the middle portion in the short direction of the substrate of the heater. The distribution of a potential difference between the conductor portion 310*a* and the conductor portion 310*b* is indicated by a dotted line in FIG. 20B. The distribution of a potential difference between the conductor portion 310*c* and the conductor portion 310*d* is the same as that between the conductor portion 310*a* and the conductor portion 310*b*. Note that the voltage values shown in FIG. 20B are values obtained at a given time. According to the fifth exemplary embodiment, since an AC voltage is applied, the conductor portion 310*b* may have a negative voltage value and the conductor portion 310*a* may have a positive voltage value at a certain moment.

In terms of the nonuniformity of heat generation according to the fifth exemplary embodiment, since the width of each of the conductor portion 310*a* and the conductor portion 310*d* in the short direction of the substrate is small, voltage drop in the long direction of the substrate increases, as in the comparative example 20. However, by increasing the width of each of the conductor portion 310*b* and the conductor portion 310*c*, the voltage drop of each of the conductor portion 310*b* and the conductor portion 310*c* is decreased. In this manner, the voltage drop of each of the conductor portion 310*a* and the conductor portion 310*d* can be compensated for. As a result, the nonuniformity of heat generation can be reduced to 8° C., which is satisfactory.

As described above, according to the fifth exemplary embodiment, the heater can prevent the nonuniformity of heat generation of the heater in the long direction of the substrate and provide a satisfactory heater cracking margin at the same time.

Sixth Exemplary Embodiment

Figure 21:
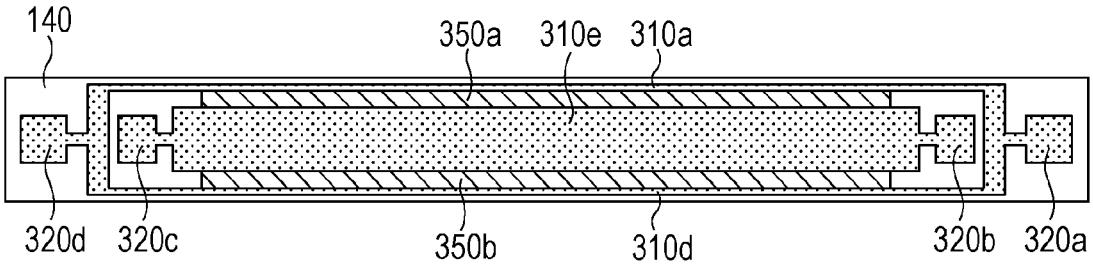
FIG. 21 is a plan view of a heater according to a sixth exemplary embodiment.

The configurations of an image forming apparatus and a fixing device 8 according to a sixth exemplary embodiment are the same as those of the fifth exemplary embodiment. Accordingly, descriptions of the configurations are not repeated. Only the configuration of a heater according to the sixth exemplary embodiment is described below. FIG. 21 is a plan view of a heater 130 mounted in the fixing device 8 of the sixth exemplary embodiment. The same numbering is used for the elements of the heater 130 as in the fifth exemplary embodiment.

The heater according to the sixth exemplary embodiment (refer to FIG. 21) differs from the heater according to the fifth exemplary embodiment (refer to FIG. 19) in the shape of the first conductor member. The first conductor member according to the fifth exemplary embodiment is annular in shape. In contrast, according to the sixth exemplary embodiment, the first conductor member is configured as a conductor portion 310*e* having a bar shape. The width of the conductor portion 310*e* of the first conductor member in the short direction of the substrate is 4.8 mm. That is, to prevent the nonuniformity of heat generation, voltage drop of the conductor portion 310*e* in the long direction of the substrate is decreased by increasing the width of the first conductor member to a value greater than that of the fifth exemplary embodiment.

The results of evaluation of the nonuniformity of heat generation in the long direction of the substrate and the heater cracking margin for the heater according to the fifth exemplary embodiment and the heater according to the sixth exemplary embodiment are shown in Table 7. Since the evaluation system for the nonuniformity of heat generation and the heater cracking margin are the same as that in the fifth exemplary embodiment, description of the evaluation system is not repeated.

TABLE 7

| Heater Pattern | Nonuniformity of Heat Generation | Heater Cracking Margin |
|---|---|---|
| Fifth Exemplary Embodiment (FIG. 19) | 8° C. (FIG. 20A) | 6.1 seconds |
| Sixth Exemplary Embodiment (FIG. 21) | 7° C. (FIG. 22A) | 6.2 seconds |

Figure 22A:
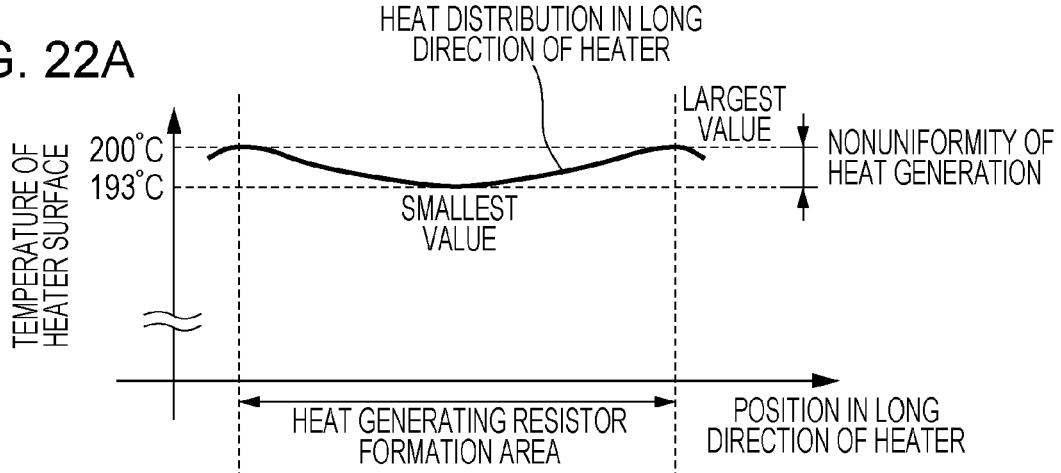
FIGS. 22A and 22B illustrate the heat distribution and the potential distribution in the length direction of a substrate of the heater according to the sixth exemplary embodiment.
Figure 22B:
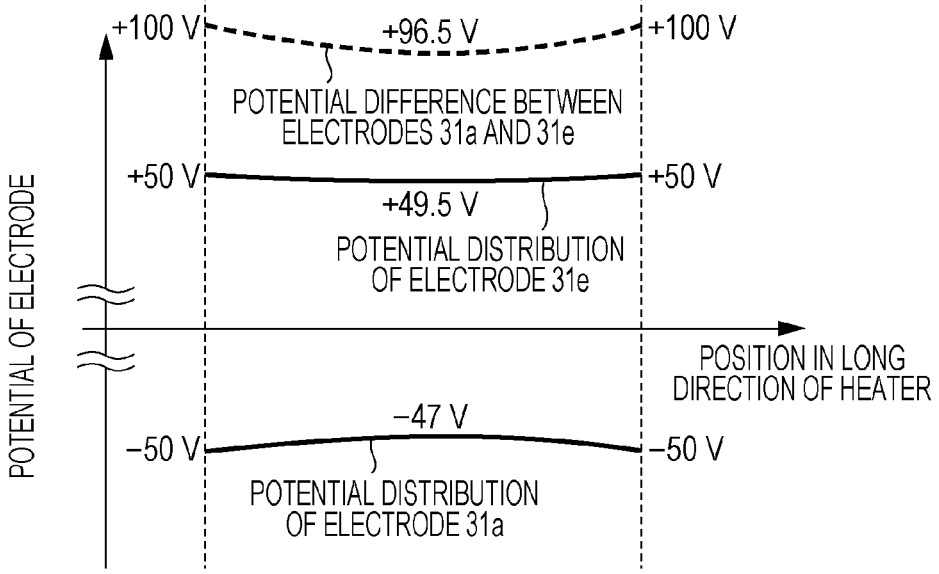
Figure 23:
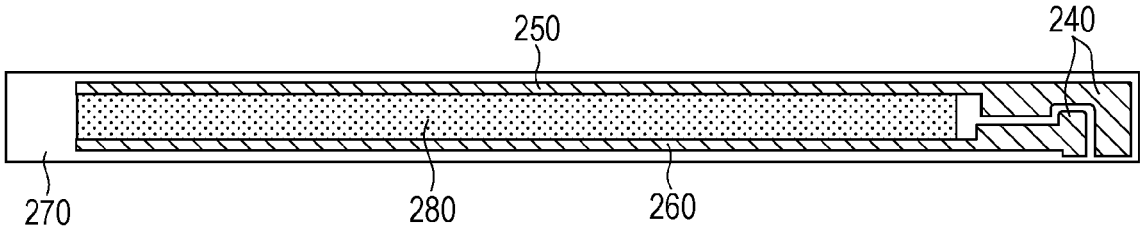
FIG. 23 is a plan view of an existing heater having a one-side power supply configuration.
Figure 24A:
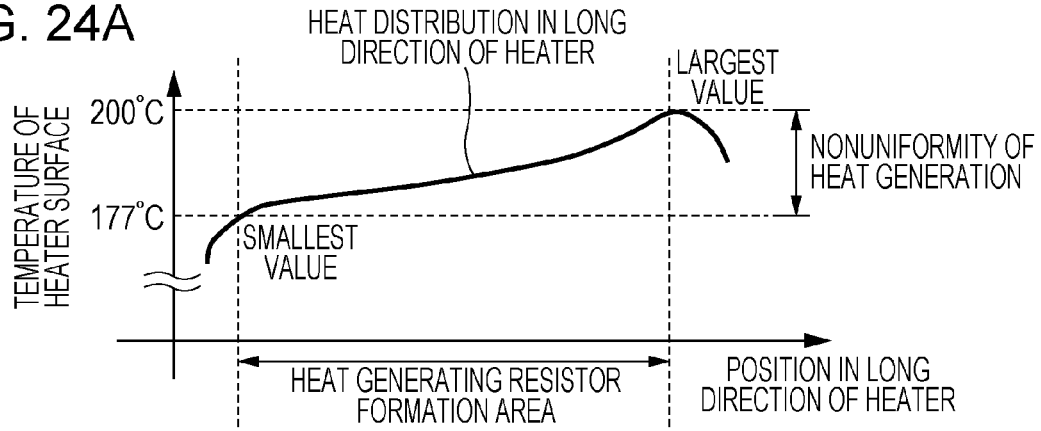
FIGS. 24A and 24B illustrate the heat distribution and the potential distribution in the length direction of a substrate of the heater illustrated in FIG. 23.
Figure 24B:
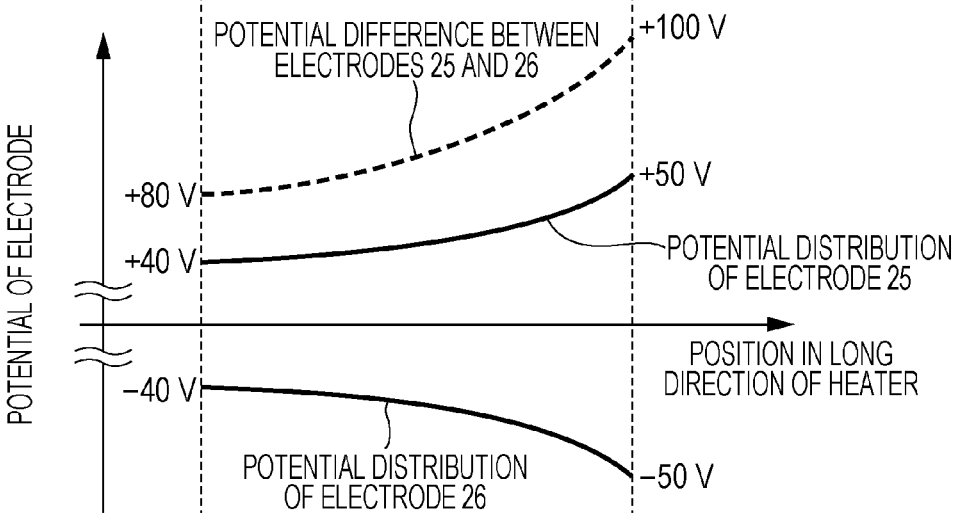

The nonuniformity of heat generation of the heater according to the sixth exemplary embodiment is described next. FIG. 22A illustrates the heat distribution of the heater in the long direction of the substrate according to the sixth exemplary embodiment. According to the heat of the sixth exemplary embodiment, the temperature is maximized in both end portions of the heater in the long direction of the substrate and is minimized in the middle portion. The reason for that is the same as that of the fifth exemplary embodiment. That is, as illustrated in FIG. 22B, the voltages of the conductor portion 310*e* and the second conductor member drop in the long direction of the substrate, and the distribution of a potential difference between the conductor portion 310*a* and the conductor portion 310*e* is indicated by a dotted line in FIG. 22B. In addition, the distribution of a potential difference between the conductor portion 310*e* and the conductor portion 310*d* is the same as the potential difference between the conductor portion 310*a* and the conductor portion 310*e*. Note that the voltage values shown in FIG. 22B are values obtained at a certain moment. According to the sixth exemplary embodiment, since an AC voltage is applied, the conductor portion 310*e* may have a negative voltage value and the conductor portion 310*a* may have a positive voltage value at a given time. As illustrated in FIG. 22B, According to the sixth exemplary embodiment, since the width of the conductor portion 310*e*, which is the first conductor member disposed in the middle, is increased, the voltage drop of the conductor portion 310*e* is smaller than that of the conductor portion 310*a*. In addition, according to the sixth exemplary embodiment, since the conductor width of the conductor portion 310*e* is set to greater than that of the conductor portion 310*b* of the fifth exemplary embodiment, the voltage drop of the conductor portion 310*e* is smaller than that of the conductor portion 310*b* of the fifth exemplary embodiment (refer to FIGS. 20A and 20B). Thus, variation of the potential difference between the conductor portion 310*a* and the conductor portion 310*e* in the length direction can be reduced. According to the sixth exemplary embodiment, the nonuniformity of heat generation in the long direction of the substrate can be reduced to 7° C. That is, the inhibiting effect of the nonuniformity of heat generation is greater than that of the fifth exemplary embodiment.

The heater cracking margin of the heater according to the sixth exemplary embodiment is described next. According to the sixth exemplary embodiment, the conductive width of each of the conductor portion 310*a* and the conductor portion 310*d* is set to a small value of 0.5 mm. Accordingly, t/d can be a small value of 0.18 and, thus, the heat generating resistor can be disposed close to the end portion of the substrate. As a result, the heater cracking time is a long time of 6.2 seconds and, thus, heater cracking during thermal runaway can be sufficiently prevented.

As described above, according to the configuration of the sixth exemplary embodiment, the heater can prevent the nonuniformity of heat generation of the heater in the long direction of the substrate more effectively than in the fifth exemplary embodiment and provide a satisfactory heater cracking margin at the same time.

Note that when the dimensions of the conductor member are large and if a glass layer is provided on the conductor member, the impedance of the glass decreases and, thus, an electric current easily flows in the glass layer. That is, large dimensions of the conductor member have a negative impact on the withstand voltage. As used herein, the term "withstand voltage" refers to a voltage obtained when an electrode A is in contact with the glass layer of the heater, an electrode B is in contact with the electrical contact portion of the heater, the voltage is applied between the electrodes A and B, and leakage occurs. That is, the sixth exemplary embodiment has an advantage over the fifth exemplary embodiment in terms of the nonuniformity of heat generation, but has a disadvantage over the fifth exemplary embodiment in terms of an actual withstand voltage.

Accordingly, if a withstand voltage margin has a priority over the nonuniformity of heat generation, it is desirable that the configuration according to the fifth exemplary embodiment be employed. In contrast, if the nonuniformity of heat generation has a priority over a withstand voltage margin, it is desirable that the configuration according to the sixth exemplary embodiment be employed.

Seventh Exemplary Embodiment

Figure 30A:
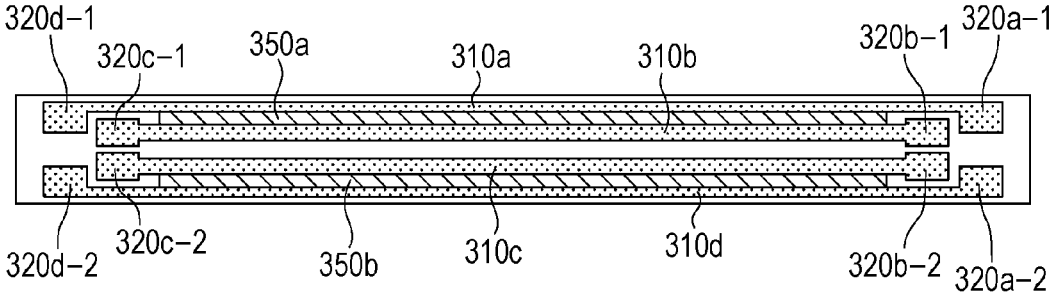
FIG. 30A is a plan view of a heater according to a seventh exemplary embodiment.

The configuration according to a seventh exemplary embodiment is illustrated in FIG. 30A. A difference between the seventh exemplary embodiment and the fifth exemplary embodiment is described below. Since the seventh exemplary embodiment and the fifth exemplary embodiment are the same except for a conductor pattern, description of the configuration other than the conductor pattern are not repeated.

According to the fifth exemplary embodiment, the electrical contact portion 320*a* is disposed in one of the end portions of the substrate in the long direction of the substrate. In the end portion, the conductor portion 310*a* merges with the conductor portion 310*d*. In addition, the electrical contact portion 320*d* is disposed in the other end portion. In the end portion, the conductor portion 310*a* merges with the conductor portion 310*d*. Furthermore, according to the fifth exemplary embodiment, the electrical contact portion 320*b* is disposed in one of the end portions of the substrate in the long direction of the substrate. In the end portion, the conductor portion 310*b* merges with the conductor portion 310*c*. In addition, the electrical contact portion 320*c* is disposed in the other end portion. In the end portion, the conductor portion 310*b* merges with the conductor portion 310*c*.

In contrast, unlike the fifth exemplary embodiment, according to the seventh exemplary embodiment, electrical contact portions disposed in the end portions of the conductor portion 310*b* and the conductor portion 310*c*, which serve as the first conductor member, in the long direction of the substrate are separated from each other on the substrate. The conductor portion 310*b* and the conductor portion 310*c* are electrically connected to each other inside a power supply connector (not illustrated) via the electrical contact portions. This is a difference from the fifth exemplary embodiment. In addition, according to the seventh exemplary embodiment, end portions of the conductor portion 310*a* and the conductor portion 310*d*, which serve as the second conductor member, in the long direction of the substrate are separated from each other on the substrate. The conductor portion 310*a* and the conductor portion 310*d* are electrically connected to each other inside a power supply connector (not illustrated) via the electrical contact portions. This is another difference from the fifth exemplary embodiment.

According to the seventh exemplary embodiment, an electrical contact portion 320*a*-1 is disposed in one of both end portions of the conductor portion 310*a* in the long direction of the substrate, and an electrical contact portion 320*d*-1 is disposed in the other end portion. In addition, an electrical contact portion 320*a*-2 is disposed in one of both end portions of the conductor portion 310*d* in the long direction of the substrate, and an electrical contact portion 320*d*-2 is disposed in the other end portion. Furthermore, an electrical contact portion 320*b*-1 is disposed in one of both end portions of the conductor portion 310*b* in the long direction of the substrate, and an electrical contact portion 320*c*-1 is disposed in the other end portion. Still furthermore, an electrical contact portion 320*b*-2 is disposed in one of both end portions of the conductor portion 310*c* in the long direction of the substrate, and an electrical contact portion 320*c*-2 is disposed in the other end portion. Voltages having the same polarity are applied to the electrical contact portion 320*b*-1 and the electrical contact portion 320*b*-2 by a first power supply connector (not illustrated), and voltages having the same polarity are applied to the electrical contact portion 320*c*-1 and the electrical contact portion 320*c*-2 by a second power supply connector (not illustrated). Voltages having the same polarity are applied to the electrical contact portion 320*a*-1 and the electrical contact portion 320*a*-2 by a third power supply connector (not illustrated), and voltages having the same polarity are applied to the electrical contact portion 320*d*-1 and the electrical contact portion 320*d*-2 by a fourth power supply connector (not illustrated). The polarity of the voltage applied by the first power supply connector is the same as the polarity of the voltage applied by the second power supply connector, and the polarity of the voltage applied by the third power supply connector is the same as the polarity of the voltage applied by the fourth power supply connector. Still furthermore, the polarity of the voltage applied by the first power supply connector is opposite to the polarity of the voltage applied by the third power supply connector. Note that like the fifth exemplary embodiment, the width of the conductor portion 310*a* and the conductor portion 310*d* in the short direction of the substrate is smaller than the width of the conductor portion 310*b* and the conductor portion 310*c* in the short direction of the substrate.

Figure 30B:
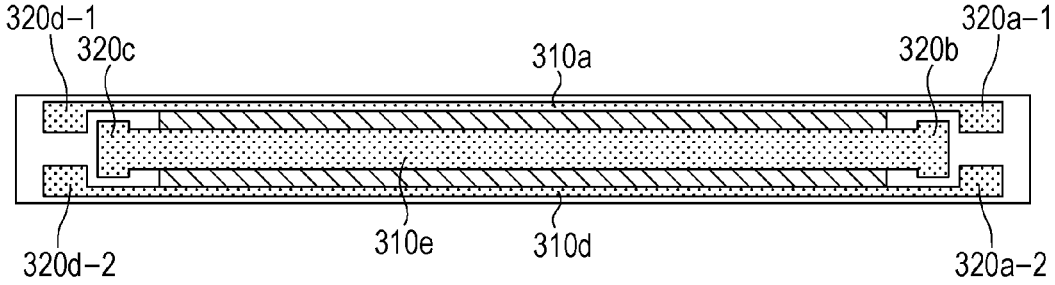
FIG. 30B is a plan view of a heater according to a modification of the seventh exemplary embodiment.

Yet still furthermore, according to a modification of the seventh exemplary embodiment, the heater may have a configuration illustrated in FIG. 30B. The modification of the seventh exemplary embodiment differs from the configuration of the sixth exemplary embodiment in only a conductor pattern. Accordingly, description of the other configurations is not repeated. Unlike the configuration of the sixth exemplary embodiment, in the configuration illustrated in FIG. 30B, the end portions of the conductor portion 310*a* and the conductor portion 310*d* which constitute the first conductor member are separated from each other on the substrate, and the conductor portion 310*a* and the conductor portion 310*d* are electrically connected to each other in a power supply connector (not illustrated) via the electrical contact portions. According to the modification of the seventh exemplary embodiment, the electrical contact portion 320*a*-1 is disposed in one of both end portions of the conductor portion 310*a* in the long direction of the substrate, and the electrical contact portion 320*d*-1 is disposed in the other end portion. In addition, the electrical contact portion 320*a*-2 is disposed in one of both end portions of the conductor portion 310*d* in the long direction of the substrate, and the electrical contact portion 320*d*-2 is disposed in the other end portion. Voltages having the same polarity are applied to the electrical contact portion 320*a*-1 and the electrical contact portion 320*a*-2 by the first power supply connector (not illustrated), and voltages having the same polarity are applied to the electrical contact portion 320*d*-1 and the electrical contact portion 320*d*-2 by the second power supply connector (not illustrated). The polarity of the voltages applied by the first power supply connector is the same as the polarity of the voltages applied by the second power supply connector. Note that like the sixth exemplary embodiment, the width of the conductor portion 310*a* and the conductor portion 310*d* in the short direction of the substrate is smaller than the width of the conductor portion 310*e* in the short direction of the substrate.

The operations and the effects of the seventh exemplary embodiment and the modification of the seventh exemplary embodiment are the same as those of the fifth exemplary embodiment and the sixth exemplary embodiment, respectively.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A heater for use in a fixing device that fixes a toner image onto a recording medium, the heater comprising:

an elongated planar substrate;

a first conductor pattern provided on the substrate along a longitudinal direction of the substrate, the first conductor pattern has an annular shape that includes first and second conductor portions provided along the longitudinal direction;

a second conductor pattern provided on the substrate along the longitudinal direction, the second conductor pattern has an annular shape that includes first and second conductor portions provided along the longitudinal direction;

a first heat generating resistor electrically connected to the first conductor portion of the first conductor pattern and the first conductor portion of the second conductor pattern, the first heat generating resistor being disposed between the first conductor portion of the first conductor pattern and the first conductor portion of the second conductor pattern;

a second heat generating resistor electrically connected to the second conductor portion of the first conductor pattern and the second conductor portion of the second conductor pattern, the second heat generating resistor being disposed between the second conductor portion of the first conductor pattern and the second conductor portion of the second conductor pattern;

a first electrical contact portion disposed at one end portion of the first conductor pattern in the longitudinal direction;

a second electrical contact portion disposed at the opposite end portion of the first conductor pattern in the longitudinal direction where the first electrical contact portion is disposed;

a third electrical contact portion disposed at one end portion of the second conductor pattern in the longitudinal direction; and a fourth electrical contact portion disposed at the opposite end portion of the second conductor pattern in the longitudinal direction where the third electrical contact portion is disposed, wherein the first and second heat generating resistors generates heat by electrical power supplied through the first, second, third, and fourth electrical contact portions.

2. The heater according to claim 1, wherein the width of the first conductor portion of the first conductor pattern in the direction perpendicularly to the longitudinal direction is larger than the width of the first conductor portion of the second conductor pattern in the direction perpendicularly to the longitudinal direction.

3. The fixing device according to claim 2, wherein the width of the first conductor portion of the first conductor pattern in the direction perpendicularly to the longitudinal direction is larger than the width of the first conductor portion of the second conductor pattern in the direction perpendicularly to the longitudinal direction.

4. A fixing device for fixing a toner image onto a recording medium while conveying the recording medium at a nip portion, the device comprising:

a cylindrical film;

a heater in contact with an inner surface of the film; and a pressing member configured to form the nip portion with the heater via the film, wherein the heater includes:

an elongated planar substrate;

a first conductor pattern provided on the substrate along a longitudinal direction of the substrate, the first conductor pattern has an annular shape that includes first and second conductor portions provided along the longitudinal direction;

a second conductor pattern provided on the substrate along the longitudinal, the second conductor pattern has an annular shape that includes first and second conductor portions provided along the longitudinal direction;

a first heat generating resistor electrically connected to the first conductor portion of the first conductor pattern and the first conductor portion of the second conductor pattern, the first heat generating resistor being disposed between the first conductor portion of the first conductor pattern and the first conductor portion of the second conductor pattern;

a second heat generating resistor electrically connected to the second conductor portion of the first conductor pattern and the second conductor portion of the second conductor pattern, the second heat generating resistor being disposed between the second conductor portion of the first conductor pattern and the second conductor portion of the second conductor pattern;

a first electrical contact portion disposed at one end portion of the first conductor pattern in the longitudinal direction;

a second electrical contact portion disposed at the opposite end portion of the first conductor pattern in the longitudinal direction where the first electrical contact portion is disposed;

a third electrical contact portion disposed at one end portion of the second conductor pattern in the longitudinal direction; and a fourth electrical contact portion disposed at the opposite end portion of the second conductor pattern in the longitudinal direction where the third electrical contact portion is disposed, wherein the first and second heat generating resistors generates heat by electrical power supplied through the first, second, third, and fourth electrical contact portions.

5. A heater for use in a fixing device that fixes a toner image onto a recording medium, comprising:

an elongated planar substrate;

a first conductor pattern provided on the substrate along a longitudinal direction of the substrate;

a second conductor pattern provided on the substrate along the longitudinal direction, the second conductor pattern has an annular shape that includes first and second conductor portions provided along the longitudinal direction;

a first heat generating resistor electrically connected to the first conductor pattern and the first conductor portion of the second conductor pattern, the first heat generating resistor being disposed between the first conductor pattern and the first conductor portion of the second conductor pattern;

a second heat generating resistor electrically connected to the first conductor pattern and the second conductor portion of the second conductor pattern, the second heat generating resistor being disposed between the first conductor pattern and the second conductor portion of the second conductor pattern;

a first electrical contact portion disposed at one end portion of the first conductor pattern in the longitudinal direction;

a second electrical contact portion disposed at the opposite end portion of the first conductor pattern in the longitudinal direction where the first electrical contact portion is disposed;

a third electrical contact portion disposed at one end portion of the second conductor pattern in the longitudinal direction; and a fourth electrical contact portion disposed at the opposite end portion of the second conductor pattern in the longitudinal direction where the third electrical contact portion is disposed, wherein the first and second heat generating resistors generates heat by electrical power supplied through the first, second, third, and fourth electrical contact portions.

6. The heater according to claim 5, wherein the width of the first conductor pattern in the direction perpendicularly to the longitudinal direction is larger than the width of the first conductor portion of the second conductor pattern in the direction perpendicularly to the longitudinal direction.

7. A fixing device for fixing a toner image onto a recording medium while conveying the recording medium at a nip portion, the device comprising:

a cylindrical film;

a heater in contact with an inner surface of the film; and a pressing member configured to form the nip portion with the heater via the film, wherein the heater includes:

an elongated planar substrate;

a first conductor pattern provided on the substrate along a longitudinal direction of the substrate;

a second conductor pattern provided on the substrate along the longitudinal direction, the second conductor pattern has an annular shape that includes first and second conductor portions provided along the longitudinal direction;

a first heat generating resistor electrically connected to the first conductor pattern and the first conductor portion of the second conductor pattern, the first heat generating resistor being disposed between the first conductor pattern and the first conductor portion of the second conductor pattern;

a second heat generating resistor electrically connected to the first conductor pattern and the second conductor portion of the second conductor pattern, the second heat generating resistor being disposed between the first conductor pattern and the second conductor portion of the second conductor pattern;

a first electrical contact portion disposed at one end portion of the first conductor pattern in the longitudinal direction;

a second electrical contact portion disposed at the opposite end portion of the first conductor pattern in the longitudinal direction where the first electrical contact portion is disposed;

a third electrical contact portion disposed at one end portion of the second conductor pattern in the longitudinal direction; and a fourth electrical contact portion disposed at the opposite end portion of the second conductor pattern in the longitudinal direction where the third electrical contact portion is disposed, wherein the first and second heat generating resistors generates heat by electrical power supplied through the first, second, third, and fourth electrical contact portions.

8. The fixing device according to claim 7, wherein the width of the first conductor pattern in the direction perpendicularly to the longitudinal direction is larger than the width of the first conductor portion of the second conductor pattern in the direction perpendicularly to the longitudinal direction.

9. A heater for use in a fixing device that fixes a toner image onto a recording medium, the heater comprising:

an elongated planar substrate;

a first conductor pattern provided on the substrate along a longitudinal direction of the substrate, the first conductor pattern includes first and second conductor portions provided along the longitudinal direction;

a second conductor pattern provided on the substrate along the longitudinal direction, the second conductor pattern includes first and second conductor portions provided along the longitudinal direction;

a first heat generating resistor electrically connected to the first conductor portion of the first conductor pattern and the first conductor portion of the second conductor pattern, the first heat generating resistor being disposed between the first conductor portion of the first conductor pattern and the first conductor portion of the second conductor pattern;

a second heat generating resistor electrically connected to the second conductor portion of the first conductor pattern and the second conductor portion of the second conductor pattern, the second heat generating resistor being disposed between the second conductor portion of the first conductor pattern and the second conductor portion of the second conductor pattern;

a first electrical contact portion disposed at one end portion of the first conductor portion of the first conductor pattern in the longitudinal direction;

a second electrical contact portion disposed at the opposite end portion of the first conductor portion of the first conductor pattern in the longitudinal direction where the first electrical contact portion is disposed;

a third electrical contact portion disposed at one end portion of the second conductor portion of the first conductor pattern in the longitudinal direction;

a fourth electrical contact portion disposed at the opposite end portion of the second conductor portion of the first conductor pattern in the longitudinal direction where the third electrical contact portion is disposed;

a fifth electrical contact portion disposed at one end portion of the first conductor portion of the second conductor pattern in the longitudinal direction; and a sixth electrical contact portion disposed at the opposite end portion of the first conductor portion of the second conductor pattern in the longitudinal direction where the fifth electrical contact portion is disposed, a seventh electrical contact portion disposed at one end portion of the second conductor portion of the second conductor pattern in the longitudinal direction; and an eighth electrical contact portion disposed at the opposite end portion of the second conductor portion of the second conductor pattern in the longitudinal direction where the seventh electrical contact portion is disposed, wherein polarity of the voltages applied to the first to fourth electrical contact portions are the same, and polarity of the voltages applied to the fifth to eighth electrical contact portions are the same and opposite to the polarity of the voltages applied to the first to fourth electrical contact portions, and wherein the first and second heat generating resistors generates heat by electrical power supplied through the first to eighth electrical contact portions.

10. A fixing device for fixing a toner image onto a recording medium while conveying the recording medium at a nip portion, the device comprising:

a cylindrical film;

a heater in contact with an inner surface of the film; and a pressing member configured to form the nip portion with the heater via the film, wherein the heater includes:

an elongated planar substrate;

a first conductor pattern provided on the substrate along a longitudinal direction of the substrate, the first conductor pattern includes first and second conductor portions provided along the longitudinal direction;

a second conductor pattern provided on the substrate along the longitudinal direction, the second conductor pattern includes first and second conductor portions provided along the longitudinal direction;

a first heat generating resistor electrically connected to the first conductor portion of the first conductor pattern and the first conductor portion of the second conductor pattern, the first heat generating resistor being disposed between the first conductor portion of the first conductor pattern and the first conductor portion of the second conductor pattern;

a second heat generating resistor electrically connected to the second conductor portion of the first conductor pattern and the second conductor portion of the second conductor pattern, the second heat generating resistor being disposed between the second conductor portion of the first conductor pattern and the second conductor portion of the second conductor pattern;

a first electrical contact portion disposed at one end portion of the first conductor portion of the first conductor pattern in the longitudinal direction;

a second electrical contact portion disposed at the opposite end portion of the first conductor portion of the first conductor pattern in the longitudinal direction where the first electrical contact portion is disposed;

a third electrical contact portion disposed at one end portion of the second conductor portion of the first conductor pattern in the longitudinal direction;

a fourth electrical contact portion disposed at the opposite end portion of the second conductor portion of the first conductor pattern in the longitudinal direction where the third electrical contact portion is disposed;

a fifth electrical contact portion disposed at one end portion of the first conductor portion of the second conductor pattern in the longitudinal direction; and a sixth electrical contact portion disposed at the opposite end portion of the first conductor portion of the second conductor pattern in the longitudinal direction where the fifth electrical contact portion is disposed, a seventh electrical contact portion disposed at one end portion of the second conductor portion of the second conductor pattern in the longitudinal direction; and an eighth electrical contact portion disposed at the opposite end portion of the second conductor portion of the second conductor pattern in the longitudinal direction where the seventh electrical contact portion is disposed, wherein polarity of the voltages applied to the first to fourth electrical contact portions are the same, and polarity of the voltages applied to the fifth to eighth electrical contact portions are the same and opposite to the polarity of the voltages applied to the first to fourth electrical contact portions, and wherein the first and second heat generating resistors generates heat by electrical power supplied through the first to eighth electrical contact portions.

11. A heater for use in a fixing device that fixes a toner image onto a recording medium, comprising:

an elongated planar substrate;

a first conductor pattern provided on the substrate along a longitudinal direction of the substrate;

a second conductor pattern provided on the substrate along the longitudinal direction, the second conductor pattern includes first and second conductor portions provided along the longitudinal direction;

a first heat generating resistor electrically connected to the first conductor pattern and the first conductor portion of the second conductor pattern, the first heat generating resistor being disposed between the first conductor pattern and the first conductor portion of the second conductor pattern;

a second heat generating resistor electrically connected to the first conductor pattern and the second conductor portion of the second conductor pattern, the second heat generating resistor being disposed between the first conductor pattern and the second conductor portion of the second conductor pattern;

a first electrical contact portion disposed at one end portion of the first conductor pattern in the longitudinal direction;

a second electrical contact portion disposed at the opposite end portion of the first conductor pattern in the longitudinal direction where the first electrical contact portion is disposed;

a third electrical contact portion disposed at one end portion of the first conductor portion of the second conductor pattern in the longitudinal direction; and a fourth electrical contact portion disposed at the opposite end portion of the first conductor portion of the second conductor pattern in the longitudinal direction where the third electrical contact portion is disposed, a fifth electrical contact portion disposed at one end portion of the second conductor portion of the second conductor pattern in the longitudinal direction; and a sixth electrical contact portion disposed at the opposite end portion of the second conductor portion of the second conductor pattern in the longitudinal direction where the fifth electrical contact portion is disposed, wherein polarity of the voltages applied to the first and second electrical contact portions are the same, and polarity of the voltages applied to the third to sixth electrical contact portions are the same and opposite to the polarity of the voltages applied to the first and second electrical contact portions, and wherein the first and second heat generating resistors generates heat by electrical power supplied through the first to sixth electrical contact portions.

12. A fixing device for fixing a toner image onto a recording medium while conveying the recording medium at a nip portion, the device comprising:

a cylindrical film;

a heater in contact with an inner surface of the film; and a pressing member configured to form the nip portion with the heater via the film, wherein the heater includes:

an elongated planar substrate;

a first conductor pattern provided on the substrate along a longitudinal direction of the substrate;

a second conductor pattern provided on the substrate along the longitudinal direction, the second conductor pattern includes first and second conductor portions provided along the longitudinal direction;

a first heat generating resistor electrically connected to the first conductor pattern and the first conductor portion of the second conductor pattern, the first heat generating resistor being disposed between the first conductor pattern and the first conductor portion of the second conductor pattern;

a second heat generating resistor electrically connected to the first conductor pattern and the second conductor portion of the second conductor pattern, the second heat generating resistor being disposed between the first conductor pattern and the second conductor portion of the second conductor pattern;

a first electrical contact portion disposed at one end portion of the first conductor pattern in the longitudinal direction;

a second electrical contact portion disposed at the opposite end portion of the first conductor pattern in the longitudinal direction where the first electrical contact portion is disposed;

a third electrical contact portion disposed at one end portion of the first conductor portion of the second conductor pattern in the longitudinal direction; and a fourth electrical contact portion disposed at the opposite end portion of the first conductor portion of the second conductor pattern in the longitudinal direction where the third electrical contact portion is disposed, a fifth electrical contact portion disposed at one end portion of the second conductor portion of the second conductor pattern in the longitudinal direction; and a sixth electrical contact portion disposed at the opposite end portion of the second conductor portion of the second conductor pattern in the longitudinal direction where the fifth electrical contact portion is disposed, wherein polarity of the voltages applied to the first and second electrical contact portions are the same, and polarity of the voltages applied to the third to sixth electrical contact portions are the same and opposite to the polarity of the voltages applied to the first and second electrical contact portions, and wherein the first and second heat generating resistors generates heat by electrical power supplied through the first to sixth electrical contact portions.

* * * * *